US005452785A

United States Patent [19]

Iwamoto et al.

[11] Patent Number: 5,452,785

[45] Date of Patent: Sep. 26, 1995

[54] COIN DIAMETER DISCRIMINATING APPARATUS

[75] Inventors: Takahisa Iwamoto, Hiratsuka; Ken Shioiri, Atsugi; Yoshifumi Takahashi, Atsugi; Noriyuki Kodama, Atsugi; Shintaro Inagaki, Ebina; Masaru Honma, Atsugi, all of Japan

[73] Assignee: Anritsu Corporation, Tokyo, Japan

[21] Appl. No.: 312,315

[22] Filed: Sep. 26, 1994

Related U.S. Application Data

[62] Division of Ser. No. 66,128, May 25, 1993.

[30] Foreign Application Priority Data

Sep. 28, 1991 [JP] Japan ..... 3-276809
Mar. 13, 1992 [JP] Japan ..... 4-89601

[51] Int. Cl.[6] ..... G07D 5/02; G07D 5/08

[52] U.S. Cl. ..... 194/318; 194/334

[58] Field of Search ..... 194/302, 317, 194/318, 319, 334

[56] References Cited

U.S. PATENT DOCUMENTS

| | | | |
|---|---|---|---|
| 3,918,564 | 11/1975 | Heiman et al. | 194/318 |
| 3,918,565 | 11/1975 | Fougere et al. | 194/317 |
| 4,601,380 | 7/1986 | Dean et al. | 194/318 |
| 4,705,154 | 11/1987 | Masho et al. | 194/319 |
| 4,809,838 | 3/1989 | Houserman | 194/317 |
| 4,870,360 | 9/1989 | Collins et al. | 194/318 X |
| 5,033,603 | 7/1991 | Kai et al. | 194/334 |
| 5,060,778 | 10/1991 | Daw | 194/334 X |

FOREIGN PATENT DOCUMENTS

| | | |
|---|---|---|
| 44-10684 | 5/1969 | Japan . |
| 48-29499 | 4/1973 | Japan . |
| 57-43950 | 9/1982 | Japan . |
| 57-147789 | 9/1982 | Japan . |
| 59-69885 | 4/1984 | Japan . |
| 59-221778 | 12/1984 | Japan . |
| 60-221888 | 11/1985 | Japan . |
| 63-45691 | 2/1988 | Japan . |
| 1-180091 | 7/1989 | Japan . |

*Primary Examiner*—Michael S. Huppert
*Assistant Examiner*—Scott L. Lowe
*Attorney, Agent, or Firm*—Frishauf, Holtz, Goodman, Langer & Chick

[57] ABSTRACT

The present invention relates to a coin discriminating apparatus for discriminating the thickness, material, diameter, and the like of a coin at high precision. A transmission coil (11) receives an AC signal generated by an AC signal generating unit (24) and applies an alternating magnetic field to a coin (C) to be discriminated. A reception coil (12) detects an electromotive force induced when the the transmission coil (11) applies the alternating magnetic field on the coin to be discriminated. A detection signal generating unit (27) generates a detection signal having a predetermined phase with respect to the AC signal generated by the AC signal generating unit (24). A phase detecting unit (26) phase-detects the electromotive force detected by the reception coil (12) in accordance with the detection signal generated by the detection signal generating unit. Discriminating units (28–31) discriminate at least one of the thickness, material, and diameter of the coin to be discriminated on the basis of a signal output from the phase detecting unit (26). Since the thickness, material, and diameter of the coin are independently separately detected, the denomination of the coin can be discriminated at high precision.

3 Claims, 43 Drawing Sheets

COIN DIAMETER DISCRIMINATING APPARATUS

This is division of application Ser. No. 08/066,128, filed May 25, 1993.

FIELD OF THE INVENTION

The present invention relates to a coin discriminating apparatus, used in a pay phone, a vending machine, and the like, for determining the shape or material of a coin by transmission and reception coils arranged on a coin track, thereby discriminating the authenticity, the denomination, and the like of the coin.

DESCRIPTION OF THE RELATED ART

Conventionally, coin discriminating apparatuses of the field described above that utilize various techniques have been developed.

For example, as disclosed in U.S. Pat. No. 4,870,360, a conventional coin discriminating apparatus in a pay phone, a vending machine, or the like that utilizes a magnetic field employs a technique of discriminating the thickness or material of the coin by comparison of a signal from a coin detector and a signal from a standard detector.

More specifically, according to this prior art technique, a test coin C1 and a standard sample coin C2 are disposed in two alternating magnetic fields generated by transmission coils 1 and 2 driven by the same drive unit, as in the basic arrangement as shown in FIG. 56. Detectors 3 and 4 detect magnetic fields near the coins C1 and C2. An output signal from the detector 3 concerning the test coin C1 is compared with an output signal from the detector 4 concerning the standard sample coin C2 by a comparator (not shown), thereby discriminating the thickness or material of the test coin C1.

However, in the conventional coin discriminating apparatus having this arrangement, in addition to the transmission coil 1 and the detector 3 for the test coin C1, the transmission coil 2 and the detector 4 for the standard sample coin C2 are required; that complicates the apparatus. Especially, when a plurality of denominations of coins should be discriminated, test coins, transmission coils, and detectors corresponding in number to the denominations of coins are required, and the apparatus becomes very complicated. In addition, since the determination is performed by simple, comparison of the output signals from the two detectors 3 and 4, it is not possible to distinguish two similar outputs of a coin with a large thickness and another coin with a large conductivity, thus causing incorrect discrimination. Sometimes the standard coin with certain thickness and material and a coin with different thickness and material generate the identical outputs. That is, the thickness and the material cannot be separately detected, causing erroneous discrimination.

Another technique is disclosed in U.S. Pat. Nos. 3,918,564 and 3,918,565.

According to this technique, in a pay phone or a vending machine, in order to discriminate the authenticity, the denomination, and the like of a coin (to be referred to as a coin hereinafter including a counterfeit coin), as shown in FIG. 57, a coin C inserted through a coin slot is caused to fall in rolling contact with a coin track 2. As shown in FIG. 58, the coin track 2 is constituted by a base plate 3 inclined with respect to the vertical plane, a cover plate 4 parallel to the base plate 3, and a rail 5 mounted on the cover plate 4 to be inclined with respect to the horizontal line. The coin C dropping onto the coin track 2 from a coin slot 1 falls in rolling along the inclined rail 5 while its circumferential surface C' contacts the rail 5 and its face C" contacts the base plate 3.

Transmission and reception coils 6 and 7 are inserted in round holes **3*a* and 4*a* of the base and cover plates 3 and 4, respectively, to oppose the coin track 2 and in the vicinity of the rail 5**, such that they are entirely covered with the passing coin C.

The transmission coil 6 generates an alternating magnetic field. When the coin C is in rolling contact with the rail 5 and passes between the coils 5 and 6, a change in magnetic field is caused and it changes the output voltage of the reception coil 7. The change amount in output voltage output from the reception coil 7 depends on both the material (conductivity) and thickness of the coin.

Accordingly, conventionally, the peak value of the change amount in output voltage from the reception coil 7, which is obtained when an authentic coin passes, is measured and stored in advance. A coin is discriminated in accordance with whether the peak value of the change amount in output voltage from the coil 6 falls within the stored allowance range when the coin to be discriminated passes.

However, in this conventional coin discriminating technique, two completely different criteria, i.e., the conductivity and thickness of a coin to be discriminated, are not separated, and a coin is discriminated from detection data that depends on both criteria. Even when the materials (conductivities) of coins are different, the output change amounts from the reception coil 7 can become identical, causing an erroneous discrimination.

More specifically, FIG. 21 is a graph showing the experimental results obtained by the present inventors by plotting the thickness of the coin along the abscissa axis and the output voltage of the reception coil along the ordinate axis. At points A and A', B and B', C and C', and D and D', the coil output voltages coincide. This means that two coins having different conductivities and thicknesses cause to generate identical outputs and thus cannot be discriminated. In this manner, in the conventional coin discriminating apparatus shown in FIGS. 57 and 58, a coin having a large conductivity and a small thickness and a coin having a small conductivity and a large thickness generate substantially identical peak values. Then, an error occurs in discrimination of the authenticity and denomination of coins, and illegal conducts using counterfeit coins cannot be prevented.

In order to prevent this problem, conventionally, combinations of a plurality of pairs of transmission/reception coils having different characteristics are used, and a plurality of magnetic field frequencies are used. Then, however, the circuit configuration of the sensor portion becomes large and complicated, that is very disadvantageous in packaging.

Furthermore, in still another of the conventional pay phones, vending machines, ticket machines, and the like, in order to discriminate the authenticity, denomination, and the like of a coin inserted from a coin slot, the coin (to be referred to as a coin hereinafter including a counterfeit coin) is caused to fall in rolling contact with a coin track, the material, thickness, diameter, and the like of the coin are detected by a material detecting apparatus, a thickness discriminating apparatus, a diameter discriminating apparatus, and the like disposed along the coin selection track, thereby discriminating the inserted coin.

More specifically, as shown in FIG. 59, in a conventional coin diameter discriminating apparatus of this type used for this purpose, two phototransistors 2 and 3 are disposed along a coin track 1, and the diameter of a coin C is discriminated from a time difference in detection signals generated by the phototransistors 2 and 3 when the coin C passes between them (Published Unexamined Japanese Patent Application No. 49-84298).

However, the moving speed of the coin C varies depending on, e.g., the insertion state of the coin. Even when two coins having identical diameters are inserted, if the moving speed of one coin is high, the time difference in detection signals of this coin generated by the two phototransistors 2 and 3 is short, and this coin is discriminated to have a diameter smaller than it actually has. Inversely, if the moving speed of one coin is low, this coin is discriminated to have a diameter larger than it actually has.

A coin diameter discriminating apparatus utilizing a magnetic field generated by an eddy current generated in a coin is conventionally proposed in Published Unexamined Japanese Patent Application No. 59-69885 as an apparatus in which an influence caused by the moving speed of the coin is eliminated.

As shown in FIG. 60, in this coin diameter discriminating apparatus, an eddy current is generated in the peripheral portion of a coin C moving along a coin track 1 by an alternating magnetic field generated by a transmission coil 4. Two reception coils 5 and 6 are provided, at a distance therebetween, along the direction perpendicular to the coin track 1. More specifically, one reception coil 5 is positioned immediately above a rail 1*a* of the coin track 1, and the other reception coil 6 is disposed above the coin track 1 in the vertical direction, i.e., at a position where its degree of encounter changes depending on the diameter of the coin C. The magnetic field caused by the eddy current in the coin C is detected by the two reception coils 5 and 6. As shown in FIG. 60, since the positional relationships between the reception coil 5 and the peripheral portion of the coin C changes, the difference in output voltages of the two reception coils 5 and 6 changes substantially in proportion to the diameter of the coin C. Hence, the diameter of the coin C is discriminated from the voltage difference of the two reception coils 5 and 6.

In the conventional coin diameter discriminating apparatus shown in FIG. 60, since the voltage difference of the two reception coils 5 and 6 disposed perpendicularly to the coin track 1 is used, the erroneous discrimination described above which is caused by a difference in moving speeds of the coins does not occur.

In the conventional coin discriminating apparatus shown in FIG. 60, however, the difference in output voltage of the reception coils 5 and 6 depends not only on the diameter of the coin but also on the thickness and conductivity of the coin. Hence, the identical voltage differences are sometimes obtained from coins having different diameters, or inversely even coins having the same diameter sometimes provide different voltage differences; i.e., high-precision diameter discrimination cannot be performed.

In order to directly detect a voltage difference between the two reception coils, the two reception coils must be disposed in a row on a line perpendicular to the moving direction of the coin, and a plurality of pairs of reception coils are required to obtain a large range of diameter detection.

In still another conventional pay phone, vending machine, ticket machine, and the like, in order to discriminate the authenticity, denomination, and the like of a coin inserted from a coin slot, the coin (to be referred to as a coin hereinafter including a counterfeit coin) is caused to fall in rolling contact with a coin track, and the material, thickness, diameter, and the like of the coin are detected by the detection coils of a material detecting apparatus, a thickness discriminating apparatus, a diameter discriminating apparatus, and the like disposed along the coin selection track, thereby discriminating the inserted coin.

In the conventional coin diameter discriminating apparatus using the detection coils, as shown in FIGS. 61 and 62, a coin C inserted from a coin slot (not shown) drops onto a coin track 2. The coin track 2 is constituted by a base plate 3 inclined with respect to the vertical plane, a cover plate 4 parallel to the base plate 3, and a rail 5 mounted on the cover plate 4 to be inclined with respect to the horizontal line. The coin C dropping onto the coin track 2 falls in rolling contact with the inclined rail 5 while its circumferential surface C' contacts the rail 5 and its face C" contacts the base plate 3. In the base and cover plates 3 and 4, a transmission coil 6 is provided in a round hole 3*a* formed at a position slightly away from the rail 5 in the upward direction, such that it covers the top part of an authentic coin having a smallest diameter and it will not be fully covered by an authentic coin having a largest diameter.

The transmission coil 6 generates an alternating magnetic field. When a coin is not present, the output voltage from the transmission coil 6 is maximum. When the coin C dropping from the coin slot is in rolling contact with the rail 5 and passes the coil 6, the magnetic field is changed by the coin C and the output voltage from the transmission coil 6 is decreased. As shown in FIG. 11, the larger the diameter of the coin, the larger the area of the transmission coil 6 covered by the coin, and the output voltage from the transmission coil 6 is decreased by a change in inductance. In this manner, the diameter of the coin is detected based on the change amount in output voltage level of the transmission coil 6 when the coin passes.

In the conventional coin diameter detecting apparatus having the above arrangement, however, since the change in output voltage level of the transmission coil depends not only on the diameter of the passing coin but also on the material and thickness of the coin, the output voltage level is also changed by the material or thickness. Hence, the diameter detecting precision is limited, and a coin is often erroneously discriminated.

SUMMARY OF THE INVENTION

It is an object of the present invention to provide a coin discriminating apparatus in which the problems as described above are solved and the material and thickness of a coil can be separately detected only by a pair of transmission and reception coils, thereby performing high-precision discrimination.

It is another object of the present invention to provide a coin selecting apparatus capable of separately detecting the material and thickness of a coin while driving a single transmission coil with a single frequency.

It is still another object of the present invention to provide a coin diameter discriminating apparatus which is little interfered with by the conductivity or thickness of a coin and which covers a wide detection range of diameter small number of reception coils.

It is still another object of the present invention to provide a coin diameter detecting apparatus capable of high-precision detection.

It is still another object of the present invention to provide a coin discriminating apparatus capable of performing high-precision discrimination by detecting the thickness, material, and diameter of a coin.

According to the first aspect of the present invention, there is provided a coin discriminating apparatus comprising:

AC signal generating means for generating an AC signal having a predetermined frequency;

transmission coil means for receiving the AC signal generated by the AC signal generating means and applying an alternating magnetic field to a coin to be discriminated;

reception coil means for detecting an electromotive force induced by an interaction of the alternating magnetic field applied by the transmission coil means and the coin to be discriminated;

detection signal generating means for generating a detection signal having a predetermined phase with respect to the AC signal generated by the AC signal generating means;

phase detecting means for phase-detecting the electromotive force detected by the reception coil means, in accordance with the detection signal generated by the detection signal generating means; and discriminating means for discriminating at least one of the thickness, the material, and the diameter of the coin to be discriminated on the basis of a signal output from the phase detecting means.

In order to achieve the above objects, according to the second aspect of the present invention, there is provided a coin discriminating apparatus characterized by comprising:

a transmission coil, arranged near a coin track, for applying an alternating magnetic field to a coin moving along the coin track;

a reception coil, arranged near the coin track, for detecting a magnetic field generated by an eddy current within the coin to which the magnetic field from the transmission coil is applied, and the change in said magnetic field during the movement of the coin;

peak value detecting means for detecting a value of a peak voltage detected by the reception coil;

bottom value detecting means for detecting a value of the bottom between adjacent peaks of the voltage; and discriminating means for discriminating the material of the coin using the bottom value and the thickness of the coin using the adjacent peak values and the bottom value.

In this above apparatus according to the second aspect, an eddy current is induced in the coin moving along the track by the alternating magnetic field applied by the transmission coil when the coin passes near the reception coil, by the magnetic field generated by the eddy current changes the voltage in the reception coil. Because the eddy current is relatively limited to periphery of the coin, the output voltage from the reception coil has a double-peak waveform which has two adjacent peaks corresponding to the front and rear periphery of the passing coin and a valley between the peaks. If the coin is made of a specific material, the voltage of this valley (bottom voltage value) of the output waveform from the reception coil does not depend on the thickness but depends on the material of the coin, as will be described later. Hence, the material of the coin can be determined from the bottom voltage value. The peak voltage value of the output waveform from the reception coil depends on both the material and thickness of the coin. Hence, the thickness of the coin can be determined from both the peak voltage value and the material of the coin determined from the bottom voltage value. In this manner, the authenticity and denomination of the coin are discriminated by separately determining the thickness and material of the coin.

In order to achieve the above objects, according to the third aspect of the present invention, there is provided a coin selecting apparatus comprising:

a transmission coil, arranged near a coin track, for applying an alternating magnetic field having a predetermined frequency to a coin moving along the coin track;

a reception coil, arranged near the coin track and having a smaller diameter than that of the coin, for detecting a magnetic field generated by an eddy current within the coin to which the magnetic field from the transmission coil is applied and the change in said magnetic field during the movement of the coil;

peak value detecting means for detecting a peak value $V_p$ of a double-peak signal representing a change in magnetic field detected by the reception coil;

bottom value detecting means for detecting a bottom value $V_b$ between adjacent peak values of the double-peak signal;

calculating means for calculating a conductivity $\sigma$ and a thickness $\delta$ of the coin on the basis of two functions $$\sigma=Fs(V_p, V_b)$$

$$\delta=Fd(V_p, V_b)$$

representing a relationship among the conductivity $\sigma$ and the peak and bottom values $V_p$ and $V_b$ and a relationship among the thickness $\delta$ and the peak and bottom values $V_p$ and $V_b$, respectively; and discriminating means for discriminating the coin on the basis of the calculated conductivity $\sigma$ and thickness $\delta$.

With this arrangement, in the coin selecting apparatus according to the third aspect of the present invention, an eddy current is induced in the coin by an alternating magnetic field applied by the transmission coil with a predetermined frequency. The magnetic field from the periphery of the coin changes more largely than that from the center of the coin. This change in magnetic field is detected by the reception coil. The change in magnetic field detected by the reception coil smaller than the coin in diameter exhibits a double-peak waveform as the coin moves. The peak and bottom values $V_p$ and $V_b$ of this double-peak signal are detected. The conductivity $\sigma$ and thickness $\delta$ of the coin are independently separately calculated on the basis of the two equations described above, thereby discriminating the coin.

In order to achieve the above objects, according to the fourth aspect of the present invention, there is provided a coin diameter discriminating apparatus comprising:

a transmission coil, arranged near a coin track, for applying an alternating magnetic field to a coin moving along the coin track;

a plurality of reception coils, arranged near the coin track, for detecting, as a change in induced signal, a magnetic field generated by an eddy current within the coin to which the magnetic field from the transmission coil is applied and the change in said magnetic field during the movement of the coin;

bottom detecting means for detecting, a bottom value of a waveform representing a change in the induced signal during the coin movement from each of the reception coils;

selecting means for selecting a reception coil, a bottom value of which is detected during the coin movement and falls within a predetermined range; and calculating means for calculating a diameter $\phi$ of the moving coin, in accordance with a following function of diameter $$\phi=Fph(V_b)$$

on the basis of the bottom value $V_b$ of the reception coil selected by the selecting means.

With this arrangement, in the coin diameter discriminating apparatus according to the fourth aspect of the present invention, an eddy current is induce in a coin applied with an alternating magnetic field from the transmission coil with a predetermined frequency, and changes the magnetic field. The change in magnetic field is detected by the plurality of reception coils provided at the different heights. The bottom values of the detected waveforms are detected in each of reception coils. A reception coil, the detected bottom value of which falls within a predetermined range, is selected. $\phi=Fph(V_b)$ is calculated on the basis of this bottom value $V_b$, thereby obtaining the diameter of the coin.

In order to achieve the above objects, in a coin diameter detecting apparatus according to the fifth aspect of the present invention, an eddy current is induced in a coin by an alternating magnetic field applied by a transmission coil. As the coin moves or the reception coil moves, two peaks are formed in the output of the reception coil which detects a magnetic field generated by the eddy current. The diameter of the coin is detected from the time between these two peaks.

In the apparatus of the fifth aspect having the above arrangement, as the coin passes or the reception coil moves, the reception coil output has two peaks which detects a magnetic field generated by an eddy current induced in the periphery of the coin by an alternating magnetic field. Since the two peaks correspond to the front and the rear peripheries of the coin, the diameter of the coin is detected from a time between the two peaks. The material and thickness of the coin interfere only with the output voltage level from the transmission coil and does not interfere of the time between the two peaks. Therefore, in diameter detection, accurate outer diameter can be detected without an interference of the material and thickness of the coin.

DETAILED DESCRIPTION OF THE PREFERRED EMBODIMENTS

The basic principle of coin discrimination performed by a coin discriminating apparatus according to the present invention will be described.

Figure 1:
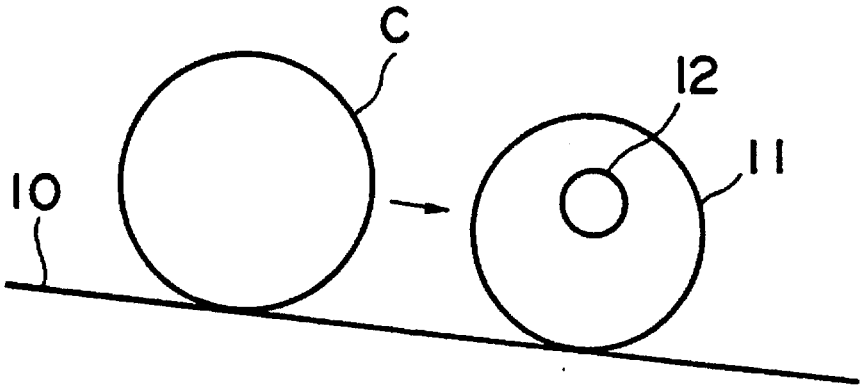
FIG. 1 is a view showing the relationship among a coin and transmission/reception coils in order to explain the principle of the present invention.
Figure 2:
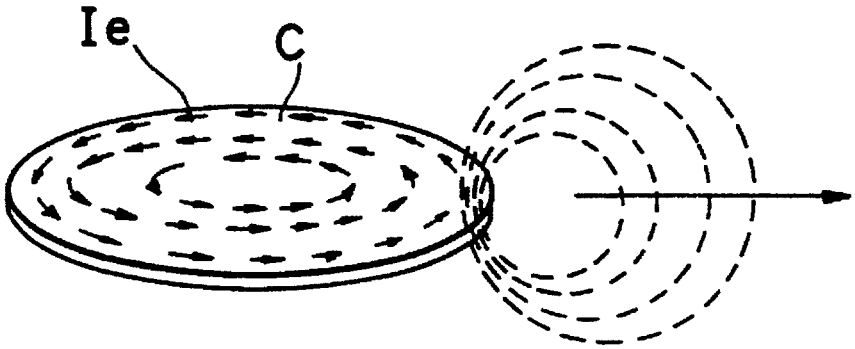
FIG. 2 is a view showing an eddy current induced in a coin and a magnetic field generated by the eddy current.

As shown in FIG. 1, a coin C moves along a coin track 10 while falling in rolling contact with it due to its own weight. Transmission and reception coils 11 and 12 are provided in the vicinity of the coin track 10 at, e.g., positions as shown in FIG. 1. When an AC signal is applied to the transmission coil 11, an alternating magnetic field is generated by the transmission coil 11. When the coin C passes in this alternating magnetic field, an eddy current Ie flows in the coin C in the circumferential direction as indicated by arrows in FIG. 2, and an alternating magnetic field He is generated by this eddy current.

The alternating magnetic field generated by the transmission coil 11 and the alternating magnetic field caused by the eddy current link in the reception coil 12 arranged near the transmission coil 11, and an electromotive force is generated by these two alternating magnetic fields. When the electromotive force, of the electromotive forces induced in the reception coil 12, which is generated by the eddy current is selectively derived, since the electromotive force generated by the eddy current is changed by the movement of the coin C, a voltage waveform (to be sometimes referred to as a double-peak waveform hereinafter) having two peaks is detected, as will be described later. The present inventors quantitatively obtained this voltage waveform by numerical calculation using the finite element method.

Figure 3A:
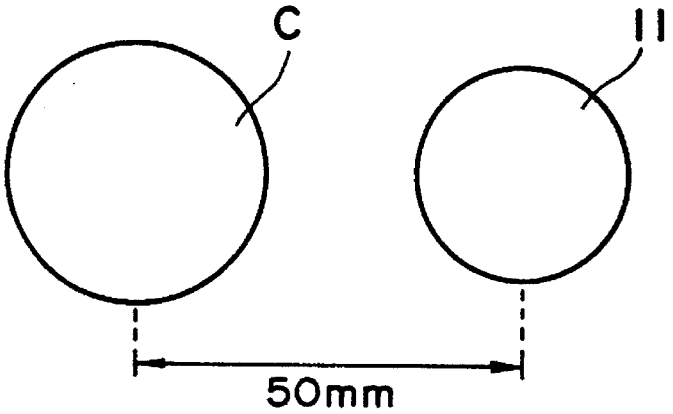
FIGS. 3A and 3B includes views respectively showing the positional relationship between the coin and the transmission/reception coils, and an eddy current generated in a coin analyzed using the finite element method.
Figure 3B:
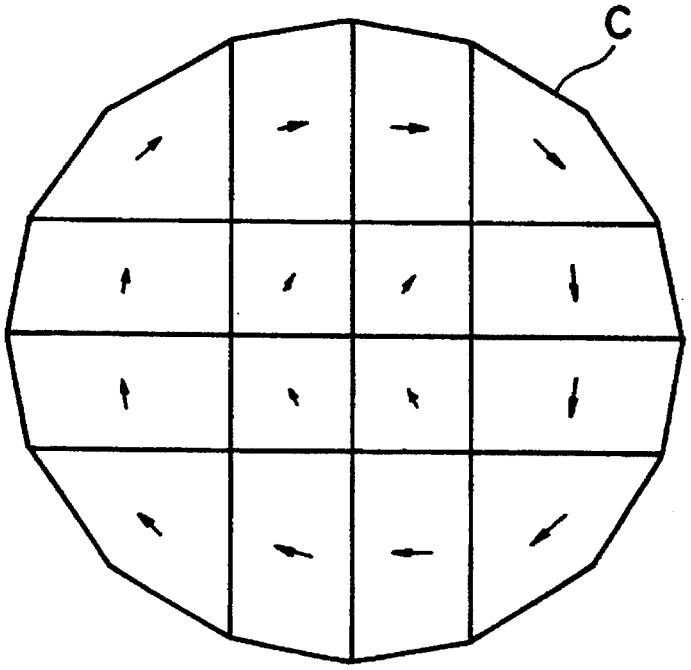
Figure 4A:
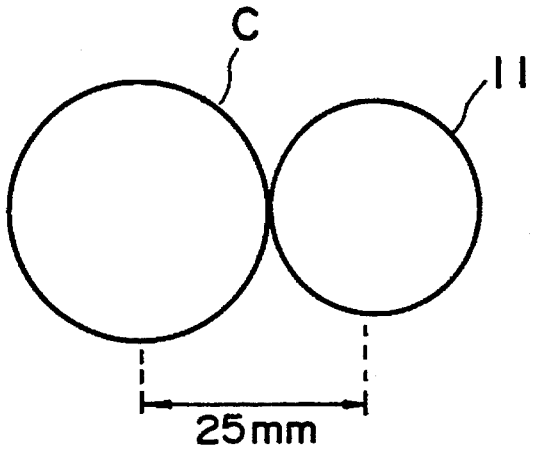
FIGS. 4A and 4B includes views respectively showing the positional relationship between the coin and the transmission/reception coils, and an eddy current generated in a coin analyzed using the finite element method.
Figure 4B:
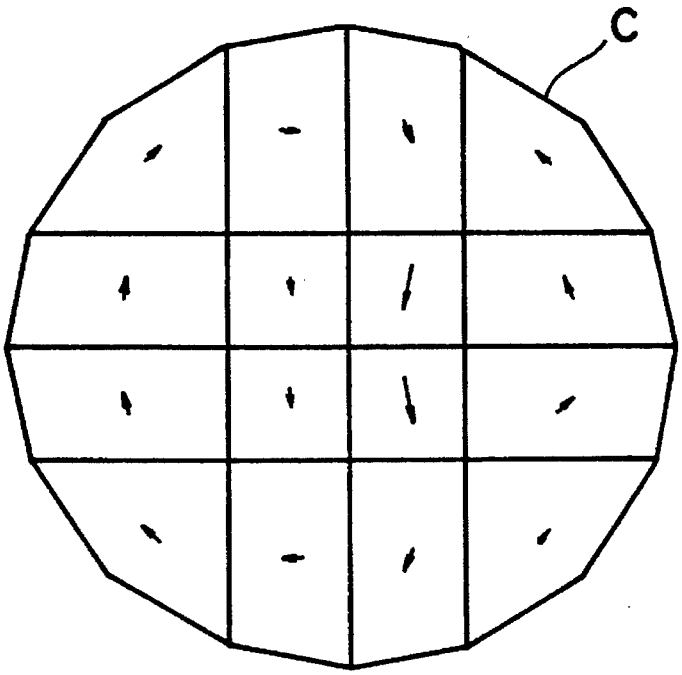
Figure 5A:
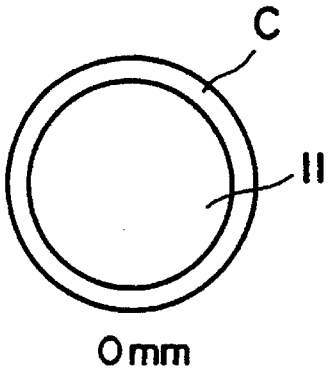
FIGS. 5A and 5B includes views respectively showing the positional relationship between the coin and the transmission/reception coils, and an eddy current generated in a coin analyzed using the finite element method.
Figure 5B:
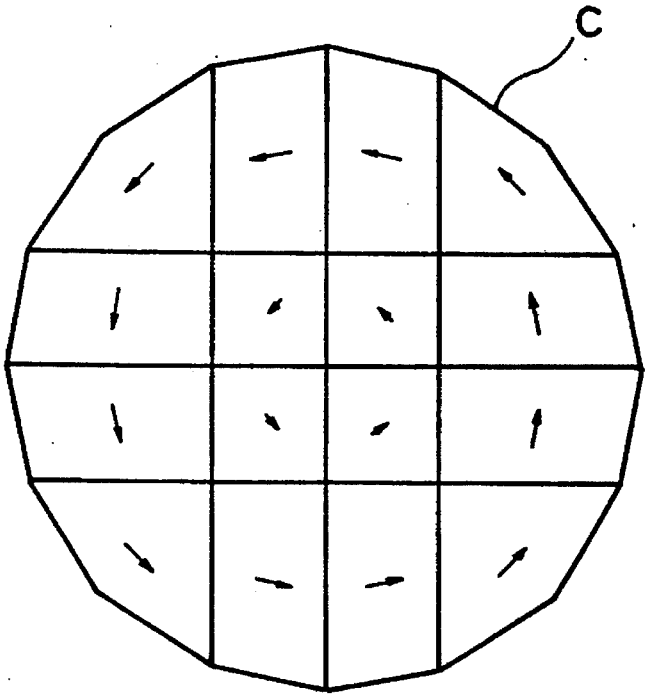

FIGS. 3A and 3B to FIGS. 5A and 5B are views showing examples of numerical calculation using the finite element method. In FIGS. 3A and 3B to FIGS. 5A and 5B, FIGS. 3A, 4A, and 5A show the positional relationship between the transmission coil 11 and the coin C, and FIGS. 3B, 4B, and 5B show the distribution of the eddy current flowing in the coin C under the corresponding positional relationship.

FIG. 3B shows an eddy current flowing in the coin C when the center-to-center distance between the transmission coil 11 and the to-be-detected coin C is 50 mm, as shown in FIG. 3A. The eddy current rotates clockwise, and apparently flows strongly near the transmission coil. FIG. 4B shows the flow of an eddy current obtained when the center-to-center distance between the transmission coil 11 and the to-be-detected coin C is 25 mm, as shown in FIG. 4A. It is seen from FIG. 4B that two eddy currents flow in the coin C. FIG. 5B shows the flow of an eddy current obtained when the center of the transmission coil 11 coincides with the center of the to-be-detected coin C, as shown in FIG. 5A. The flow of the eddy current rotates counterclockwise, which is contrary to the case of FIG. 3B. The distribution of the eddy current, the distribution of the magnetic field caused by the eddy current, and the waveform of the electromotive force induced by the magnetic field are systematically obtained by performing this numerical calculation while finely changing the center-to-center distance. Hence, this numerical calculation method is performed while changing the thickness, thereby quantitatively clarifying by numerical calculation that (a) when the conductivity or thickness of the coin is small, the eddy current caused by the alternating magnetic field flows near the center of the coin, and (b) when the conductivity or thickness of the coin is large, the eddy current caused by the alternating magnetic field flows near the periphery of the coin.

Analytical results obtained by this numerical calculation will be described.

Figure 6:
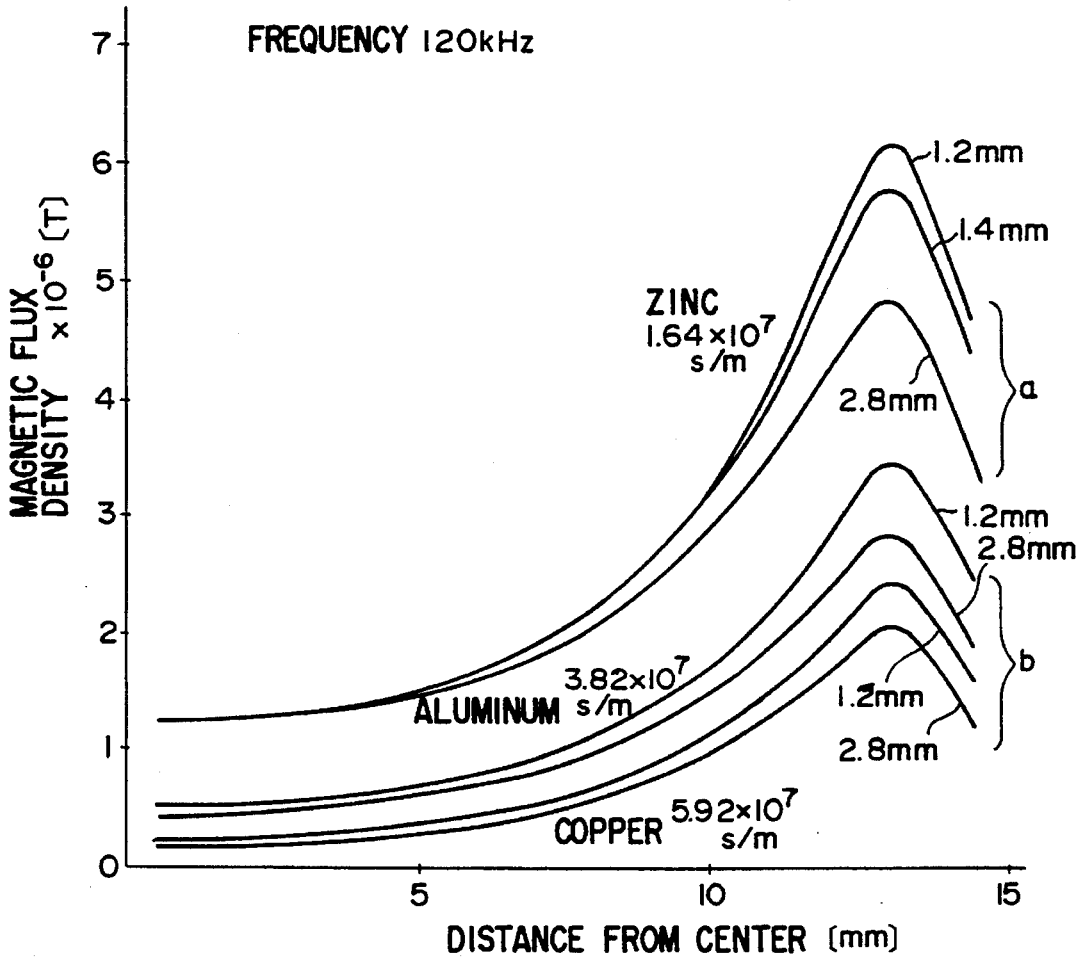
FIG. 6 is a graph showing output waveforms from a reception coil with various the thicknesses and conductivities of coins when a reception coil is fixed at 5.0 mm from a coin track and the coin diameters are 30 mm.
Figure 7:
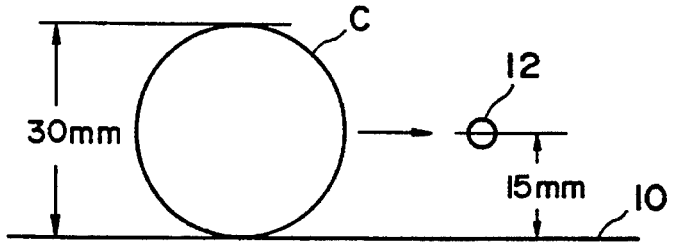
FIG. 7 is a view showing the positional relationship between a coin and the reception coil.

FIG. 6 shows magnetic flux density distributions obtained when an AC signal having a relatively high frequency (120 kHz) is applied to the transmission coil 11, the center of the reception coil 12 located 15.0 mm from the coin track 10, as shown in FIG. 7, and a coin C having a diameter of 30.0 mm moves on the coin track 10. (Although the frequency of the AC signal to be applied can be 40 to 50 kHz, if an AC signal having a high frequency (e.g., 120 kHz) is applied, the eddy current is centralized on the periphery of the coin, and a double-peak output clearly showing the peak and bottom can be easily obtained, as will be described later.)

Referring to FIG. 6, the abscissa axis represents the center-to-center distance between the coin C and the reception coil 12, and the ordinate axis represents the magnetic flux density (proportional to the electromotive force of the reception coil) received by the reception coil 12. Since the center of the reception coil 12 is defined as 0, the abscissa axis represents the characteristics obtained when the center of the coin C moves to the right by passing through the center of the reception coil 12, i.e., the characteristics of the right half of the coin C.

Symbol a of FIG. 6 indicates changes in magnetic flux density obtained when the thickness of a zinc coin having a conductivity of $1.64\times10^7$ S/m is changed to 1.2, 1.4, and 2.8 mm. The two upper curves of curves indicated by reference symbol b indicate changes in magnetic flux density obtained when the thickness of an aluminum coin having a conductivity of $3.82\times10^7$ S/m is changed to 1.2 and 2.8 mm. The two lower curves of the curves indicated by reference symbol b indicate changes in magnetic flux density obtained when the thickness of a copper coin having a conductivity of $5.92\times10^7$ S/m is changed to 1.2 and 2.8 mm. It is apparent from FIG. 6 that where the distance from the center is small, the magnetic flux density depends on the material, and that as the distance from the center is increased, the magnetic flux density depends on the thickness. Because the characteristics (shown in FIG. 6) of the right half of the coin and the characteristics (not shown) of the left half of the coin are symmetrical, the detection waveform detected by the reception coil 12 arranged along the coin track 10 is a double-peak waveform having two peaks and one bottom.

Referring to FIG. 6, regarding the zinc coin, the bottom value voltage is independent on the thickness of the coin and determined by the material of the coin, and regarding the aluminum or copper coin, the bottom voltage value changes to weakly depend on the thickness of the coin and strongly depend on the conductivity of the coin. Accordingly, since the bottom voltage value, of the double-peak waveform, strongly depends on the conductivity, i.e., the material of the coin, the conductivity, i.e, the material of the coin can be known by detecting the bottom voltage value.

The peak voltage value, of the double-peak waveform, depends on the thickness and conductivity of the coin. If the conductivity of the coin in question is obtained in advance from the bottom voltage value in accordance with the method described above, the thickness of the coin can be obtained from the peak voltage value.

A case wherein the frequency of the AC signal to be applied to the transmission coil is further increased (160 kHz) will be described.

Figure 8:
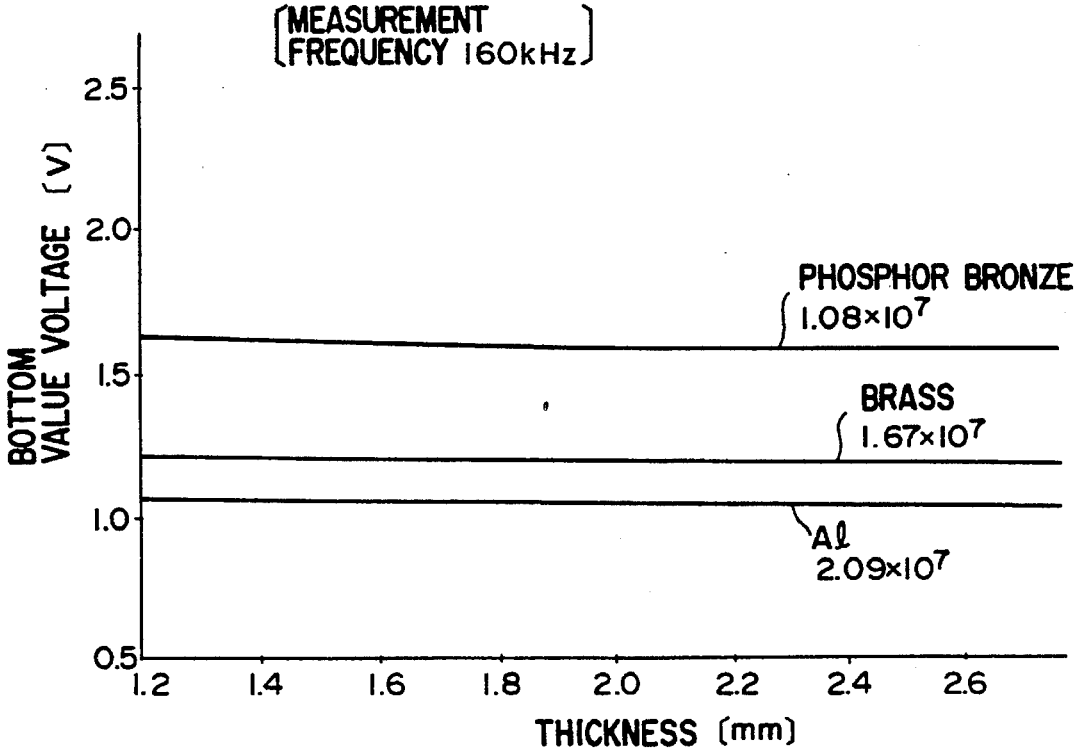
FIG. 8 is a graph showing the relationship between the coin thickness and the bottom voltage value.
Figure 9:
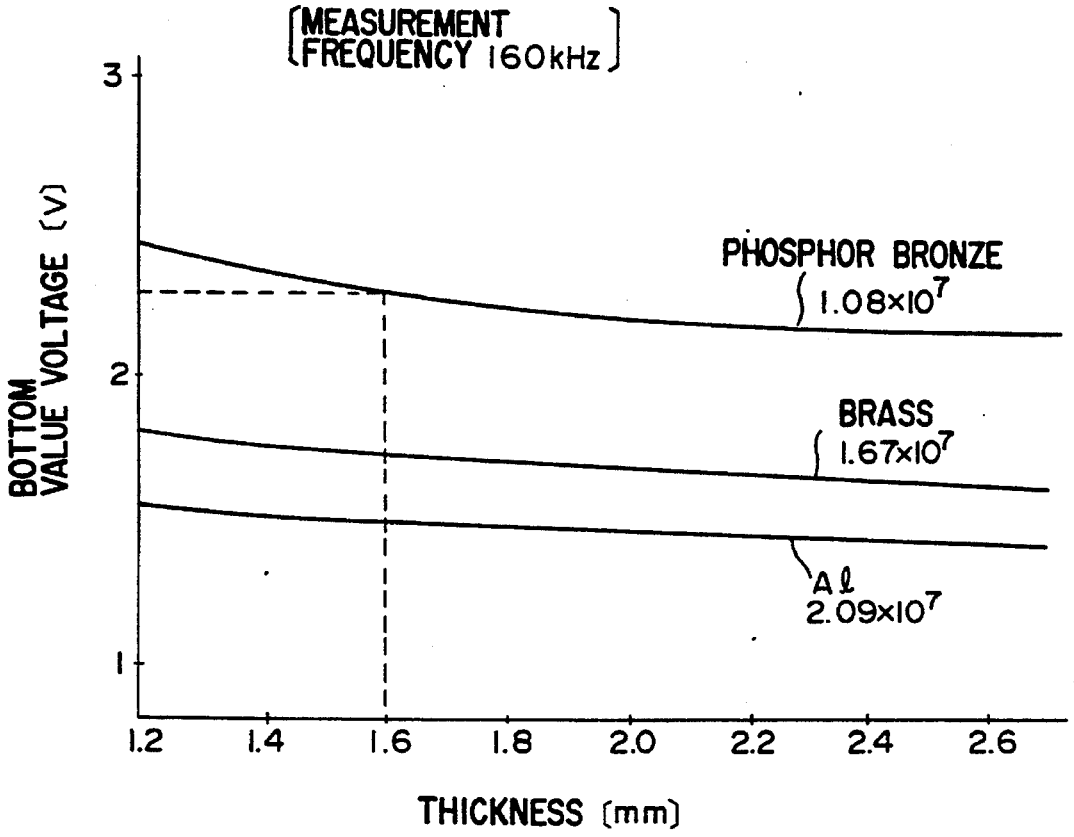
FIG. 9 is a graph showing the relationship between the coin thickness and the peak voltage value.

FIG. 8 shows experimental results of a case wherein the center of the reception coil 12 is at 16.5 mm from the coin track 10, and obtained by measuring the bottom voltage values of the double-peak waveforms while changing only the thickness of three denominations of coins having known conductivities. In FIG. 8, the abscissa axis represents the thickness of the coin, and the ordinate axis represents the bottom voltage value. FIG. 9 shows experimental results obtained under the same conditions but by measuring the peak voltage values of the double-peak waveforms while changing only the thicknesses of the coins. The ordinate axis represents the peak voltage value.

It is apparent from FIG. 8 that when a coin made of a specific material is considered, the bottom voltage value of the double-peak waveform depends not on the thickness of the coin but only on the conductivity of the coin. An aluminum coin having a conductivity of $2.09\times10^7$ [S/m] has a bottom voltage value of about 1.06 V. A brass coin having a conductivity of $1.67\times10^7$ [S/m] has a bottom voltage value of about 1.20 V. A phosphor bronze coin having a conductivity of $1.08\times10^7$ [S/m] has a bottom voltage value of about 1.60 V.

It is apparent from FIG. 9 that the peak voltage value of a double-peak waveform depends both on the thickness and conductivity of the coin. However, from the results of FIG. 8, since the conductivity is known from the bottom voltage value of the double-peak waveform, the thickness of a coin in question can be discriminated by detecting the peak voltage value of the double-peak waveform. For example, when a coin has a bottom voltage value of 1.6 V and a peak voltage value of 2.28 V, its conductivity of $1.08\times10^7$ [S/m] is obtained from FIG. 8, and then its thickness of 1.6 mm is obtained from FIG. 9.

In this manner, the conductivity and thickness of a coin can be quantitatively discriminated from the bottom and peak voltage values, respectively, of a double-peak waveform detected by one reception coil.

A coin discriminating apparatus according to the first embodiment of the present invention based on the principle of coin discrimination described above will be described.

Figure 10:
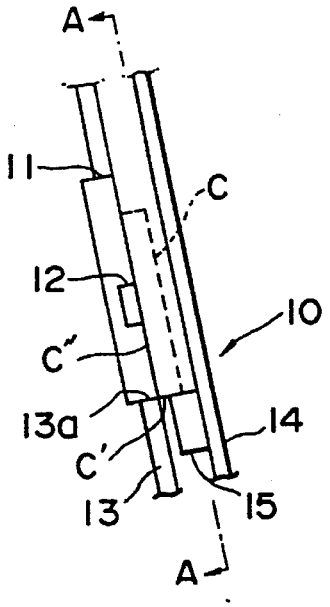
FIG. 10 is a sectional view of the coin track according to the first embodiment of the present invention.
Figure 11:
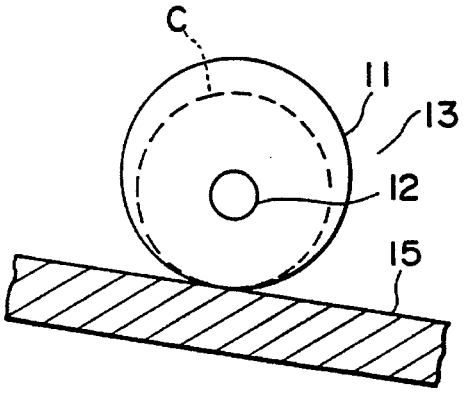
FIG. 11 is a view taken along the line A—A in FIG. 10.
Figure 12:
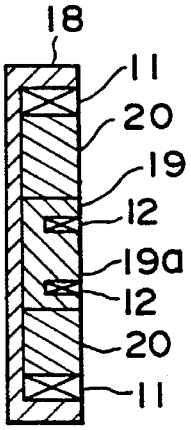
FIG. 12 is a sectional view of transmission/reception coils.

As shown in FIGS. 10 to 12, a coin track 10 is constituted by a base plate 13 inclined with respect to the vertical plane, a cover plate 14 at a predetermined gap from and parallel to the base plate 13, and a rail 15 mounted on the cover plate 14 to be inclined with respect to the horizontal line. When a coin C drops onto the coin track 10, it falls in rolling contact with the inclined rail 15 while its circumferential surface C' contacts the rail 15 and its face C" contacts the base plate 13.

A transmission coil 11 is provided within a plane in the base plate 13, which is substantially parallel to the base plate 13, and a reception coil 12 smaller than the transmission coil 11 is provided in the transmission coil 11.

As shown in FIG. 12, the transmission coil 11 is wound on a bobbin, and this bobbin is fitted in a large cylindrical bottomed core 18. The reception coil 12 is wound on a bobbin, and this bobbin is fitted in an annular groove 19*a* of a small-diameter core 19. The large-diameter core 18 is fitted in a round hole 13*a* of the base plate 13 and fixed to be the same level as that of the surface of the base plate 13. Reference numeral 20 denotes an annular spacer or part of the large-diameter core 18.

As shown in FIG. 11, the size (inner diameter) of the reception coil 12 must be much smaller than the diameter of the coin C and is preferably 0.25 times or less the diameter of the coin.

The transmission coil 11 must be much larger than the reception coil 12, and its size (inner diameter) is preferably 0.5 times or more the diameter of the coin C.

Figure 13A:
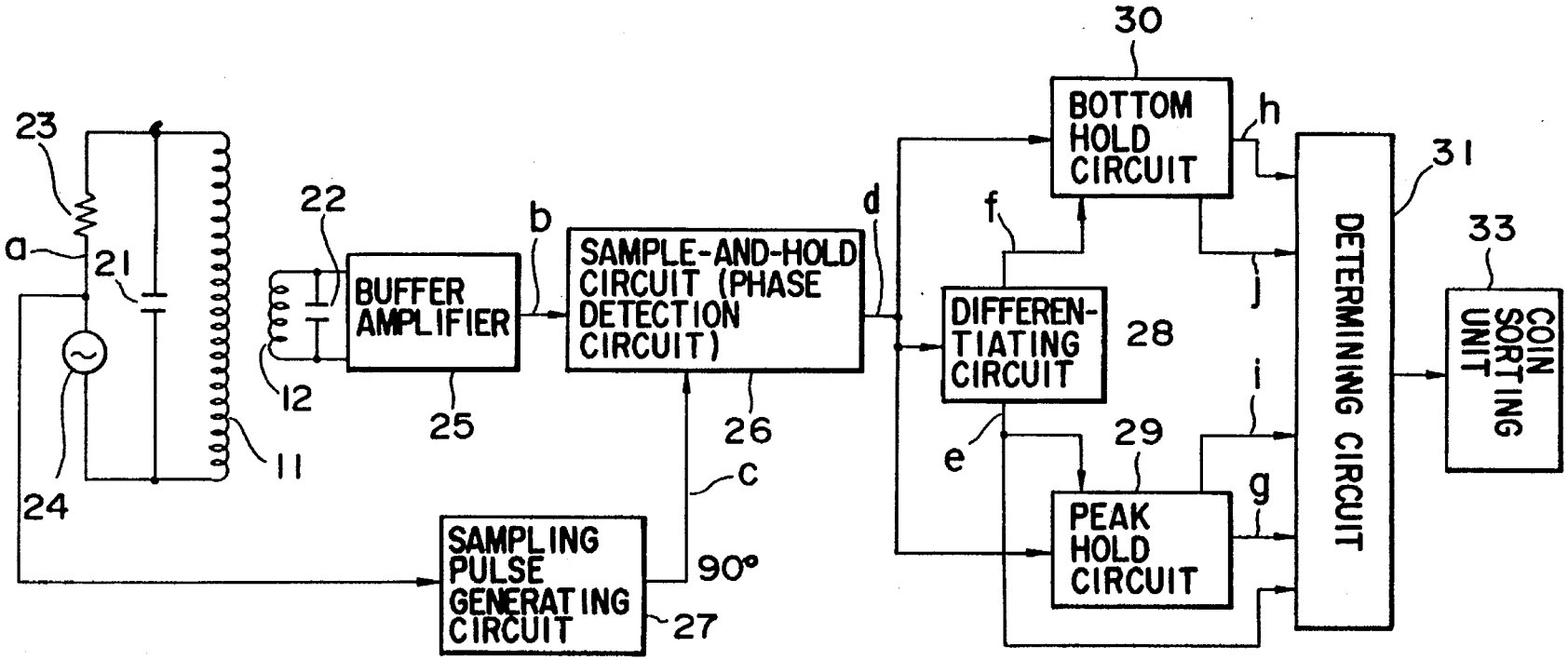
FIG. 13A is a block diagram showing the electric circuit used in the first embodiment of the present invention.

FIG. 13A shows a block diagram of the electrical circuit used in the coin discriminating apparatus according to the first embodiment of the present invention.

Referring to FIG. 13A, a capacitor 21 is connected to the transmission coil 11 to constitute a resonance circuit, and a capacitor 22 is connected to the reception coil 12 to constitute a resonance circuit. A relatively high frequency output (FIG. 14A) from an oscillator 24 connected in series with a resistor 23 is applied to the transmission coil 11 to generate an alternating magnetic field. An electromotive force is generated in the reception coil 12 by this alternating magnetic field. When the coin C passes the reception coil 12, an eddy current is generated in the coin C by the alternating magnetic field, and an electromotive force is generated in the reception coil 12 also by a magnetic field generated by this eddy current. Hence, an electric signal is generated in the reception coil 12. A signal (FIG. 14B) amplified by a buffer amplifier 25 is supplied to a sample-and-hold circuit (phase detection circuit) 26.

Figures 14A, 14B, 14C, 14D:
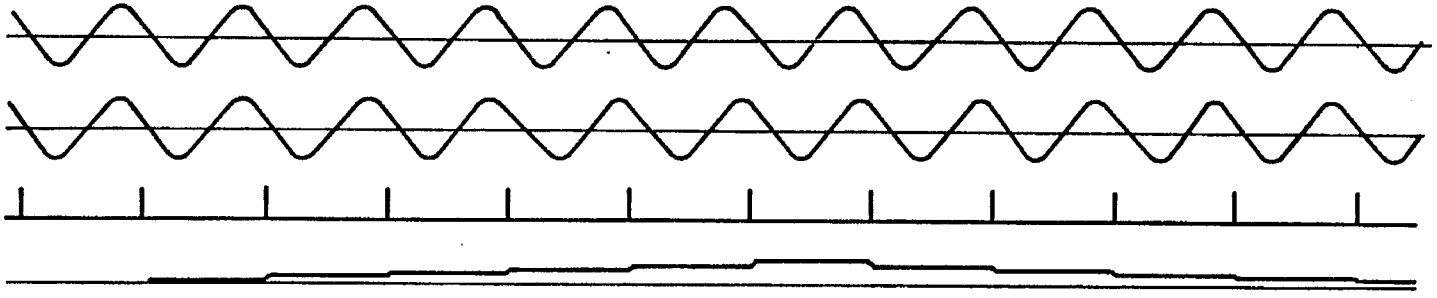
FIGS 14A to 14D are charts showing the output waveforms of the respective portions of the block diagram of FIG. 13A.

The sample-and-hold circuit 26 is driven by a sample pulse (FIG. 14C) generated by a sample pulse generating circuit 27 and having a phase delayed by only 90° from that of the drive signal of the transmission coil 11, samples the signal from the buffer amplifier 25 as indicated by FIG. 14D, and converts the signal into a voltage level, thereby converting it to a DC signal. That is, the sample-and-hold circuit 26 has a function equivalent to that of a so-called phase detection circuit.

A phase difference of 90° exists between an electromotive force generated in the reception coil 12 in the absence of a coin and an electromotive force generated in the reception coil 12 by the magnetic field of the eddy current in the coin. Hence, in this manner, when sampling (phase detection) is performed by a sampling pulse having a phase difference of 90° from the drive signal of the transmission coil 11, the electromotive force of the reception coil 12 generated by the magnetic field of the eddy current in the coin is optimally extracted.

As described above, when the coin inserted from the coin slot passes between the transmission and reception coils 11 and 12, the eddy current is generated by the alternating magnetic field generated by the transmission coil 11 to flow in the coin, and a new magnetic field is generated by this eddy current. When the frequency is relatively high, the position on the coin where the eddy current flows does not depend on the conductivity or thickness but is substantially constant on the peripheral portion of the coin. The output from the reception coil 12 caused by the magnetic field of this eddy current becomes maximum when the front periphery of the coin passes the center of the reception coil 12 and when the rear periphery of the coin passes the center of the reception coil 12. Hence, the output waveform of the sample-and-hold circuit 26 becomes a double-peak waveform having two peaks, as indicated by reference symbol (d) of FIG. 15.

Figure 15:
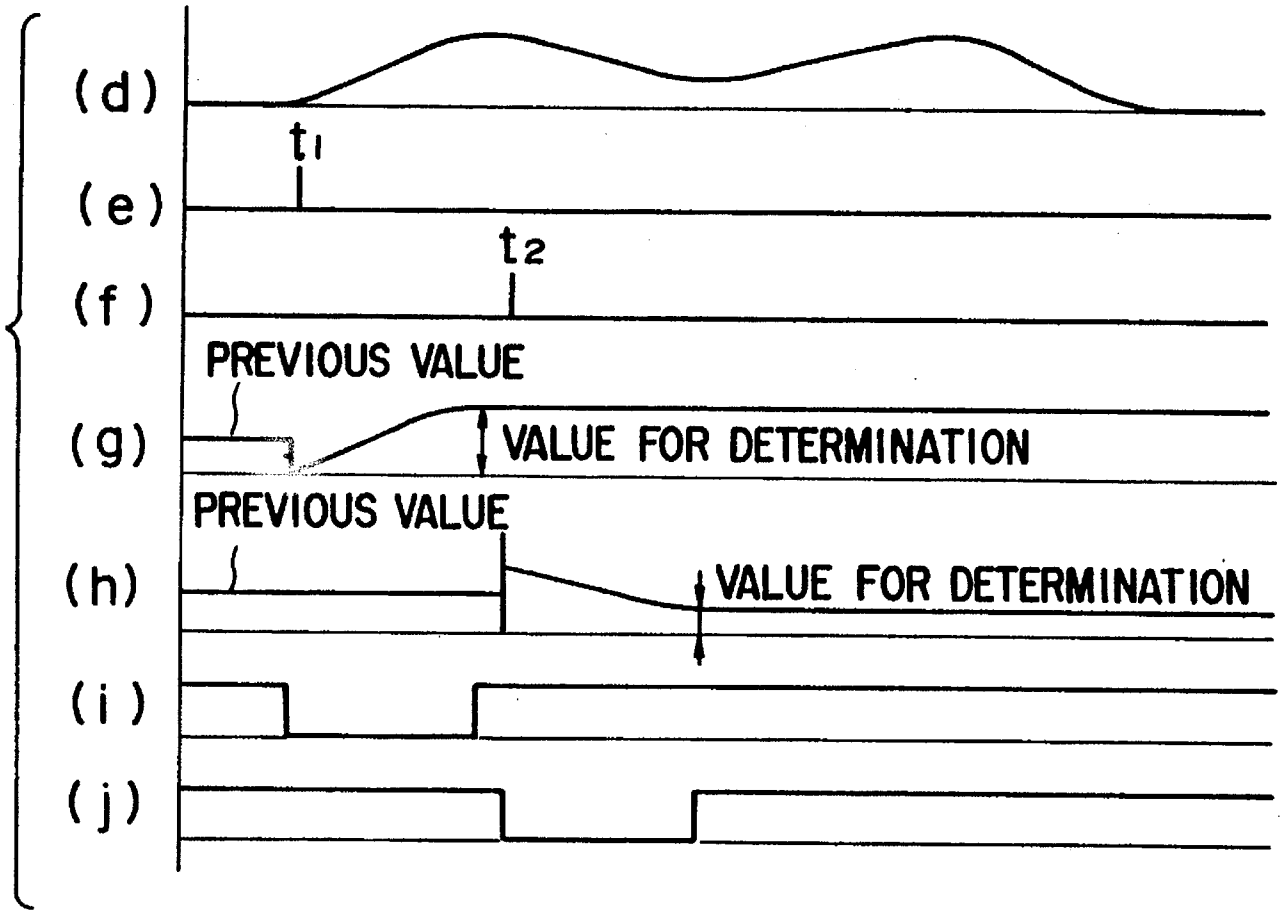
FIG. 15 shows the output waveforms of the respective portions of the block diagram of FIG. 13A.

The output signal having this double-peak waveform is input to a differentiating circuit 28, and outputs (indicated by reference symbols (e) and (f) of FIG. 15) are extracted at a timing t1 when the gradient of this signal appears and at a timing t2 when the gradient of the signal changes from positive to negative for the first time.

A peak hold circuit 29 is reset when the rise time t1 of the signal (d) is detected, as indicated by reference symbol (g) of FIG. 15, to delete its previously held value, and holds the peak value of the signal from t1. When the output signal reaches the peak value voltage, the peak hold circuit 29 is latched at (t2) (indicated by reference symbol (i) of FIG. 15), and this value is sent to a determining circuit 31 as a thickness determination signal.

A bottom hold circuit 30 is reset when the first peak time t2 of the output signal having the double-peak waveform described above is detected, as indicated by reference symbol (h) of FIG. 15, to delete its previously held value, and holds the bottom value of the signal from t2. When the output signal reaches the bottom value voltage, the bottom hold circuit 30 is latched (indicated by reference symbol (j) of FIG. 15), and this value is sent to the determining circuit 31 as a material determination signal.

The determining circuit 31 compares the two determination signals g and h with reference signals having specific numerical ranges corresponding to several denominations of coins. When the determination signals fall within the ranges of any one of the coins, the determining circuit 31 determines that the coin in question is identical to this specific coin. If the determination signals do not fall within the range of this coin, the determining circuit 31 determines that the coin in question is a counterfeit coin and outputs a determination signal. In this manner, the authenticity or denomination of the coin is determined, and the coin is directed in a storing or discharge direction or the like by a coin sorting unit 33 on the basis of the determination signal.

Figure 13B:
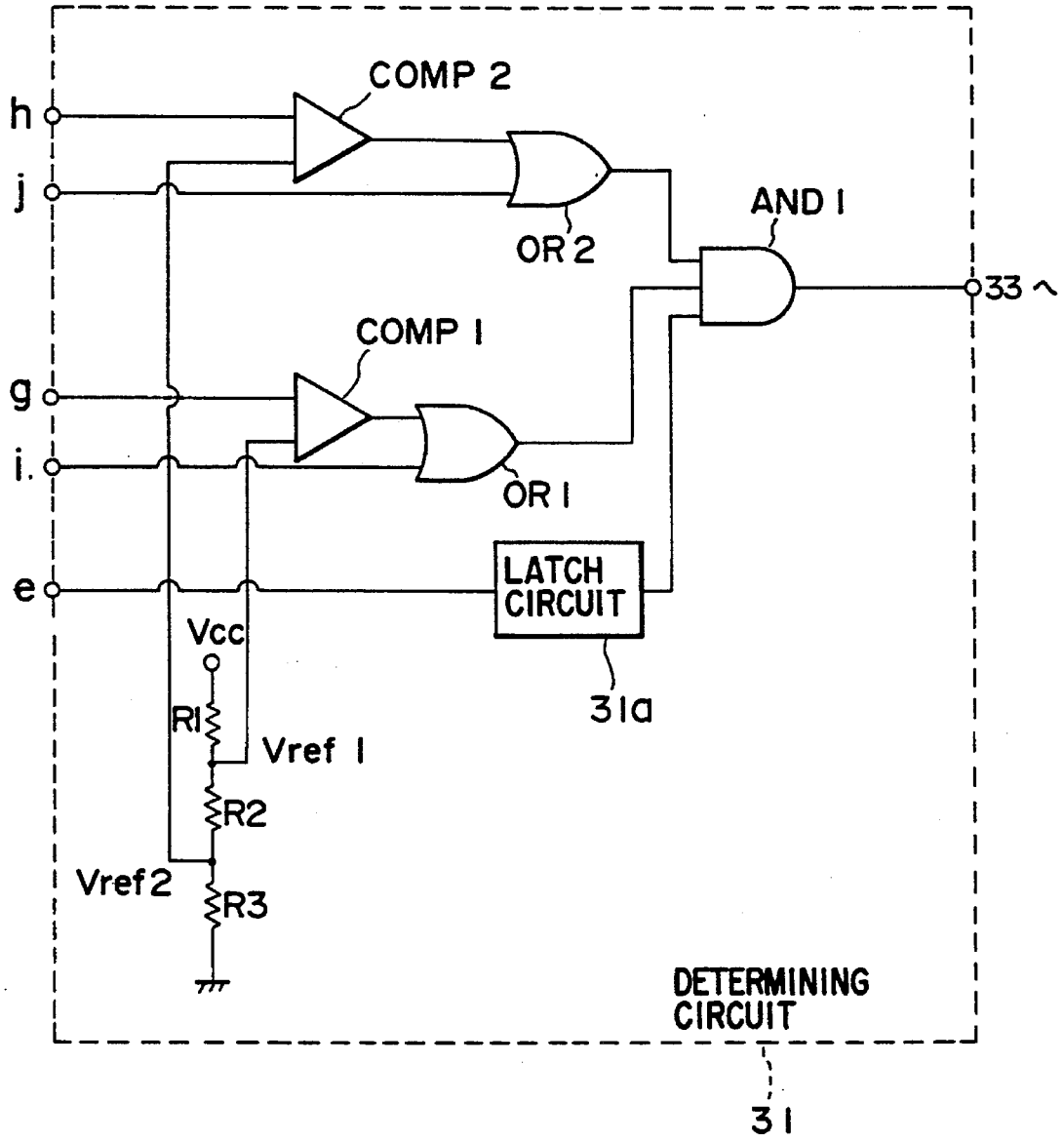
FIG. 13B is a view showing a practical arrangement of the discriminating circuit of FIG. 13A.

FIG. 13B shows a practical arrangement of the determining circuit 31 described above.

More specifically, the determining circuit 31 has comparators COMP1 and COMP2 for comparing the two determination signals g and h with corresponding reference voltages $V_{ref1}$ and $V_{ref2}$. The reference voltages $V_{ref1}$ and $V_{ref2}$ are applied from a voltage dividing circuit constituted by resistors R1, R2, and R3 connected in series between a power supply $V_{cc}$ and a ground terminal. The outputs from the comparators COMP1 and COMP2 described above are ORed with the latching voltages i and j by OR gates OR1 and OR2, respectively. Outputs from the OR gates OR1 and OR2 described above are ANDed, together with an output as a timing signal e at t1 supplied through a latch circuit 31*a*, by an AND gate AND1. In this manner, the determination signal concerning the authenticity of the coin is output.

In the determining circuit 31, the reference signals $V_{ref1}$ and $V_{ref2}$ are prepared for comparison with the two determination signals g and h, respectively. In a practical design, however, a plurality of reference voltages may be prepared for each determination signal and be compared with the corresponding signal.

Figure 16:
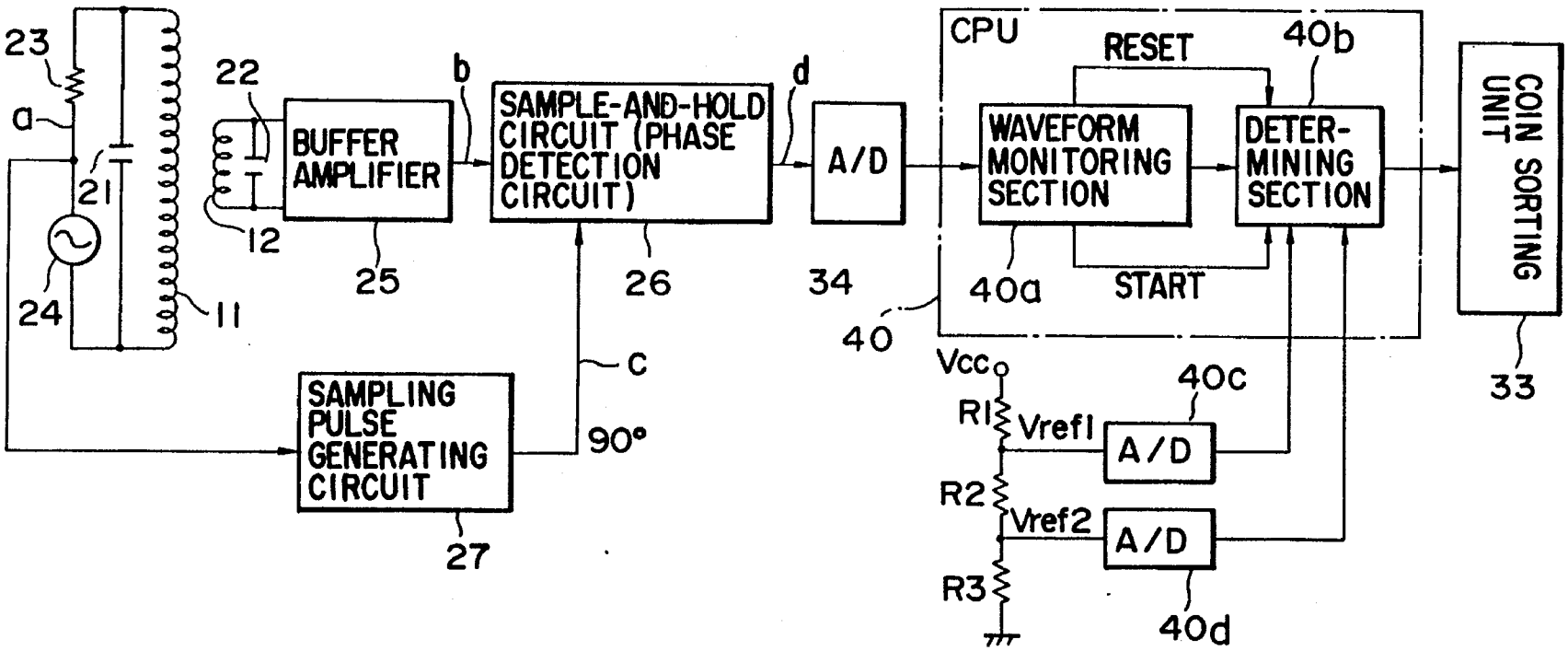
FIG. 16 is a block diagram showing the electric circuit of another arrangement of the first embodiment of the present invention.

FIG. 16 shows an arrangement in which a central processing unit (CPU) is used as the electric circuit.

Referring to FIG. 16, the circuit configuration is partly the same as that of the block diagram of FIG. 13A up to conversion of the AC signal output from a reception coil 12 into a DC signal by a sample-and-hold circuit (phase detection circuit) 26. In this arrangement, however, an analog signal from the sample-and-hold circuit 26 is digitized by an A/D converter 34 and input to a CPU 40.

Figure 17:
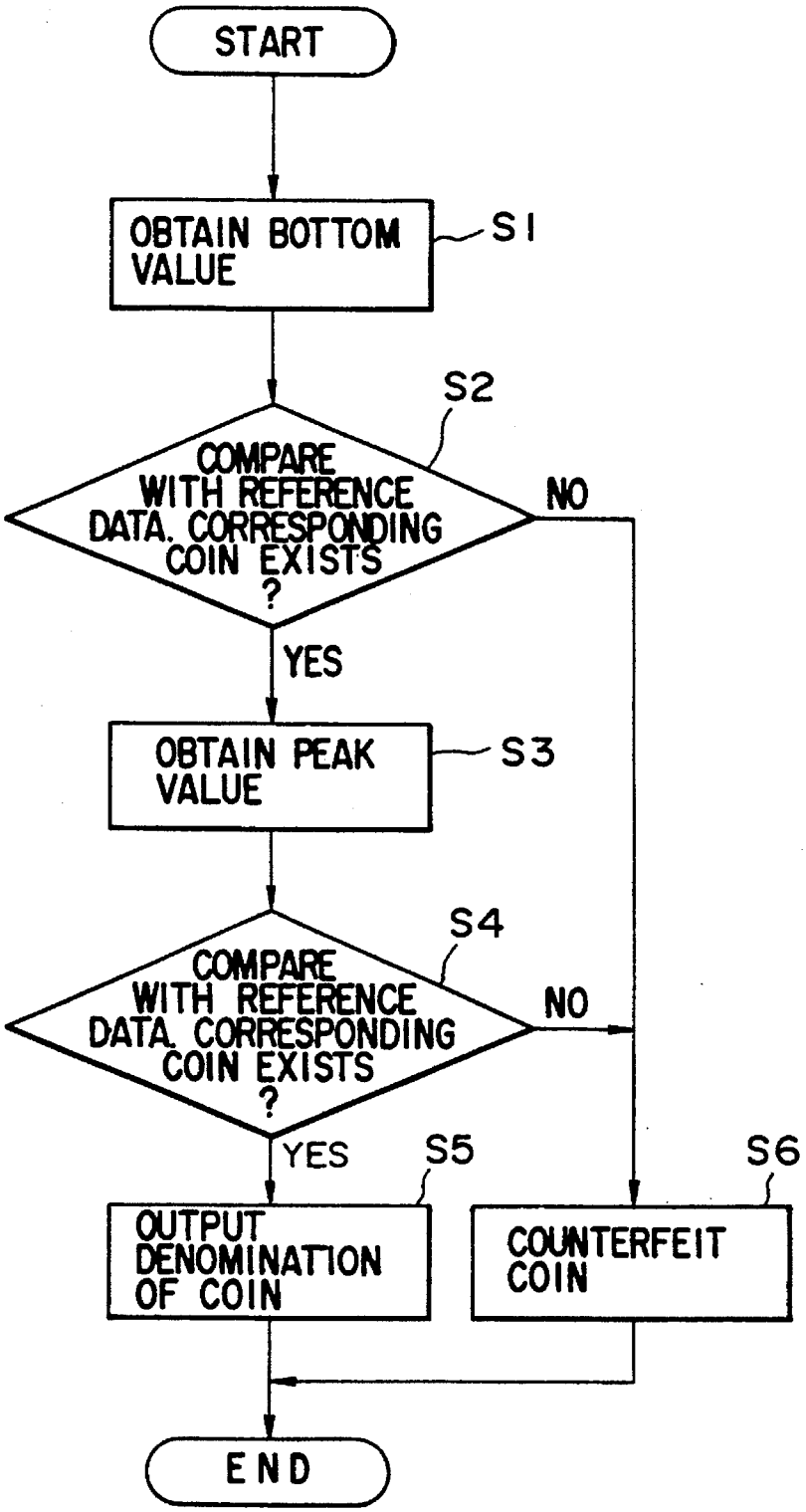
FIG. 17 is a flow chart of the operation of the CPU of the block diagram of FIG. 16.

The operation in the CPU 40 will be described hereinafter with reference to the flow chart of FIG. 17.

A waveform monitoring section 40*a* of the CPU 40 obtains the bottom value voltage of an input signal (step S1). A determining section 40*b* compares the bottom value voltage supplied from the A/D converter 40*c* with reference data $V_{ref2}$ having a specific numerical range corresponding to a plurality of denominations of coins (step S2). If the bottom value falls within a range of any one of the coins, the flow advances to next step S3; if the bottom value does not fall within a range of any one of the coins, it is determined that this coin is a counterfeit coin (step S6).

In step S3, the waveform monitoring section 40*a* obtains the peak value voltage of the input signal, and the determining section 40*b* compares this peak voltage value supplied from the A/D converter 40*d* with reference data $V_{ref1}$ having a specific numerical range corresponding to a plurality of denominations of coins. If the peak value falls within the range of any one of the coins, then it is determined that this coin is this specific coin, and denomination data of this coin is output (step S5); if the peak value does not fall within the range of any coin, it is determined that this coin is a counterfeit coin (step S6).

In this embodiment, the transmission and reception coils are of one side type. However, transmission and reception coils of a two-side type may be disposed on the two sides of a coin track 10 to oppose each other, or transmission and reception coils having different shapes may be disposed in different manner.

As described above, in the coin discriminating apparatus according to the first embodiment of the present invention, the magnetic field generated by an eddy current generated in a coin is detected by the reception coil. The bottom value of the double-peak waveform of the reception output depends only on the conductivity of the coin, and the peak value of the double-peak waveform of the reception output depends on both the conductivity and thickness of the coin. The conductivity of the coin is detected from the bottom value voltage by utilizing this fact, and the thickness of the coin is separately detected from the peak value and the detected conductivity, thereby discriminating the authenticity or denomination of the coin. Therefore, (a) since a plurality of pairs of transmission coils and detectors need not be separately provided for standard sample coins, unlike in the conventional apparatus shown in FIG. 18, the structure becomes simple; and (b) in the present invention, a pair of transmission and reception coils are used, and the material and thickness of a coin are separately detected based on the bottom and peak values of the reception output signal detected by the reception coil and having a double-peak waveform, thereby discriminating the coin. Even if a difference in thickness or conductivity between coins to be discriminated is very small, the bottom and peak values of the reception output waveforms are clearly changed. Consequently, a very small difference in thickness and conductivity between coins can be separately discriminated, so that very high-precision coin discrimination can be performed.

The second embodiment of the present invention will be described.

The basic principle of this embodiment will be described first. The premise of the second embodiment is the same as the detecting method of the double-peak waveform described in the first embodiment with reference to FIGS. 1 to 7.

The second embodiment is characterized in the signal processing method for the detected double-peak waveform. This point will be described.

Figure 18:
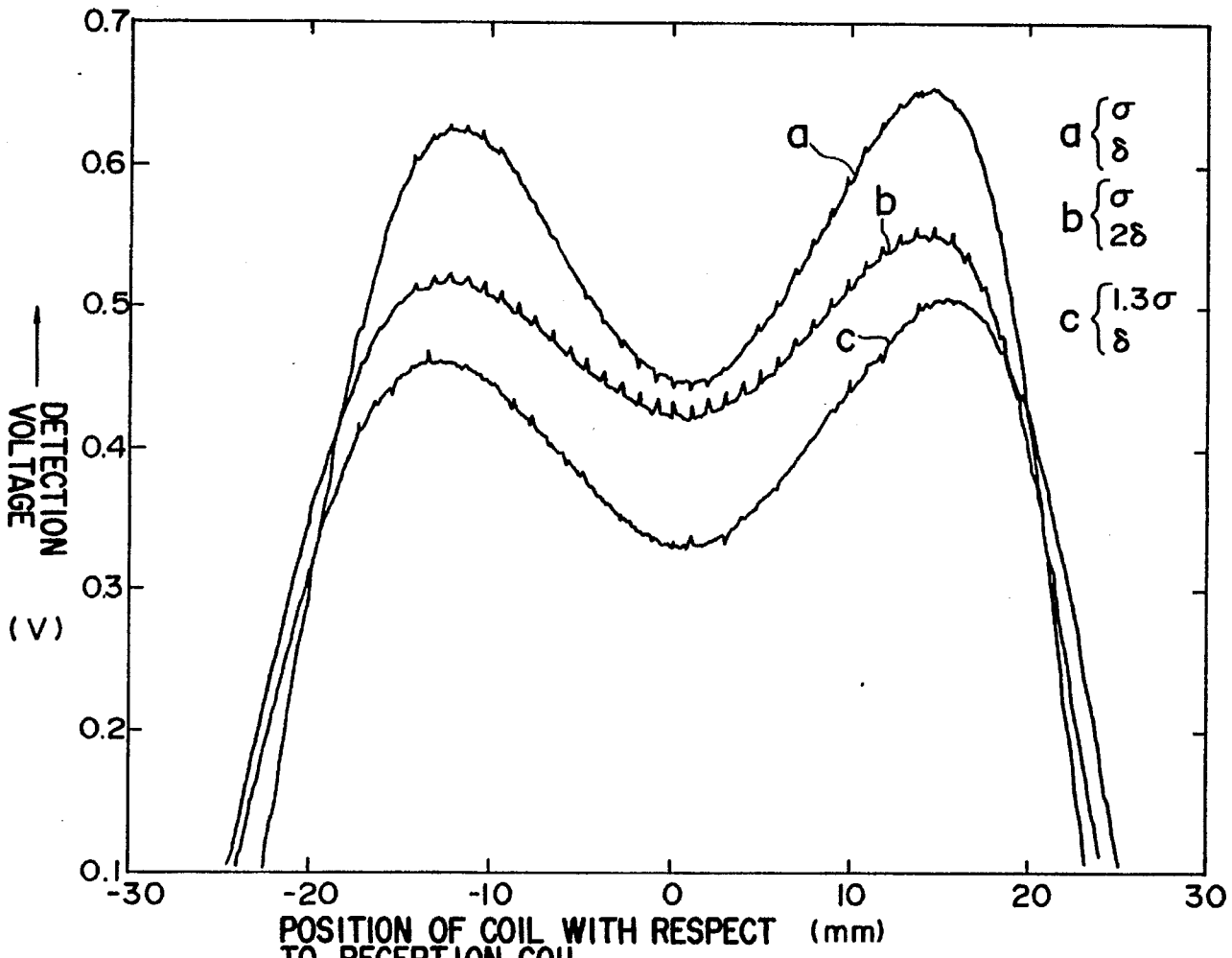
FIG. 18 is a graph showing detection waveforms from various conductivities and thicknesses of coins with the same diameter in order to explain the principle of the second embodiment of the present invention.

FIG. 18 shows detection outputs having double-peak waveforms obtained by actually sampling (phase-detecting) an induced signal of the reception coil 12 when coins having the same diameters are moved. Referring to FIG. 18, when characteristics a obtained when a coin having a conductivity $\sigma$ and a thickness $\delta$ is moved and characteristics b obtained when a coin having the same conductivity $\sigma$ and a thickness $2\delta$, which is changed, is moved are compared, although the peak voltage of the double-peak waveform is largely changed (decreased), a change in bottom voltage is small. When characteristics c obtained when a coin having a conductivity $1.3\sigma$, which is changed, and a thickness $\delta$, which is the same, and the characteristics a are compared, both the peak and bottom voltages of the double-peak waveform are largely changed (decreased).

As indicated by these measurement results, the peak value of the double-peak waveform exhibits the dependency on the material (conductivity) and thickness of the coin, and the bottom value of the double-peak waveform exhibits the dependency on the coin material rather than the thickness of the coin. When the bottom value of the double-peak waveform depends on only the material, the material can be directly clarified from the bottom value, as in the zinc coin described above. However, if a dependency, if small, on the thickness exists, as in a coin made of aluminum, the coin can be discriminated at higher precision by correctly knowing the degree of dependency and subjecting the degree of dependency to mathematical operations in the latter step.

More specifically, from the analytic results of the magnetic field by numerical calculation and the experimental results, two functions $$\sigma = Fs(V_p, V_b)$$

$$\delta = Fd(V_p, V_b)$$

representing the relationship among the conductivity $\sigma$ and the peak and bottom values $V_p$ and $V_b$ and the relationship among the thickness $\delta$ and the peak and bottom values $V_p$ and $V_b$ are introduced. From these two functions, the conductivity $\sigma$ and thickness $\delta$ of a coin are calculated at high precision on the basis of the peak and bottom values $V_p$ and $V_b$, thereby discriminating the coin.

The relationship among the conductivity $\sigma$ and the peak and bottom values $V_p$ and $V_b$, and the relationship among the thickness $\delta$ and the peak and bottom values $V_p$ and $V_b$ are largely changed in accordance with measurement conditions, e.g., the size and shape of the coil, and the size, shape, drive frequency, and the like of the core in the coil. In some case, the bottom value $V_b$ of an aluminum coin does not depend much on the thickness while the bottom value $V_b$ of a hard zinc coin depends much on the thickness. Whatever dependency may exist, however, the conductivity $\sigma$ and thickness $\delta$ can be calculated at high precision without any problem by introducing the two appropriate functions Fs and Fd from the experimental results.

In practice, the simpler the calculation of the two functions, the more advantageous. Hence, the present inventors studied the experimental results to find simpler functions, as will be described below. A function is preferably expressed by a simple linear expression even if the range of material and the range of thickness of a coin are subjected to certain limitations.

Figure 19A:
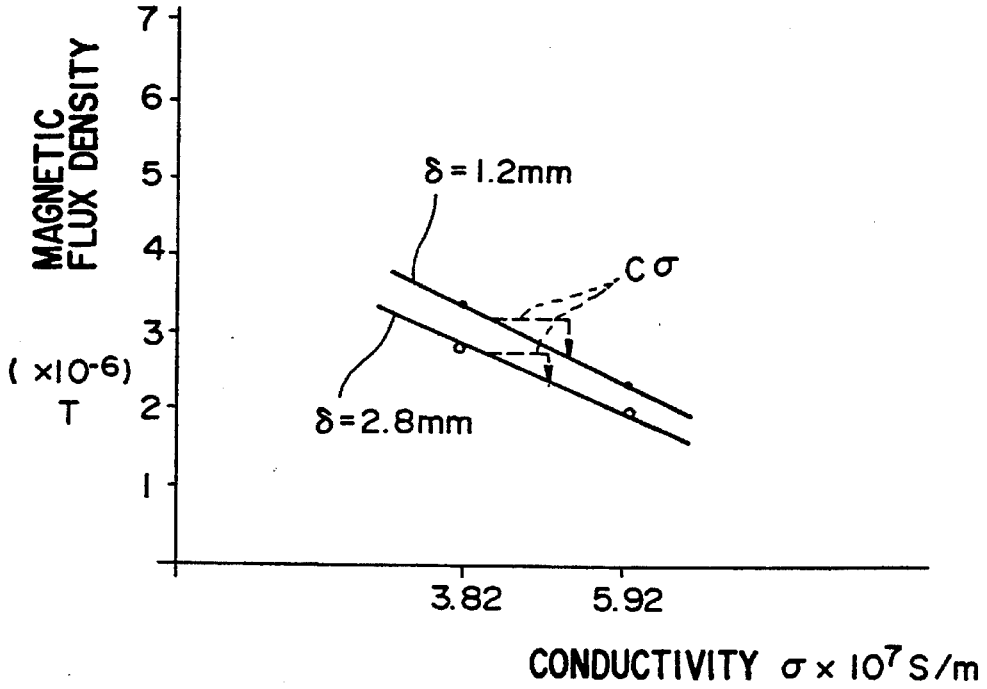
FIGS. 19A and 19B is a graph showing a change in peak value with respect to a change in conductivity or thickness of a coin.

The relationships between the peak values of the double-peak waveforms and the conductivities of the aluminum and copper coins having the same thickness but different materials, as shown in FIG. 6, are obtained. As shown in FIG. 19A, it is apparent that the rate of change (conductivity sensitivity C) in peak value with respect to the conductivity is substantially constant (i.e., a linear function).

Figure 19B:
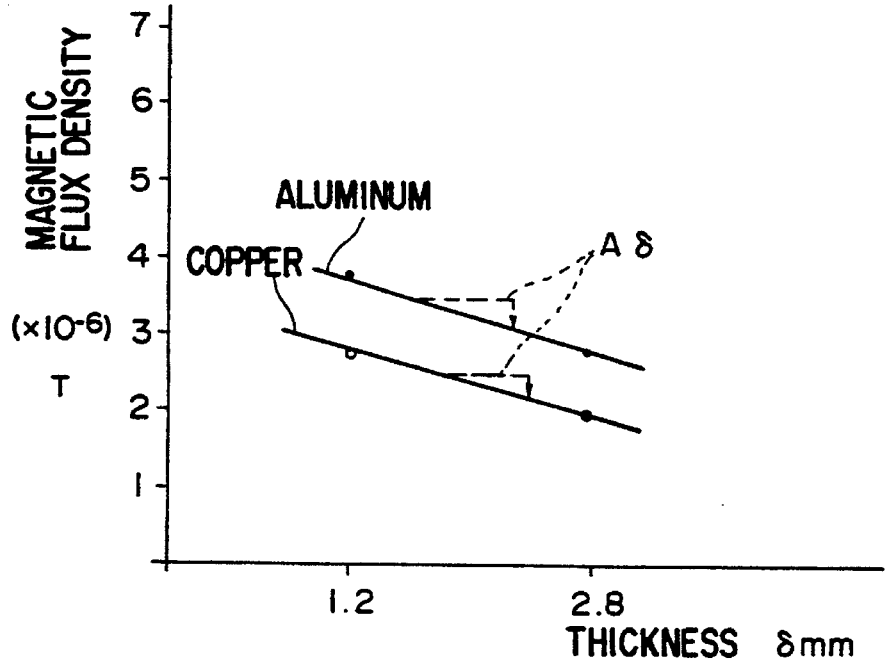

Similarly, the relationships between the thicknesses and peak values of coins having the same material are obtained. As shown in FIG. 19B, it is apparent that the rate of change (thickness sensitivity A) in peak value with respect to the thickness is substantially constant (linear).

Figure 20A:
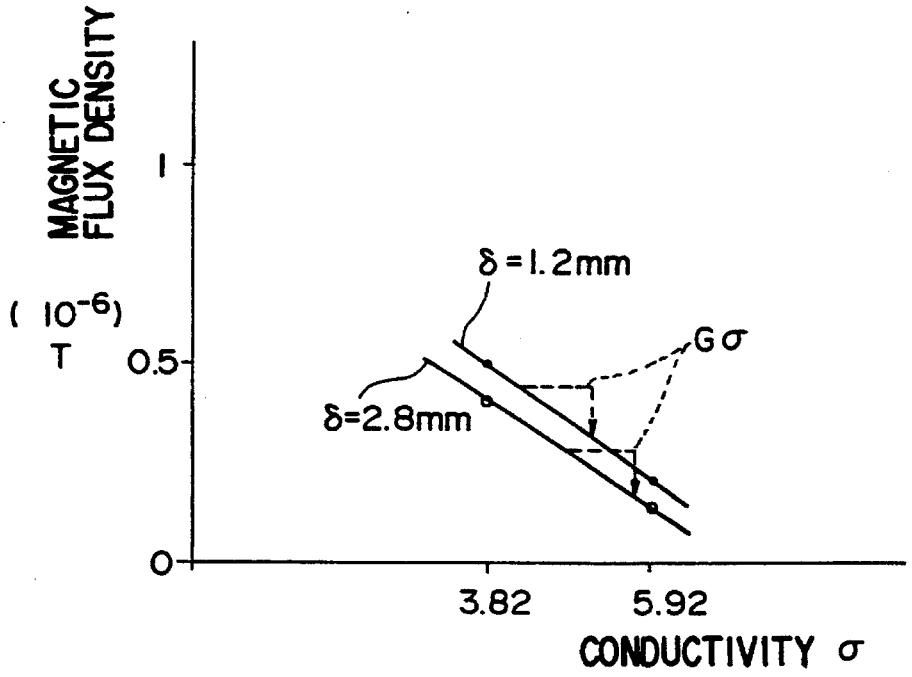
FIGS. 20A and 20B is a graph showing a change in bottom value with respect to a change in conductivity or thickness of a coin.
Figure 20B:
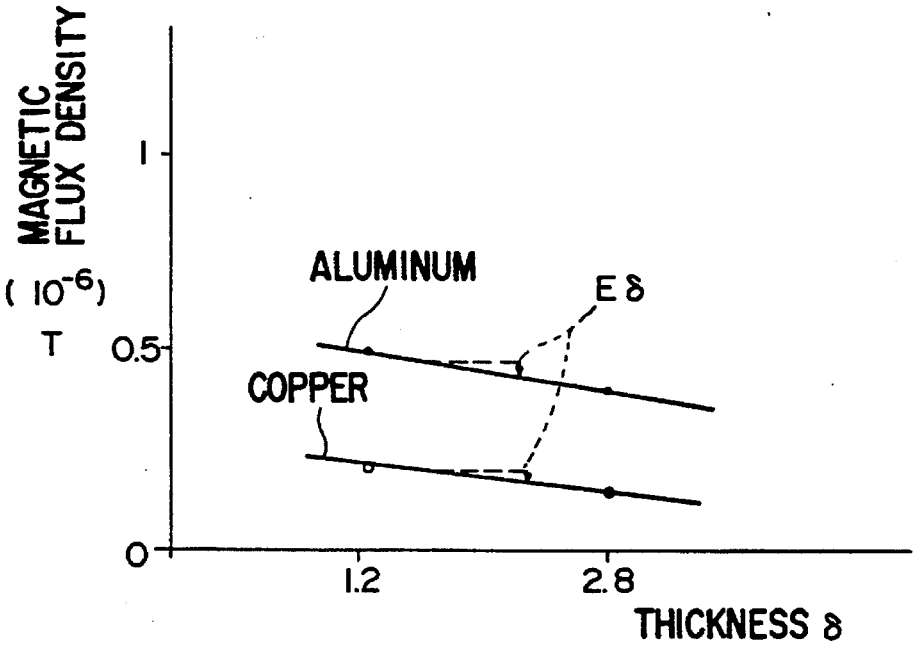

The relationships between the bottom values and conductivities of coins having the same thickness are obtained from FIG. 6. As shown in FIG. 20A, it is apparent that the rate of change (conductivity sensitivity G) in bottom value with respect to the conductivity is also substantially constant (linear), and as shown in FIG. 20B, the rate of change (thickness sensitivity E) in bottom value with respect to the thickness is also substantially constant.

Since these sensitivities are substantially constant, the peak and bottom voltages $V_p$ and $V_b$ of a double-peak waveform are expressed by the following two equations:

$$V_p=A\delta+C\sigma+D \quad (1)$$

$$V_b=E\delta+G\sigma+H \quad (2)$$

Hence, the conductivity $\sigma$ and thickness $\delta$ can be obtained by solving these two equations as simultaneous equations, thereby discriminating a coin.

If, however, a relationship $$A/c=E/G \text{ or } A/E=C/G$$

is established among the respective sensitivities, equations (1) and (2) having $\delta$ and $\sigma$ as variables become parallel straight lines within a $\delta$-$\sigma$ plane, and the solutions of $\delta$ and $\sigma$ cannot be obtained.

Figure 21:
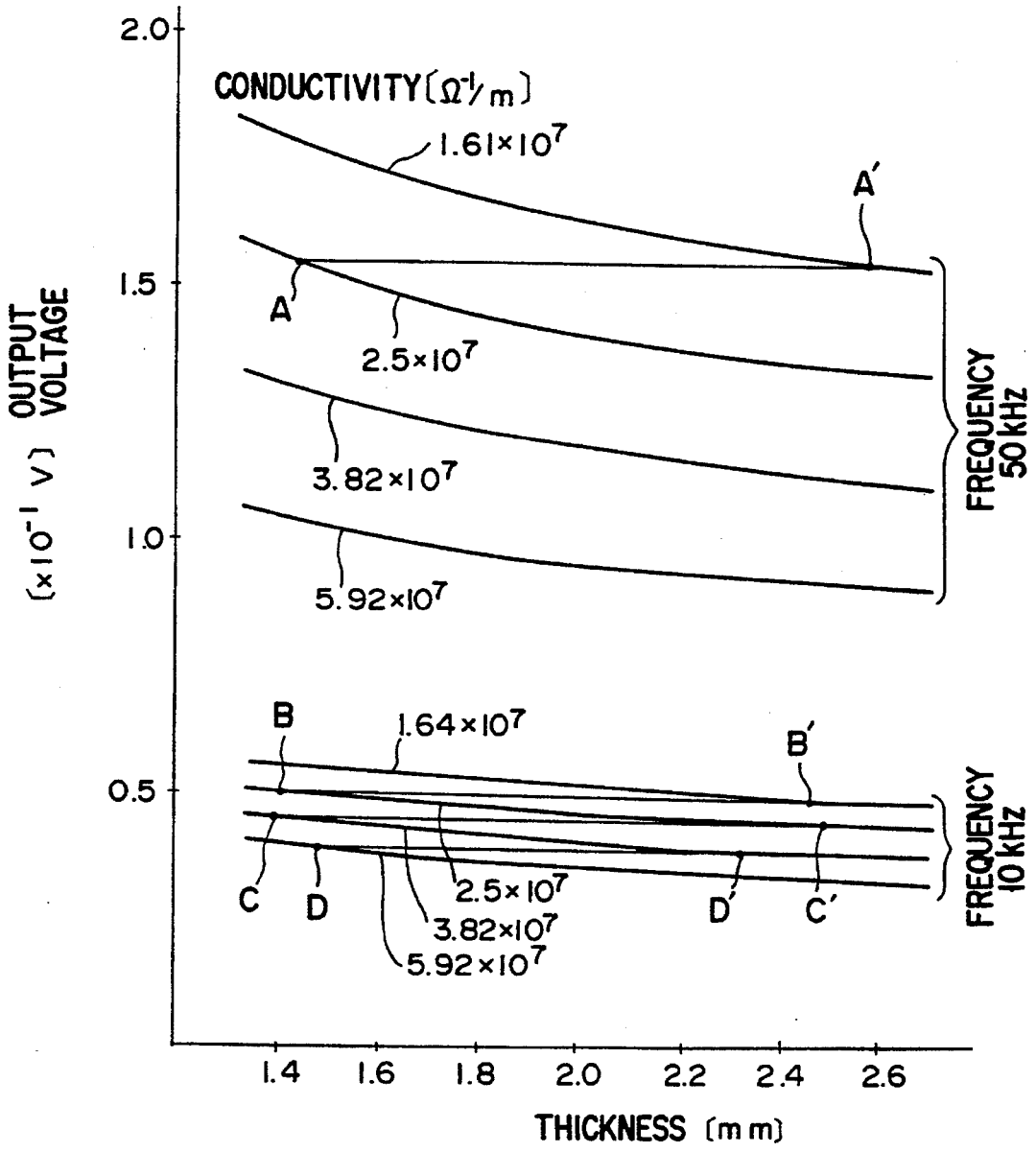
FIG. 21 is a graph showing the relationship among the conductivity of the coin, the thickness of the coin, and the output voltage of the reception coil.
Figure 22:
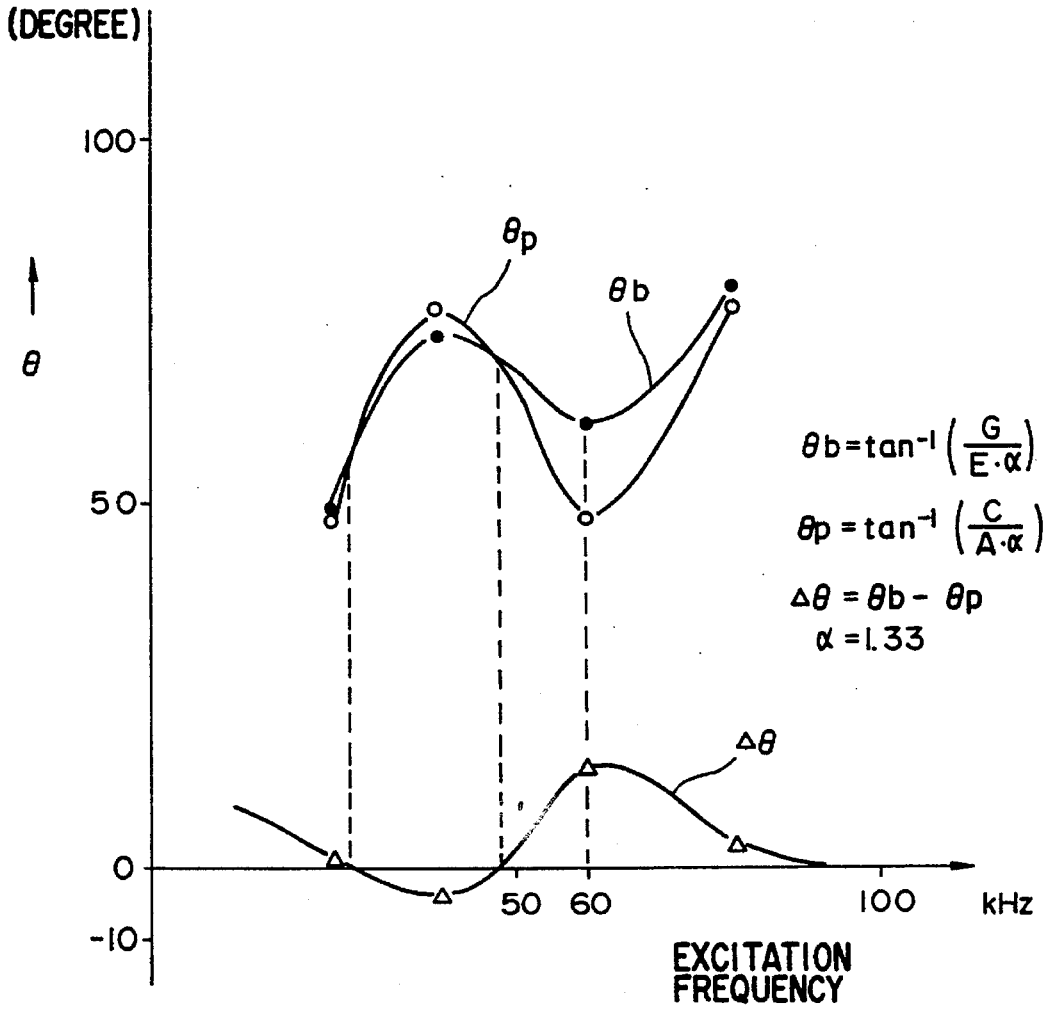
FIG. 22 is a graph showing a change in sensitivity ratio angle with respect to an excitation frequency.

As shown in FIG. 21, the respective sensitivities change depending on the excitation frequency. Hence, the present inventors considered sensitivity ratios $C/(A\cdot\alpha)$ and $G/(E\cdot\alpha)$ as the vector angles in linear algebra by actually using coins (e.g., 10-, 20-, and 50-cent coins used in Australia) as the discrimination target, and measured their angular changes with respect to the excitation frequency. Note that reference symbol $\alpha$ is a coefficient for correcting a difference between each of the conductivity $\sigma$ and thickness $\delta$ of an amount to be measured, and a corresponding measurement range. FIG. 22 shows the measurement results of angles representing the sensitivity ratios. When the excitation frequency is near 27 kHz and near 48 kHz, the tangential angle $\theta p=\tan^{-1}(C/A\cdot\alpha)$ of $C/(A\cdot\alpha)$ and the tangential angle $\theta b=\tan^{-1}(D/E\cdot\alpha)$ of $G/(E\cdot\alpha)$ coincide, and $\Delta\theta=\theta b-\theta p$ becomes zero. With these frequencies, equations (1) and (2) cannot be solved.

From FIG. 22, it is apparent that a frequency of 60 kHz, with which the difference between angles $\theta b$ and $\theta p$ representing sensitivity ratios becomes maximum, is an excitation frequency advantageous for stably and reliably obtaining solutions.

Accordingly, when equations (1) and (2) are solved by using the peak and bottom values $V_p$ and $V_b$ of a double-peak waveform detected by this optimum excitation frequency, and the respective sensitivities obtained with this excitation frequency, the conductivity $\sigma$ and thickness $\delta$ of a coin can be accurately obtained.

A coin discriminating apparatus according to the second embodiment of the present invention based on the principle of coin discrimination described above will be described.

The positional relationship among a coin track 10 and transmission and reception coils 11 and 12 of this embodiment is set in the same as that of the first embodiment described with reference to FIGS. 10 to 12.

Figure 23:
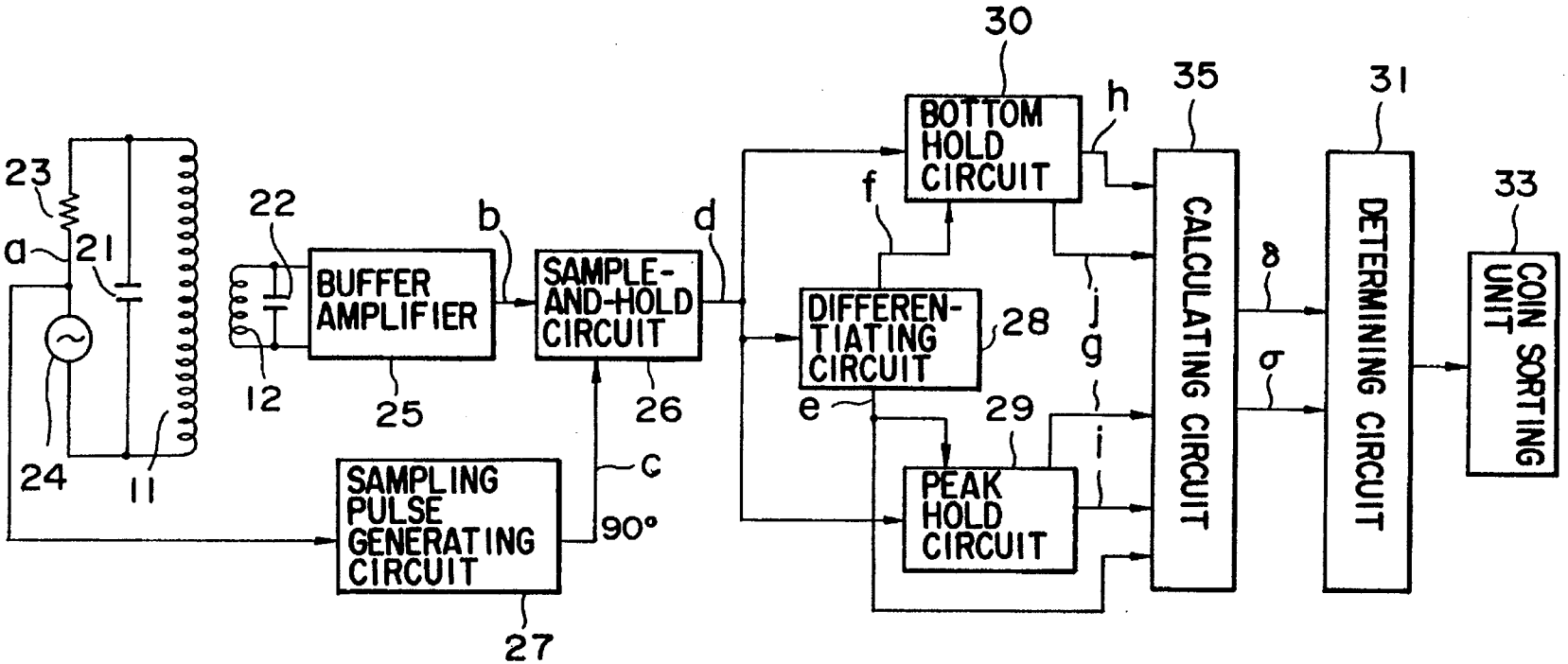
FIG. 23 is a block diagram showing the electric circuit used in the second embodiment of the present invention.

FIG. 23 is a block diagram showing the electric circuit used in this second embodiment.

FIG. 23 is different from FIG. 13A of the first embodiment in that the oscillation frequency of an oscillator 24 is set to 60 kHz and that a calculating circuit 35 is connected to the input of a determining circuit 31.

Hence, portions of FIG. 23 which are the same as those of FIG. 13A are denoted by the same reference numerals, and a detailed description thereof will be omitted. The function of the calculating circuit 35 will be mainly described below.

The calculating circuit 35 separately calculates e and k by following two equations:

$$\sigma=LV_p+MV_b+N \quad (3)$$

$$\delta=PV_p+QV_b+R \quad (4)$$

obtained by solving equations (1) and (2) with regard to the conductivity e and the thickness of a coin. Note that L, M, and N, and p, Q, and R satisfy $$L=-E/(AG-CE)$$

$$M=A/(AG-CE)$$

$$N=(DE-AH)/(AG-CE)$$

$$P=-G/(CE-AG)$$

$$Q=C/(CE-AG)$$

$$R=(DG-CH)/(CE-AG)$$

L to N, and P to R are expressed by using thickness sensitivities A and E, and conductivity sensitivities C and G at the peak and bottom values of a double-peak waveform detected with the maximum excitation frequency of 60 kHz described above, and constants D and H. These sensitivities and constants are values obtained in advance by experiments and stored in the calculating circuit 35. The calculating circuit 35 calculates the conductivity $\sigma$ and the thickness $\delta$ by substituting peak and bottom values $V_p$ and $V_b$ of the detected double-peak waveform in equations (3) and (4).

The determining circuit 31 compares the calculated conductivity $\sigma$ and thickness $\delta$ with reference values corresponding to several denominations of coins and respectively having specific numerical ranges, in the same manner as in the first embodiment. If the conductivity $\sigma$ and thickness $\delta$ fall within the range of a certain coin, the determining circuit 31 determines that the coin in question is this specific coin. If the conductivity $\sigma$ and thickness $\delta$ do not fall within the range of this coin, the determining circuit 31 determines that the coin in question is a counterfeit coin, and outputs a determination signal. In this manner, the authenticity or denomination of the coin is determined, and the coin is directed in a storing or discharge direction or the like by a coin sorting unit 33 on the basis of the determination signal.

Figure 24:
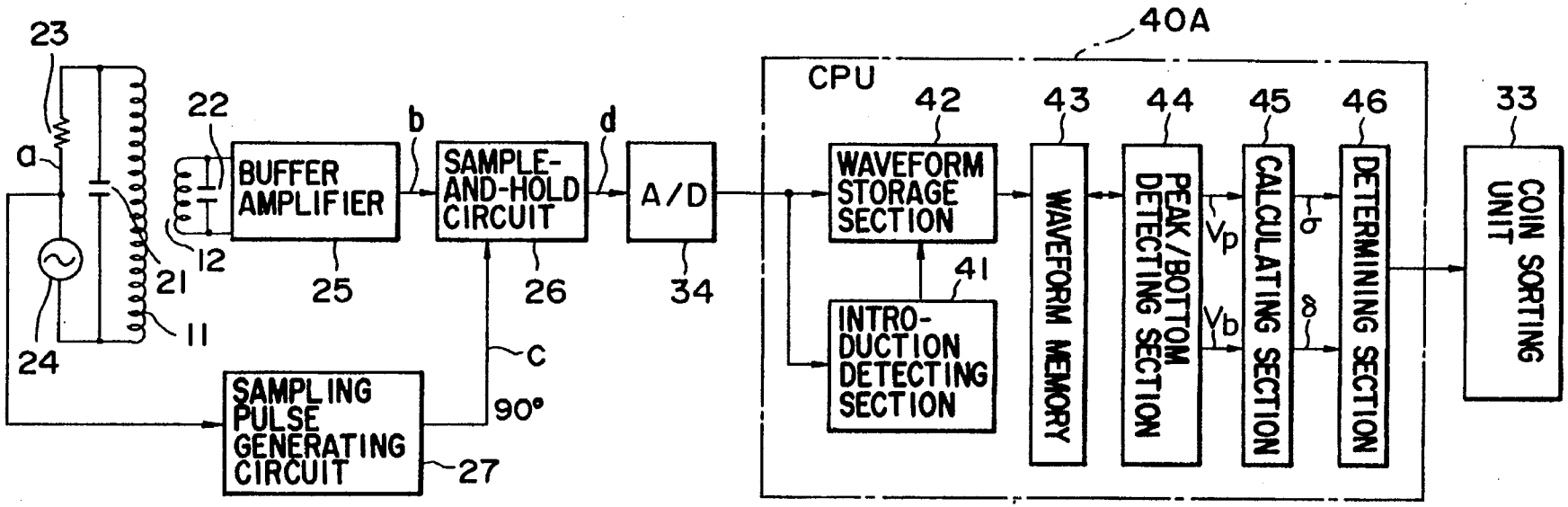
FIG. 24 is a block diagram showing the electric circuit of another arrangement of the second embodiment of the present invention.

In this embodiment, the peak and bottom values are detected in an analog manner by using a peak hold circuit and a bottom hold circuit. However, as shown in FIG. 24, an output from a sample-and-hold circuit (phase detection circuit) 26 may be digitized by an A/D converter 34 and input to a processing unit 40A including a CPU shared by the calculating circuit 35, thereby determining the coin.

In the processing unit 40A, when it is detected by an introduction detecting section 41 that the output from the A/D converter 34 exceeds a predetermined value as the coin moves into the magnetic field, an output waveform of the A/D converter 34 is stored in a waveform memory 43 by a waveform storage section 42. A peak/bottom detecting section 44 obtains a peak value $V_p$ and a bottom value $V_b$ of the waveform stored in the waveform memory 43. A calculating section 45 calculates the conductivity $\sigma$ and the thickness $\delta$ from the peak and bottom values $V_p$ and $V_b$ in accordance with equations (3) and (4). A determining section 46 determines whether the coin is an authentic coin that can be used, based on the calculated conductivity $\sigma$ and thickness $\delta$, and outputs a signal corresponding to the determination result to a coin sorting unit 33.

This embodiment exemplifies a case wherein the frequency of the magnetic field is 60 kHz. However, the present invention is not limited to this. It suffices if a coil having a frequency optimum to a coin and the like as the discrimination target is used.

Figure 25:
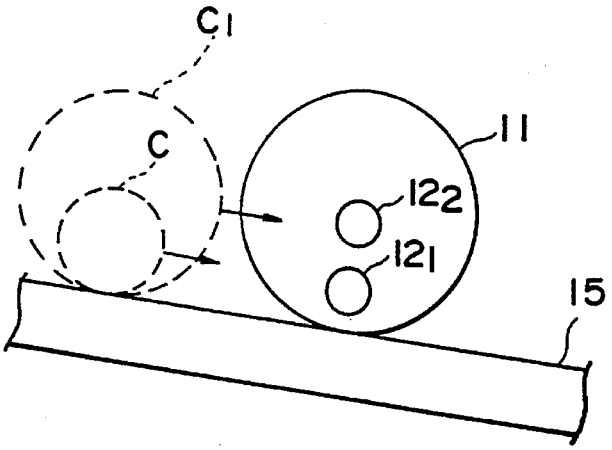
FIG. 25 is a view showing the relationship among the coil and the transmission/reception coils when the number the reception coils is two.
Figure 26:
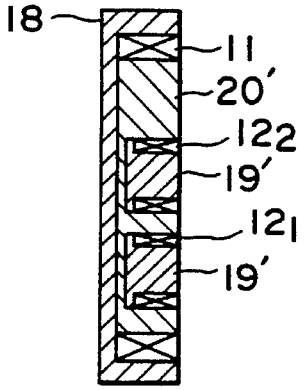
FIG. 26 is a sectional view showing the actual transmission and reception coils of the type shown in FIG. 25.

In this embodiment, the number of transmission coils is one and the number of reception coils is one. However, as shown in FIGS. 25 and 26, for example, two reception coils 121 and 122 may be arranged at different heights for one transmission coil 11, the reception coil with which peak and bottom values can be clearly obtained may be selected, and the conductivity and thickness may be calculated from the peak and bottom values of the selected reception coil. Referring to FIG. 26, reference numeral 19' denotes a core of the reception coil; 20', a spacer or part of a core 18.

In this manner, when two reception coils are used, signals induced by the reception coils $\mathbf{12}_1$ and $\mathbf{12}_2$ are output to sample-and-hold circuits $\mathbf{26}_1$ and $\mathbf{26}_2$ through buffer amplifiers $\mathbf{25}_1$ and $\mathbf{25}_2$, respectively, thereby obtaining detection signals in units of reception coils. The detection signals are time-divided by a multiplexer 36, converted into digital values by an A/D converter 34, and output to a processing unit 40A'.

In the processing unit 40A', when movement of a coin into the magnetic field is detected by an introduction detecting section 41, the output waveforms in units of reception coils are stored in regions in units of reception coils of a waveform memory 43 by a waveform storage section 42. A peak/bottom detecting section 44 obtains peak and bottom values $V_p$ and $V_b$ of each waveform stored in the waveform memory 43 and outputs them to a selecting section 47.

Figure 28:
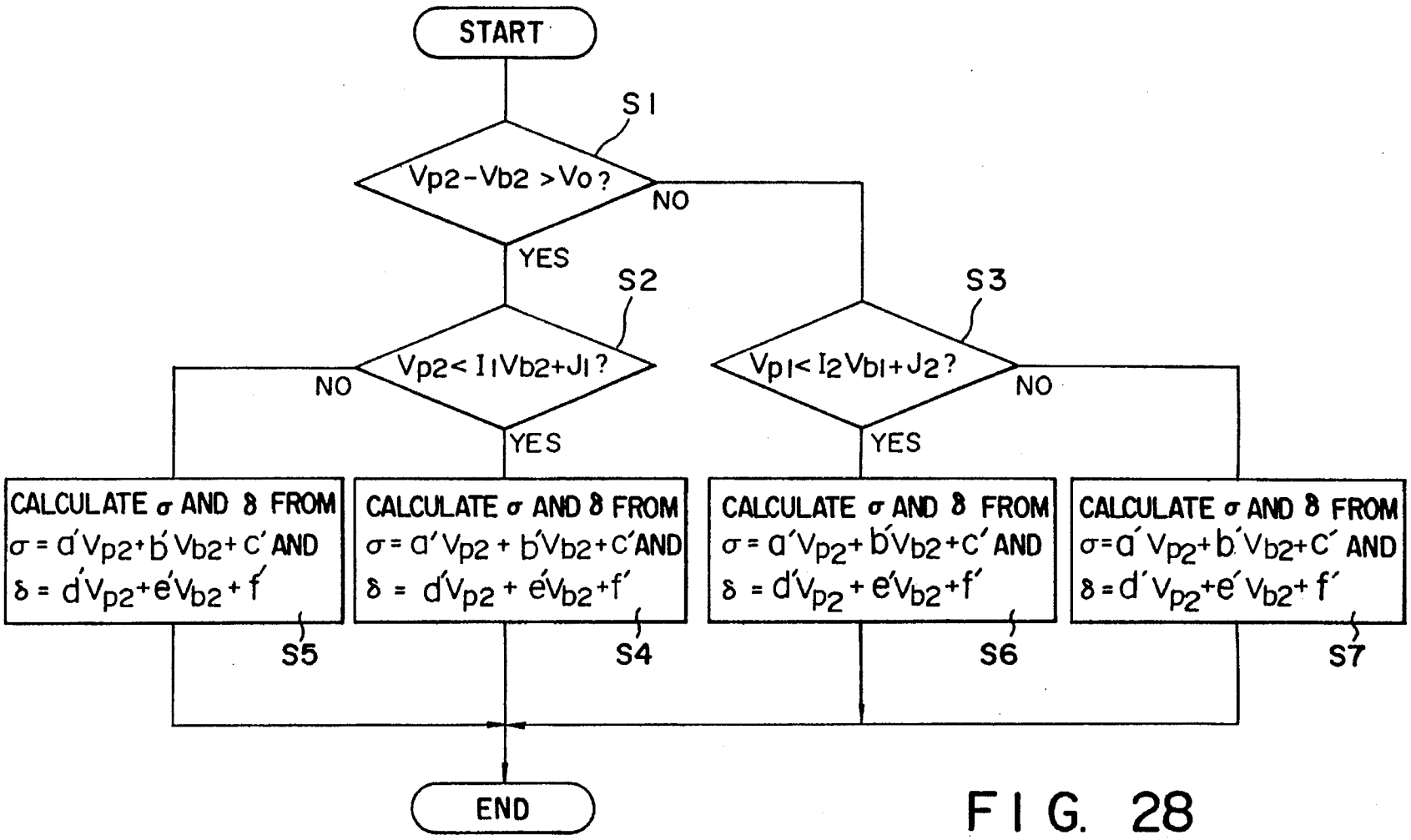
FIG. 28 is a flow chart of the main part of FIG. 27.

The selecting section 47 and a calculating section 45 select peak and bottom values optimum for calculation in accordance with the flow chart of FIG. 28 and calculate a conductivity $\sigma$ and a thickness $\delta$ of the coin.

More specifically, first, whether a difference between a peak value $V_{p2}$ and a bottom value $V_{b2}$ of the output waveform obtained by the upper reception coil $\mathbf{12}_2$ exceeds a predetermined reference value $V_0$. If this difference exceeds $V_0$, these peak and bottom values $V_{p2}$ and $V_{b2}$ are selected, and whether the material of this coin has a high or low conductivity is determined in accordance with a determination inequality:

$$V_{p2}<I_1V_{b2}+J_1 \tag{5}$$

(steps S1 and S2).

If the difference between the peak and bottom values $V_{p2}$ and $V_{b2}$ is smaller than $V_0$, peak and bottom values $V_{p1}$ and $V_{b1}$ obtained by the lower reception coil $\mathbf{12}_1$ are selected, and whether the material of this coin has a high or low conductivity is determined in accordance with a determination inequality:

$$V_{p1}<I_2V_{b2}J_2 \tag{6}$$

(step S3). In determination inequalities (5) and (6), the degree of change in peak value with respect to a change in bottom value differs between a range of a high conductivity and a range of a low conductivity, and whether the conductivity is high or low is determined by using the degree of change ($I_1$ or $I_2$) at the boundary of these ranges. Constants ($I_1$,$J_2$), and ($I_2$,$J_2$) are determined in advance in units of reception coils.

If the peak and bottom values $V_{p2}$ and $V_{b2}$ of the output waveform obtained by the upper reception coil $\mathbf{12}_2$ satisfy steps S1 and S2, the conductivity $\sigma$ and thickness $\delta$ of the coin are calculated in accordance with following two equations:

$$\sigma=aV_{p2}+bV_{b2}+c \tag{7}$$

$$\delta=dV_{p2}+eV_{b2}+f \tag{8}$$

that are equivalent to equations (3) and (4) (step S4). Constants a to f are constants obtained from calculating the constants (A, C, D, E, G, and H) of equations (1) and (2). As described above, since the respective constants of equations (1) and (2) are experimentally obtained in advance in units of reception coils and for each of the high and low conductivities, the constants a to f also has known values.

If it is determined in step S2 that the conductivity is low, the conductivity $\sigma$ and the thickness $\delta$ of the coin are calculated in accordance with calculations of equations (7) and (8) performed by changing the constants a to f to constants a' to f' corresponding to the low conductivity (step S5).

When the processing speed of the calculating section 45 is sufficiently high, the two functions Fs and Fd are changed to functions more complicated than linear equations. Then, the functions can be commonly applied to coin materials having high and low conductivities, thereby eliminating branching necessitated by the determination equations.

When the peak and bottom values $V_{p1}$ and $V_{b1}$ of the lower reception coil $\mathbf{12}_1$ are selected, the conductivity $\sigma$ and the thickness $\delta$ of the coin are calculated in accordance with calculations of equations (7) and (8) performed by changing the constants to p to u or p' to u' (steps S5 to S7).

In this manner, when a plurality of reception coils are arranged at different heights for one transmission coil, if a small-diameter coin is detected by the lower reception coil and a large-diameter coin is detected by the upper reception coil, a double-peak detection waveform can always be obtained. Hence, this arrangement can be easily applied to a machine in which coins having extremely different diameters are used, thereby much improving the versatility.

Figure 29:
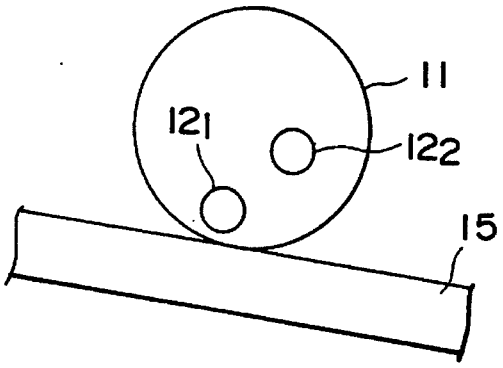
FIG. 29 is a view showing an arrangement in which the two reception coils are deviated in the moving direction of the coin.
Figure 27:
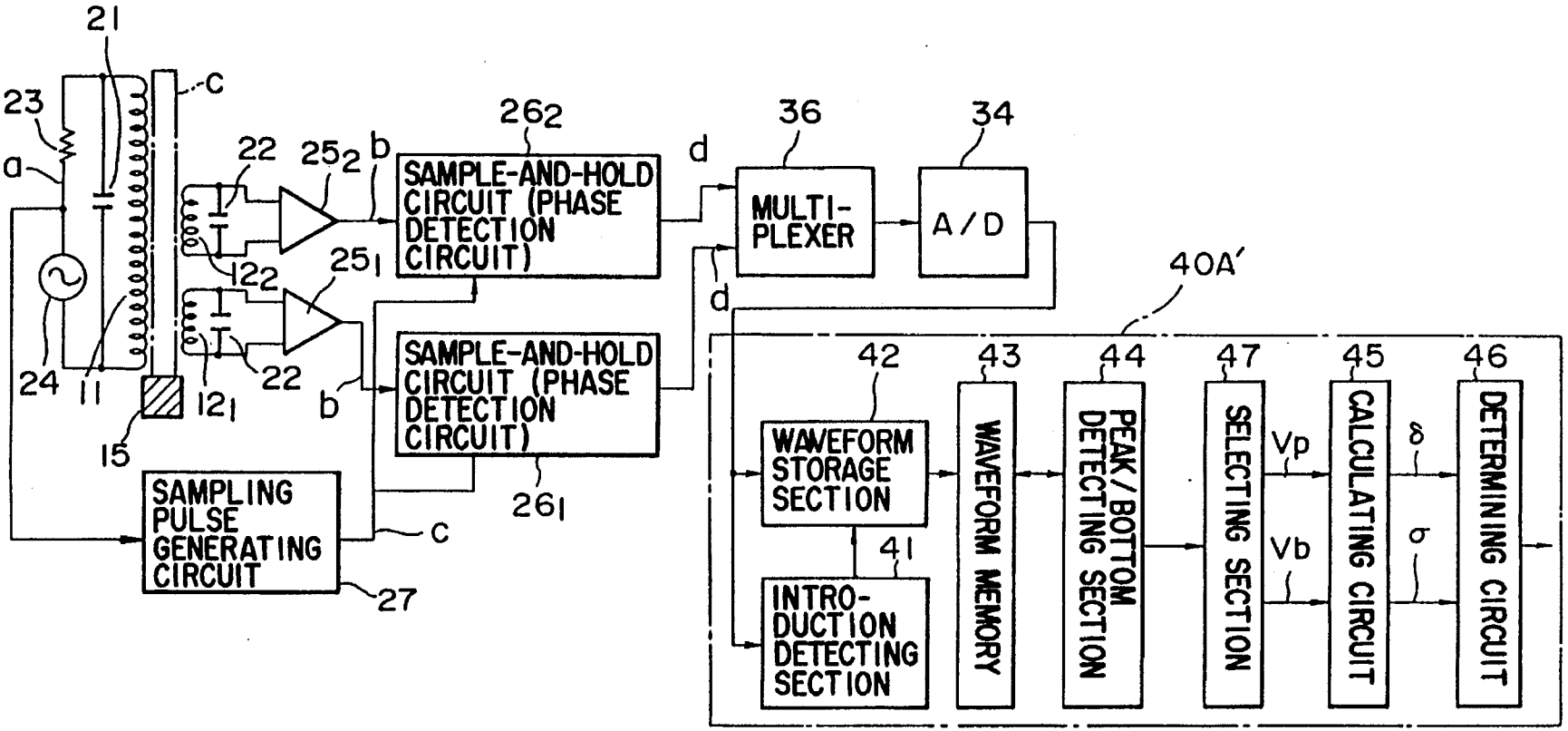
FIG. 27 is a block diagram of the arrangement of the second embodiment corresponding to the two reception coils.

Since the peak and bottom values of detection waveforms that are obtained independently are selected in units of reception coils, as shown in, e.g., FIG. 29, the reception coils $\mathbf{12}_1$ and $\mathbf{12}_2$ may be disposed at different positions in the moving direction of the coin.

In these embodiments, as shown in FIGS. 12 and 26, the transmission coil 11 and the reception coil 12 (or $\mathbf{12}_1$ and $\mathbf{12}_2$) are arranged on the same plane and integrated, so that the positions of the transmission and reception coils relative to each other will not change. When compared to a conventional arrangement in which the transmission and reception coils oppose each other through the coin track, this arrangement is advantageous in that the coils can easily be mounted, a variation in return position and vibration of the cover plate 14 in the discriminating apparatus, having a forcible return mechanism for moving the cover plate 14 apart from the base plate 13, can be coped with, and a change in magnetic field can be stably detected. In a selecting apparatus which does not have such a return mechanism, transmission and reception coils may be arranged to oppose each other, in the same manner as in the conventional apparatus.

As described above, in the coin discriminating apparatus according to the second embodiment of the present invention, the denomination or authenticity of a coin is discriminated by detecting a change in magnetic field occurring during movement of a coin in which a stronger eddy current is generated in its peripheral portion rather than its central portion, by a reception coil having a diameter smaller than that of the coin, and calculating the conductivity $\sigma$ and thickness $\delta$ of a coin from the following two equations:

$$\sigma=LV_p+MV_b+N$$

$$\delta=PV_p+QV_b+R$$

which are obtained by considering a fact that the rates of change (thickness sensitivities) in peak and bottom values $V_p$ and $V_b$ of the detection output with respect to the thickness are substantially constant and that the rate of change (conductivity sensitivities) in peak and bottom values with respect to the conductivity are substantially constant.

Therefore, when the peak and bottom values are detected by selecting an optimum excitation frequency, the conductivity and thickness can be separately, reliably, and accurately obtained. It suffices if one transmission coil is energized with a single frequency. Then, the circuit configuration of the sensor portion can remarkably be simplified, and mounting can be performed more easily.

In the coin discriminating apparatus according to the present invention which calculates the conductivity and thickness of a coin by using the peak and bottom values of a reception coil selected from a plurality of reception coils that are disposed at different heights for one transmission coil, the conductivities and thicknesses of coins of a wide range of small- to large-diameter coins can be detected, so that the versatility is much enhanced.

In the coin discriminating apparatus according to the present invention in which the transmission and reception coils are disposed on the same plane and integrated, the coils can easily be mounted compared to an apparatus in which the transmission and reception coils oppose each other. Since the positions of the transmission and reception coils relative to each other do not change, even a discriminating apparatus having a forcible return mechanism can perform stable detection.

The third embodiment of the present invention will be described.

The basic principle of this embodiment will be described first. The premise of the third embodiment is the same as the detecting method of the double-peak waveform described in the first embodiment with reference to FIGS. 1 to 7.

The third embodiment is characterized in that a double-peak waveform itself is not detected but a so-called dip waveform is detected and hence the diameter (information) of the coin is discriminated.

More specifically, the first and second embodiments described above are based on the premise that the diameter (information) of the coin should be known in advance by some detecting means. The third embodiment can be used as the detecting means used for this purpose.

Figure 30A:
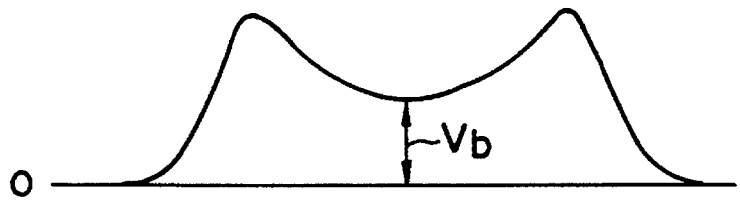
FIGS. 30A and 30B are are charts showing detected waveforms representing a change in the magnetic field accompanying the movement of the coin in order to explain the basic principle of the third embodiment of the present invention.
Figure 30B:
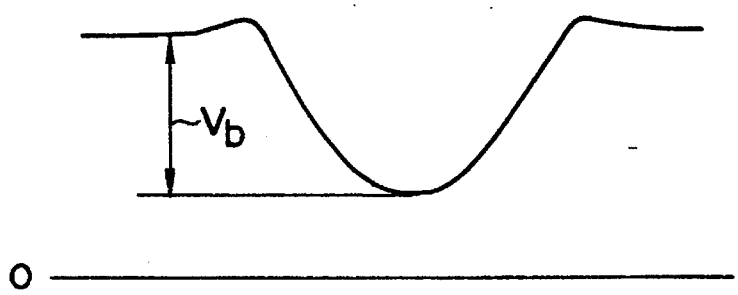
Figure 31:
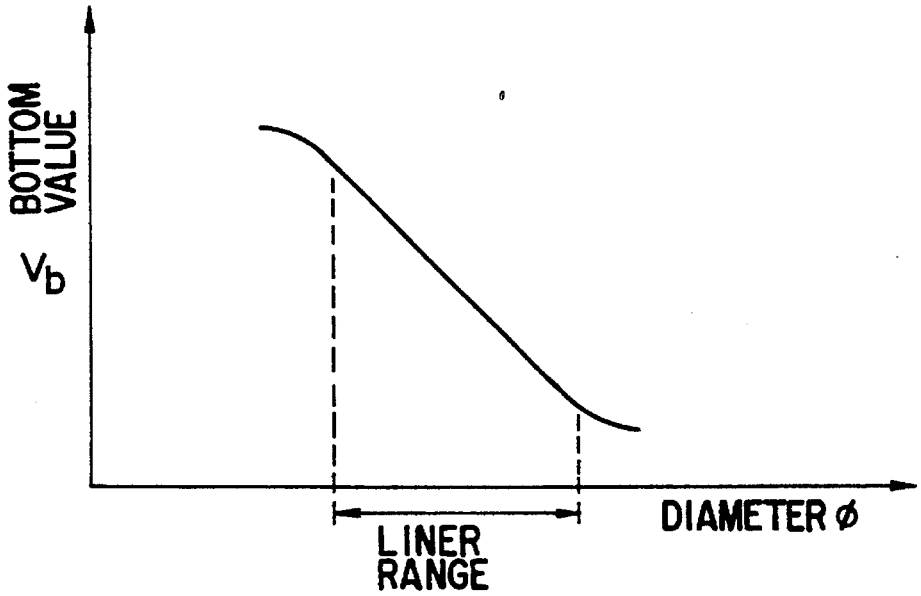
FIG. 31 is a chart showing the change in bottom value detected by one reception coil with respect to the diameter of a coin.

Discrimination of the coin diameter (information) by detecting a dip waveform will be described. The detection principle of the double-peak waveform described above is, as shown in FIG. 1, when a coin passes the reception coil 12 arranged along the coin track 10 under a high magnetic field frequency, the detection waveform of the change in magnetic field becomes a double-peak waveform having a bottom value $V_b$, as shown in FIG. 30A. The difference between the double-peak waveform shown in FIG. 30A and the dip waveform shown in FIG. 30B depends on a difference in sampling phase (phase detection) of the reception coil 12 with respect to an induced signal. The double-peak waveform of FIG. 30A is a waveform obtained when sampling (phase detection) is performed at a 90° phase with which an output in the absence of a coin becomes zero, and the dip waveform of FIG. 30B is a waveform obtained when sampling (phase detection) is performed at a 0° phase with which an output in the absence of a coin becomes maximum. In either case, it is apparent that the bottom value is not influenced much by the material or thickness of the coin but substantially depends only on a diameter $\phi$ of the coin, and that the diameter $\phi$ satisfies a diameter function $\phi=Fph(V_b)$. In addition, it is also apparent that even if the diameter $\phi$ satisfies a substantially linear equation $\phi=AV_p+B$ (A: a coefficient; B: a constant) in practice within a certain range (V1 to V2), as shown in FIG. 31, acceptable discrimination can be performed.

These characteristics are obtained due to the existence of one reception coil fixed at a predetermined height. Since the linear region of these characteristics is a limited linear range capable of providing a bottom value, the above equation cannot be satisfied with a coin having a diameter exceeding this range.

Figure 32:
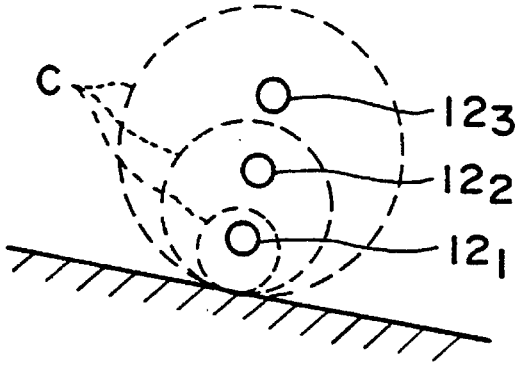
FIG. 32 is a view showing the positional relationship among three reception coils and coins.

Hence, as shown in FIG. 32, a reception coil $\mathbf{12}_1$ for detecting a change in magnetic field at the central portion of a coin $C_S$ having a minimum diameter and a reception coil $\mathbf{12}_3$ for detecting a change in magnetic field at the central portion of a coin $C_b$ having the maximum diameter are arranged above and under a reception coil $\mathbf{12}_2$.

Figure 33:
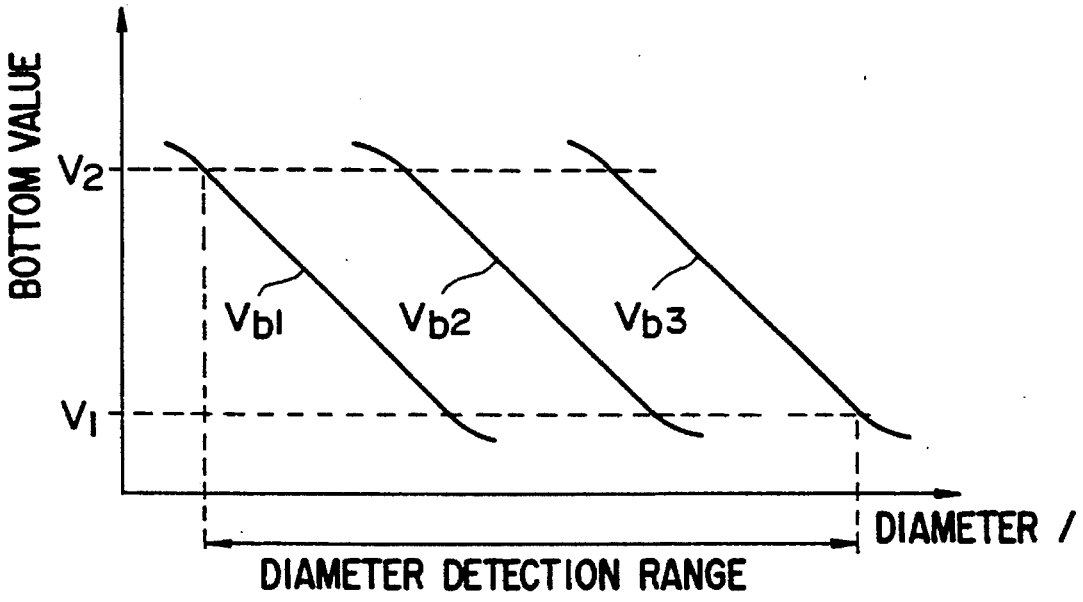
FIG. 33 is a chart showing changes in bottom values of the three reception coils.

Since the respective reception coils have detection characteristics satisfying the above equation in the respective coin diameter regions, if the diameter regions of these reception coils are set to slightly overlap each other, as shown in FIG. 33, the linear range can be widened to coins ranging from the minimum to maximum diameters, and the diameter can be calculated from a bottom value falling within a range of $V_1$ to $V_2$.

A coin diameter discriminating apparatus according to the third embodiment of the present invention based on the principle described above will be described.

Figure 34:
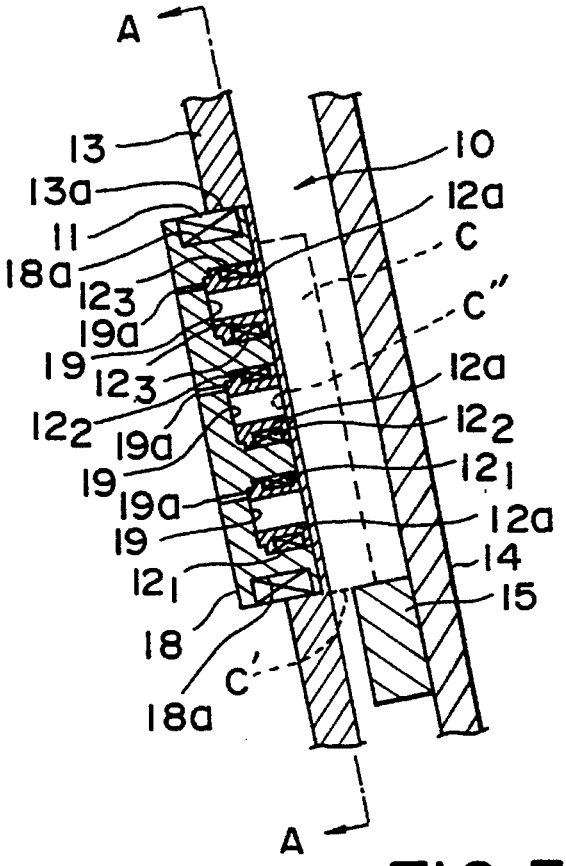
FIG. 34 is a sectional view of the coin track of the third embodiment of the present invention.
Figure 35:
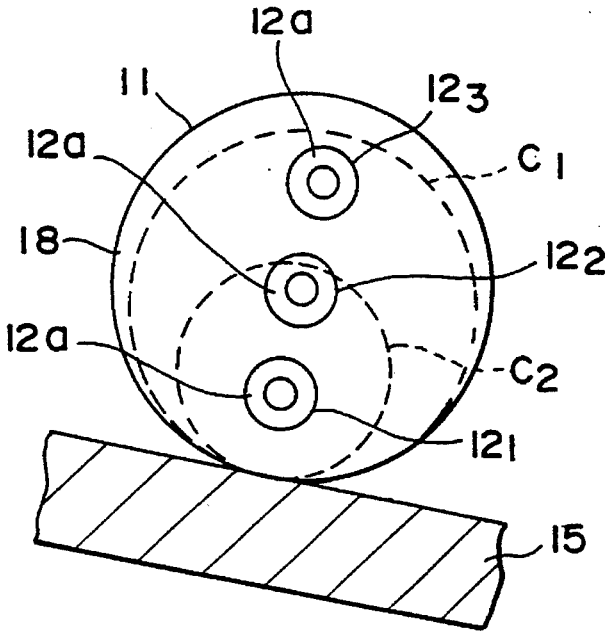
FIG. 35 is a view taken along the line A—A of FIG. 34.

As shown in FIGS. 34 and 35, a coin track 10 is constituted by a base plate 13 inclined with respect to a vertical plane, a cover plate 14 at a predetermined gap from and parallel to the base plate 13, and a rail 15 mounted on the cover plate 14 to be inclined with respect to the horizontal line. When a coin C drops onto the coin track 10, it falls in rolling contact with the inclined rail 15 while its circumferential surface C' contacts the rail 15 and its face C" contacts the base plate 13.

A round hole 13*a* having a predetermined depth is formed in the lower surface of the base plate 13, and a transmission coil 11 is provided in the round hole 13*a* within a plane substantially parallel to the base plate 13. Three reception coils $\mathbf{12}_1$, $\mathbf{12}_2$, and $\mathbf{12}_3$ each smaller than the transmission coil 11 are arranged in a row at different heights to be perpendicular to the rail 15.

Figure 36:
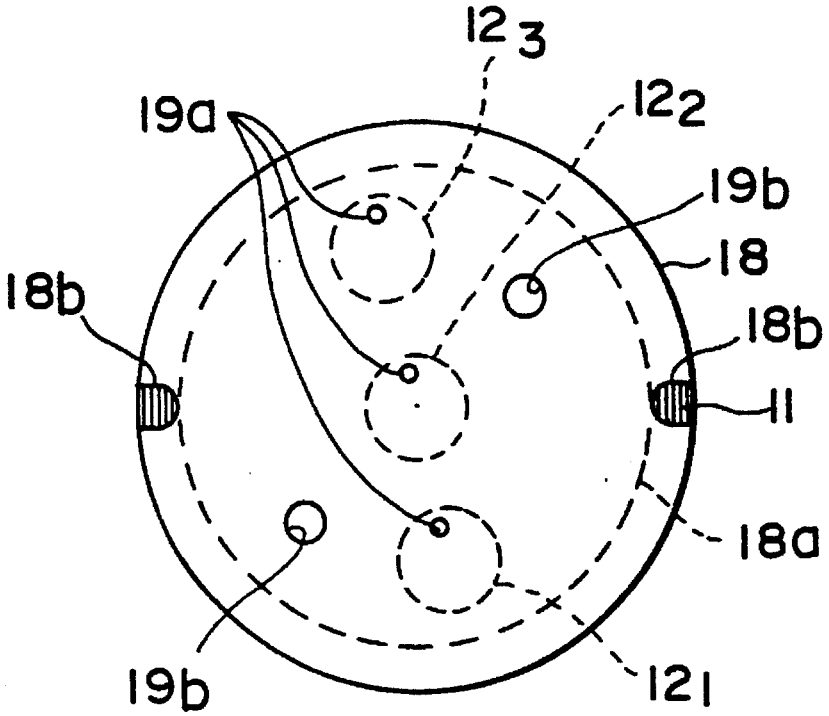
FIG. 36 is a view of transmission/reception coils seen from the rear side.
Figure 37:
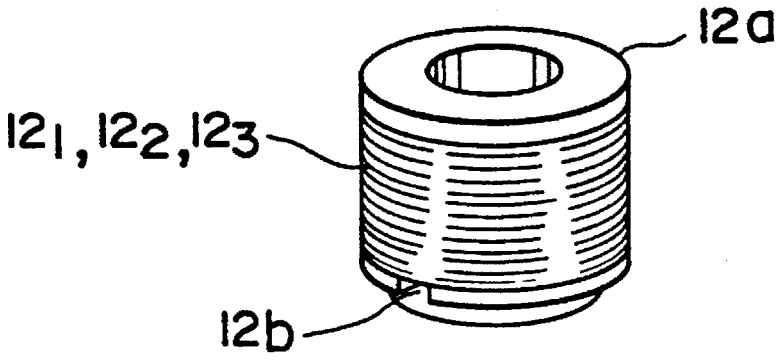
FIG. 37 is an enlarged perspective view of a reception coil.

As shown in FIG. 36, the transmission coil 11 is wound on an outer circumferential groove 18*a* of a large cylindrical bottomed core 18. As shown in FIG. 37, the reception coils $\mathbf{12}_1$, $\mathbf{12}_2$, and $\mathbf{12}_3$ are wound on corresponding bobbins 12*a*, and fitted in three circular holes 19*a* linearly arranged on one side surface of the core 18. Lead wires (not shown) of the transmission coil 11 are derived from U-shaped notches 18*b* in the edge portions of the bottom portion of the core 18, and the lead wires (not shown) of the reception coils $\mathbf{12}_1$, $\mathbf{12}_2$, and $\mathbf{12}_3$ are derived from notches 12*b* in the edge portions of the lower portion of the respective bobbins 12*a* to the rear surface of the core 18 through lead holes 19*a* extending through the bottom portions of the circular holes 19. The large-diameter core 18 is fitted in the round hole 13*a* of the base plate 13, so that the transmission and reception coils are fixed on the base plate 13. Circular holes 19b in FIG. 36 are screw holes for fixing the core 18 from the rear side by screwing. In this manner, since a plurality of reception coils are arranged on the same plane in the transmission coil and integrated, the positions of the reception and transmission coils with respect to each other do not change, stable, high-precision magnetic field detection is enabled, and the coils can be easily mounted on the coin track (base plate 13).

The sizes (inner diameters) of the reception coils $\mathbf{12}_1$, $\mathbf{12}_2$, and $\mathbf{12}_3$ must be much smaller than the diameter of the coin C in order to obtain a detection waveform having a bottom value, and is preferably 0.25 times or less the diameter of the coin. The transmission coil 11 must be very larger than the reception coil 12, and its size (inner diameter) is preferably 0.5 times or more the diameter of the coin C.

Figure 38:
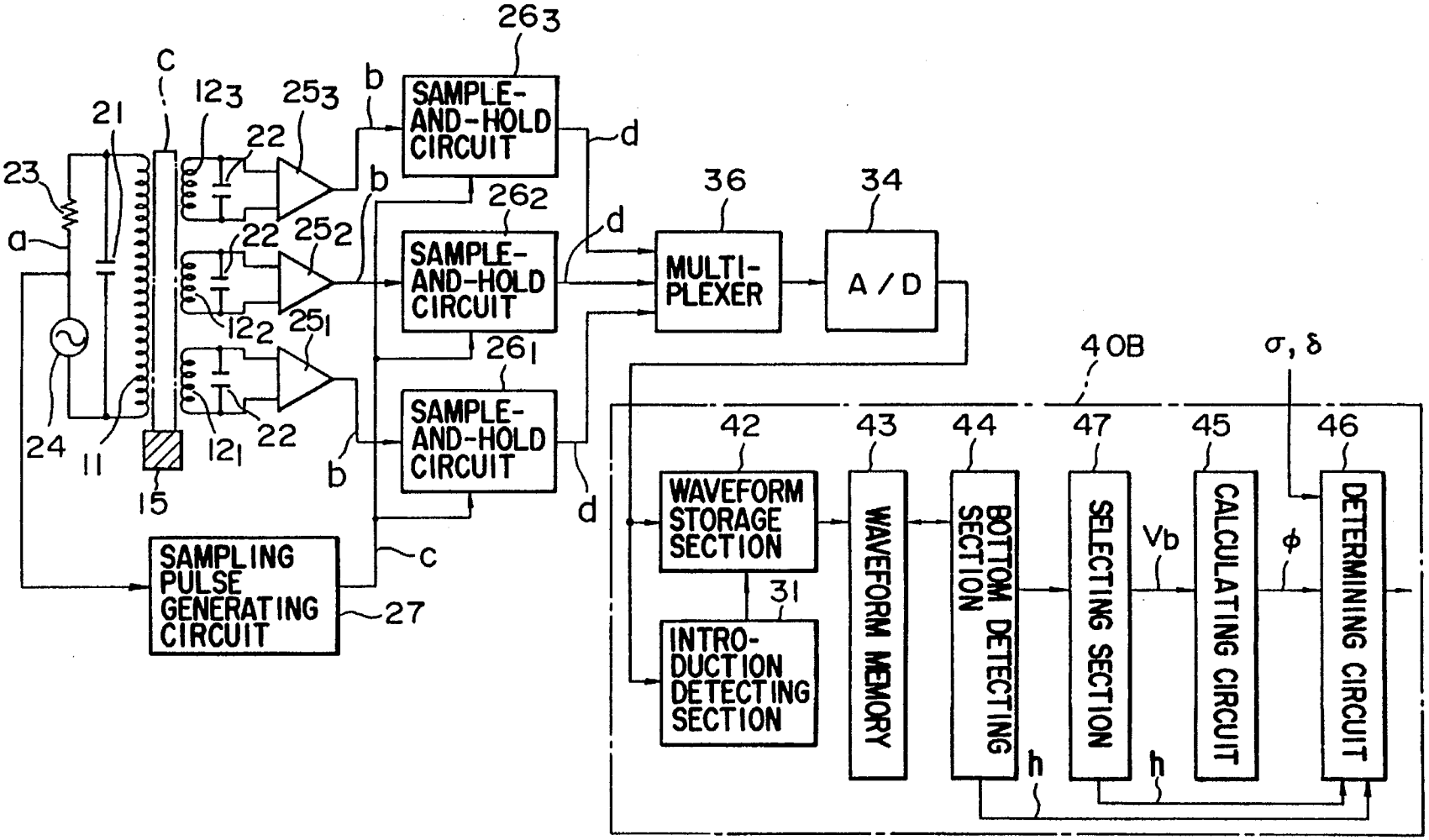
FIG. 38 is a block diagram showing the electric circuit used in the third embodiment of the present invention.

FIG. 38 shows a block diagram of an electrical circuit used in the coin discriminating apparatus according to the third embodiment of the present invention.

Referring to FIG. 38, a capacitor 21 is connected to the transmission coil 11 to constitute a resonance circuit, and capacitors 22 are connected to the reception coils $\mathbf{12}_1$, $\mathbf{12}_2$, and $\mathbf{12}_3$ to constitute resonance circuits. A frequency output (FIG. 39A) from an oscillator 24 connected in series with a resistor 23 is applied to the transmission coil 11 to generate an alternating magnetic field. An electromotive force is generated in each of the reception coils $\mathbf{12}_1$, $\mathbf{12}_2$, and $\mathbf{12}_3$ by this alternating magnetic field. When the coin C passes the reception coils $\mathbf{12}_1$, $\mathbf{12}_2$, and $\mathbf{12}_3$, an eddy current is generated in the coin C by the alternating magnetic field, and electromotive forces are generated in the reception coils $\mathbf{12}_1$, $\mathbf{12}_2$, and $\mathbf{12}_3$ also by a magnetic field generated by this eddy current. Hence, electric signals are generated in the reception coils $\mathbf{12}_1$, $\mathbf{12}_2$, and $\mathbf{12}_3$. Signals (FIG. 39B) amplified by buffer amplifiers $\mathbf{25}_1$, $\mathbf{25}_2$, and $\mathbf{25}_3$ are supplied to sample-and-hold circuits (phase-detection circuits) $\mathbf{26}_1$, $\mathbf{26}_2$, and $\mathbf{26}_3$.

Figures 39A, 39B, 39C, 39D:
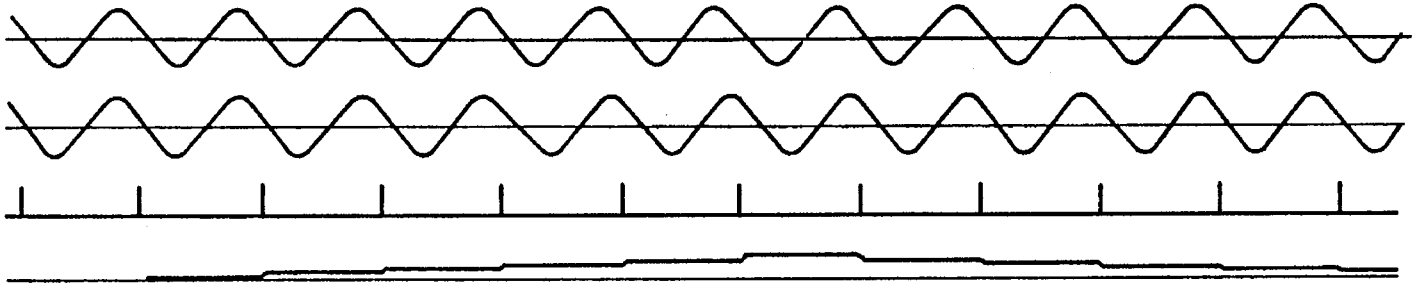
FIGS. 39A to 39D are charts showing the output waveforms of the respective portions of the block diagram of FIG. 38.

The sample-and-hold circuits $\mathbf{26}_1$, $\mathbf{26}_2$, and $\mathbf{26}_3$ are driven by a sample pulse (FIG. 39C) generated by a sample pulse generating circuit 27 and having the same phase as that of the drive signal of the transmission coil 11, i.e., a phase difference of 90°, sample the signals from the buffer amplifiers $\mathbf{25}_1$, $\mathbf{25}_2$ and $\mathbf{25}_3$ as indicated by FIG. 39D, and convert the signals into voltage levels, thereby converting them to DC signals.

As described above, when the coin inserted from the coin slot passes between the transmission coil 11 and the reception coils $\mathbf{12}_1$, $\mathbf{12}_2$, and $\mathbf{12}_3$, the eddy current is generated by the alternating magnetic field generated by the transmission coil 11 to flow in the coin, and a new magnetic field is generated by this eddy current. As described above, when the magnetic field frequency is relatively high, the position on the coin where the eddy current flows does not depend on the conductivity or thickness but is substantially constant on the peripheral portion of the coin. Change amounts in output from the reception coils $\mathbf{12}_1$, $\mathbf{12}_2$, and $\mathbf{12}_3$ caused by the magnetic field of this eddy current become maximum when the front side of the coin passes the centers of the reception coils $\mathbf{12}_1$, $\mathbf{12}_2$, and $\mathbf{12}_3$ and when the rear side of the coin passes the centers of the reception coils.

Figures 40A, 40B, 40C:
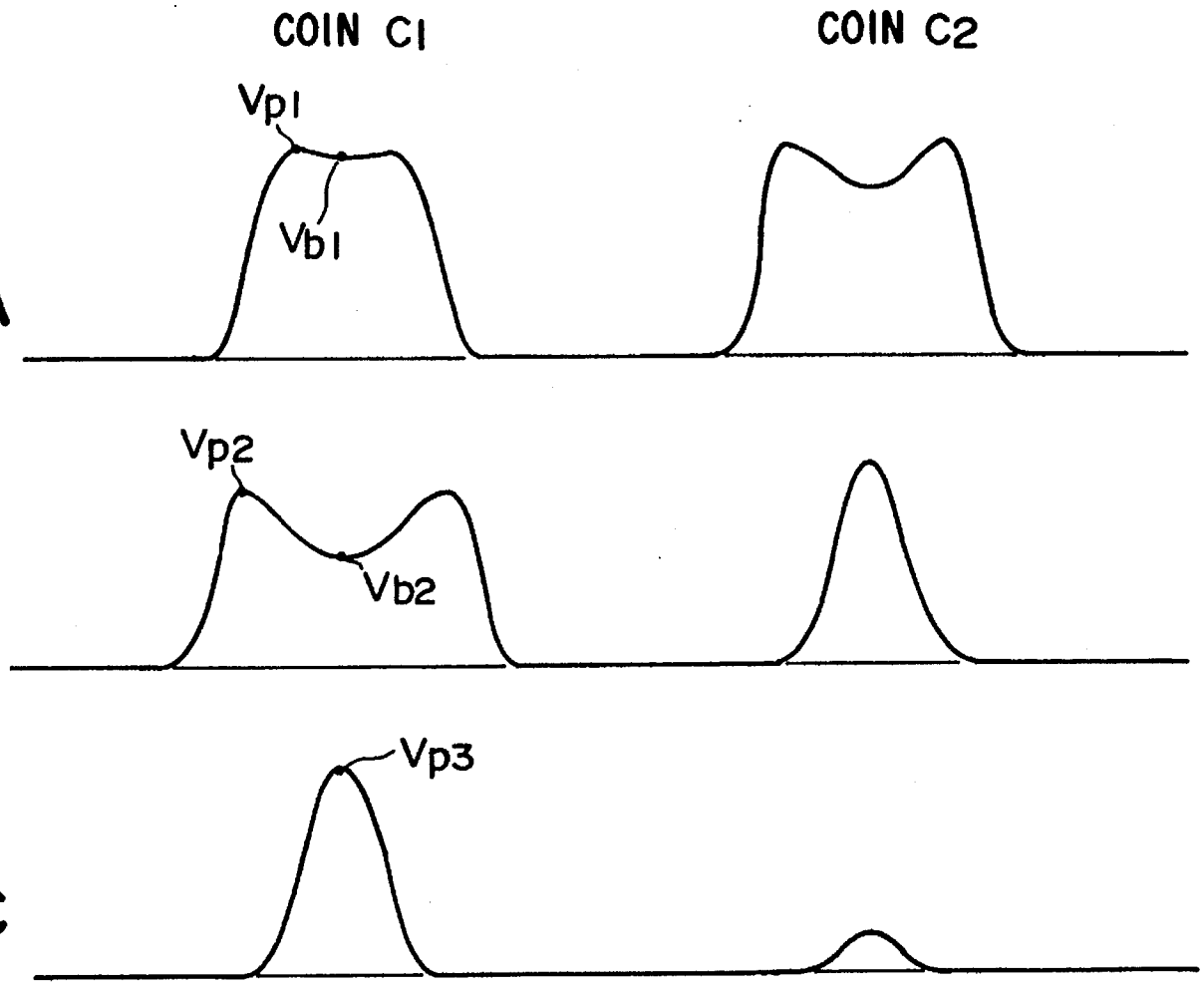
FIGS. 40A to 40C are charts showing the detection waveforms obtained by the respective reception coils and corresponding to two denominations of coins.

Hence, for example, as shown in FIG. 35, when a coin $C_1$ having a diameter almost equal to the distance between the rail 15 and the reception coil $\mathbf{12}_3$ is introduced, the detection waveform obtained by the reception coil $\mathbf{12}_1$ is a double-peak waveform close to a one-peak waveform having a small difference between its peak and bottom values $V_{p1}$ and $V_{b1}$, as shown in FIG. 40A, the detection waveform obtained by the reception coil $\mathbf{12}_2$ is a double-peak waveform having a large difference between its peak and bottom values $V_{p2}$ and $V_{b2}$, as shown in FIG. 40B, and the detection waveform obtained by the reception coil $\mathbf{1}_{23}$ is a one-peak waveform having only a peak value $V_{p3}$, as shown in FIG. 40C.

When a coin $C_2$ having a diameter close to the height of the reception coil $\mathbf{12}_2$ measured from the rail 15 is moved, the two-peak characteristics of the detection waveform obtained by the lower reception coil $\mathbf{12}_1$ are enhanced, the detection waveform obtained by the central reception coil 122 becomes a one-peak waveform, and the detection waveform obtained by the upper reception coil $\mathbf{12}_3$ becomes a one-peak waveform having a very small peak value.

Signals from the sample-and-hold circuits $\mathbf{26}_1$, $\mathbf{26}_2$, and $\mathbf{26}_3$ are input to an A/D converter 34 through a multiplexer 36, converted into digital signals, and input to a processing unit 40B including a CPU.

In the processing unit 40B, the fact that either one output from the A/D converter 34 exceeds a predetermined value as the coin is introduced into the magnetic field is detected by an introduction detecting section 31, and the output waveforms supplied in units of reception coils from the A/D converter 34 are stored in a waveform memory 43 by a waveform storage section 42. A bottom detecting section 44 obtains the bottom values $V_b$ of the respective waveforms stored in the waveform memory 43.

A selecting section 45 preferentially selects, of the bottom values detected by the peak/bottom detecting section 44, a bottom value equal to or more than $V_1$ but not exceeding $V_2$ which is obtained by a reception coil at a higher position, and outputs it to a calculating section 45.

The calculating section 45 calculates $$\phi = AV_b + B$$

by using the bottom value $V_b$ selected by the selecting section 47 and outputs it to a determining section 46.

As described above with reference to FIG. 33, since constants A of proportion are substantially equal for the respective reception coils and constants B of proportion are different in units of reception coils, the calculating section 45 performs calculation by using, from constants $B_1$, $B_2$, and $B_3$ of the respective reception coils, a constant of a selected reception coil. These constants A and B experimentally obtained in advance are set as the reference values.

In the bottom detecting section 44 or the selecting section 47, if it is determined that the detection waveforms obtained by the three reception coils are one-peak waveforms or do not fall within the range of $V_1$ to $V_2$, a return signal h indicating that the coin in question is a counterfeit coin having a diameter smaller or larger than the allowable range is output to the determining section 46.

The determining section 46 compares a diameter $\phi$ output from the calculating section 45 and a conductivity $\sigma$ and a thickness $\delta$, that are obtained by other discriminating means or the like described in the first and second embodiments, with preset reference values, having specific numerical ranges, of a several denominations of coins. If the diameter $\phi$, the conductivity $\sigma$, and the thickness $\delta$ fall within a range of a certain coin, it is determined that the coin in question is the specific coin. If the diameter $\phi$, the conductivity $\sigma$, and the thickness $\delta$ fall outside this range, or if the return signal h is received, it is determined that the coin in question is a counterfeit coin, and a determination signal is output. In this manner, the authenticity or denomination of the coin is determined, and the coin is directed in a storing or discharge direction or the like by a coin sorting unit (not shown) on the basis of the determination signal.

Figure 41A:
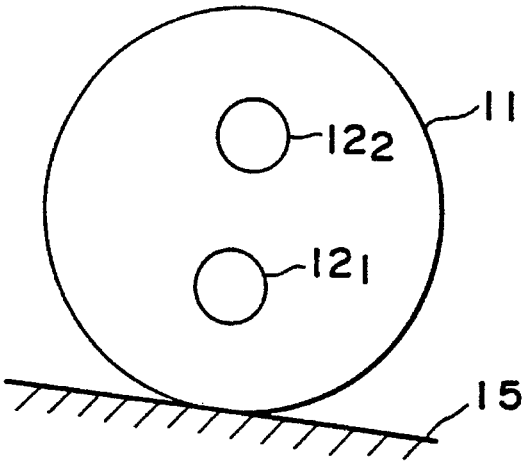
FIGS. 41A to 41C are views showing modifications of the number of reception coils and the arrangements thereof.

In the above embodiment, the diameter value of a coin is calculated by selecting a bottom value falling within the predetermined range from the three reception coils $12_1$, $12_2$, and $12_3$. As shown in FIG. 41A, the number of reception coils may be set to two, or as shown in FIGS. 41B and 41C, four reception coils $12_1$, $12_2$, $12_3$, and $12_4$ may be used.

Figure 41B:
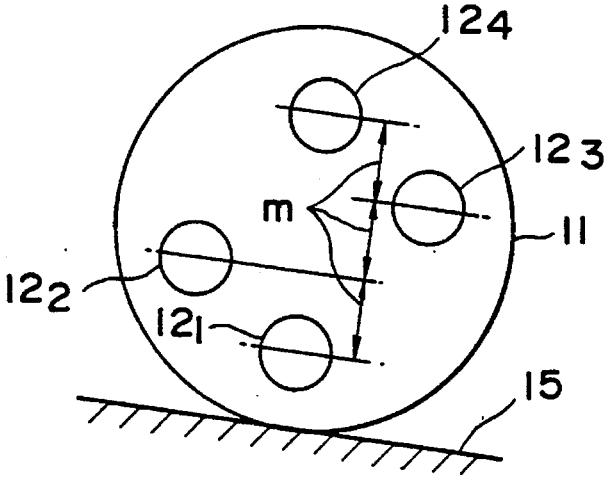
Figure 41C:
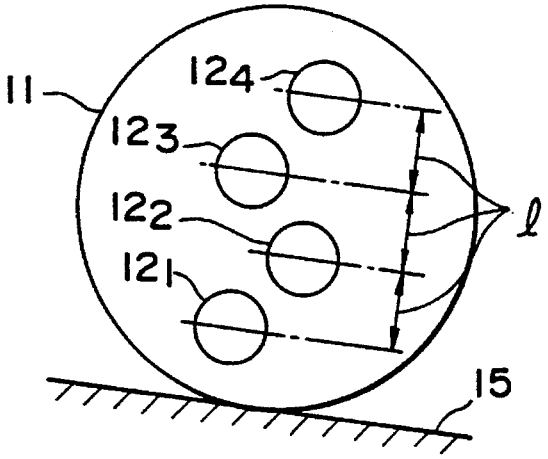

When the number of reception coils is to be increased in order to obtain a wide diameter detection range, if the reception coils $12_1$, $12_2$, $12_3$, and $12_4$ are disposed at shifted positions in the coin moving direction while maintaining the same gap in the direction of height, as shown in FIGS. 41B and 41C, an increase in diameter of the transmission coil 11 can be prevented.

In the above embodiment, the reception coils have the same diameter. However, for example, the diameter of a lower reception coil may be set to smaller than that of an upper reception coil in accordance with the diameter range of a coin to be detected.

In the above embodiment, the constants A of proportion for the bottom values of the respective reception coils are equal. However, the diameter may be calculated by using different constants of proportion for different reception coils. When the bottom value has a slight dependency not only on the diameter but also on the material (conductivity $\sigma$) and the thickness $\delta$ and the influence of this dependency is not negligible, calculation may be performed by including in B, values ($D\sigma+E\delta$), obtained by multiplying $\sigma$ and $\delta$ obtained in separate discriminating means by dependencies D and E, as correction constants, as described above.

In the above embodiment, sampling is performed in a 90° phase where the detection values from the respective reception coils become substantially zero when a coin does not exist. However, sampling may be performed in a 0° phase, as described above.

Figure 42:
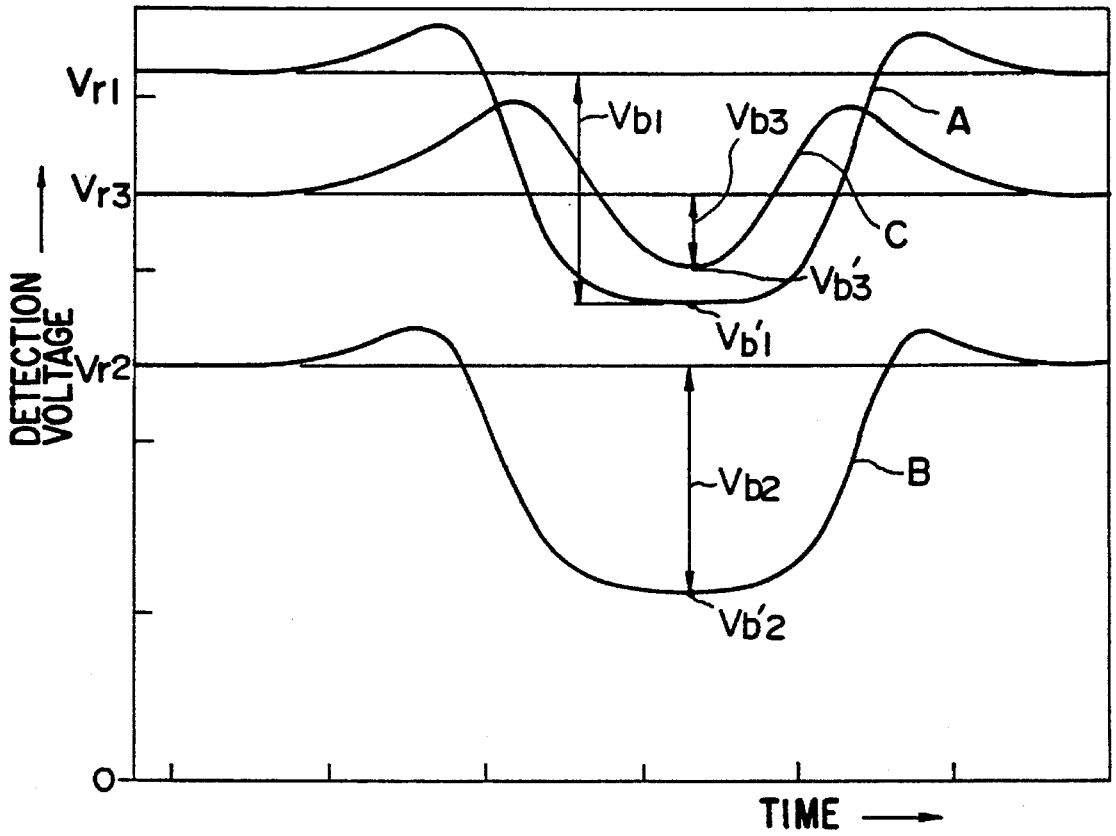
FIG. 42 is a chart showing detected waveforms obtained by the 0° sampling.

FIG. 42 shows detection waveforms in units of reception coils when sampling is performed in a 0° phase. Referring to FIG. 42, curves A, B, and C are detection waveforms of the lower, intermediate, and upper reception coils $12_1$, $12_2$, and $12_3$, respectively. If bottom values $V_{b1}$, $V_{b2}$, and $V_{b3}$ obtained in this case are defined by differences between output values $V_{r1}$, $V_{r2}$, and $V_{r3}$ in the absence of a coin and true bottom values $V_{b1}'$, $V_{b2}'$, and $V_{b3}'$, the equations described above can similarly be applied. It was experimentally confirmed that when sampling in a 0° phase was employed, the dependency of the bottom value on the conductivity and thickness of the coin can further be decreased.

The diameter of a coin may be calculated not only in accordance with the sampling type magnetic field change detecting method as in the above embodiment, but also by performing envelope detection of an induced signal and using the bottom value of the detection output in this case, bottom values proportionally dependent only on the diameter can be obtained from the respective reception coils, in the same manner as in sampling in a 0° phase.

Figure 43:
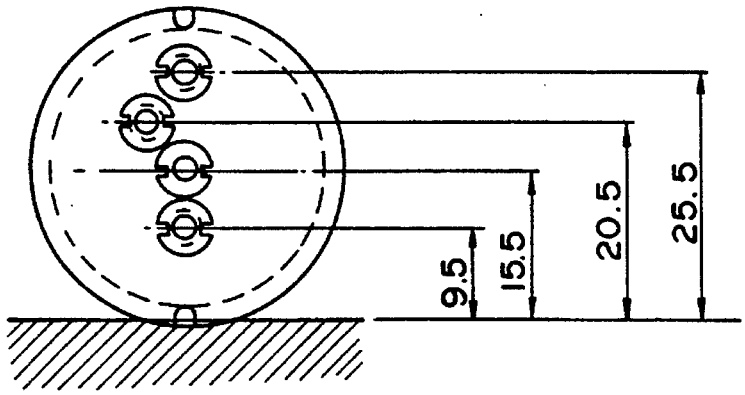
FIG. 43 is a view showing the actual positional relationship when four reception coils are used.

FIG. 43 shows an arrangement when the four reception coils $12_1$, $12_2$, $12_3$, and $12_4$ described above are used. More specifically, the first, second, and fourth reception coils $12_1$, $12_2$, and $12_4$ are on the vertical central line of a transmission coil 11 and are arranged at heights of 9.5 mm, 15.5 mm, and 25.5 mm, respectively, from a rail 15. The third reception coil $12_3$ is arranged slightly on the left side from the vertical central line of the transmission coil 11 and at a height of 20.5 mm from the rail 15.

As described above, in the coin diameter discriminating apparatus according to the third embodiment of the present invention, a change in magnetic field generated by an eddy current generated in a coin is detected by a plurality of reception coils arranged at different heights with respect to a coin track, bottom values having a dependency substantially only on the diameter of the coin are detected, the bottom value of a reception coil that falls within a predetermined range is selected from the bottom values, and the diameter is calculated from the selected bottom value.

For this reason, according to the discriminating apparatus of the third embodiment, diameter detection of a wide range from small- to large-diameter coins can be performed remarkably accurately with a small number of reception coils in a state wherein the influence of a change in material or thickness of the coin is very small.

In the coin discriminating apparatus according to the third embodiment in which the plurality of reception coils are arranged on the same plane in the transmission coils and integrated, since the coils can be easily mounted on the coin track, and the positions of the transmission and reception coils relative to each other do not change, constantly stable magnetic field detection can be performed, and diameter detection precision is very high.

Figure 44:
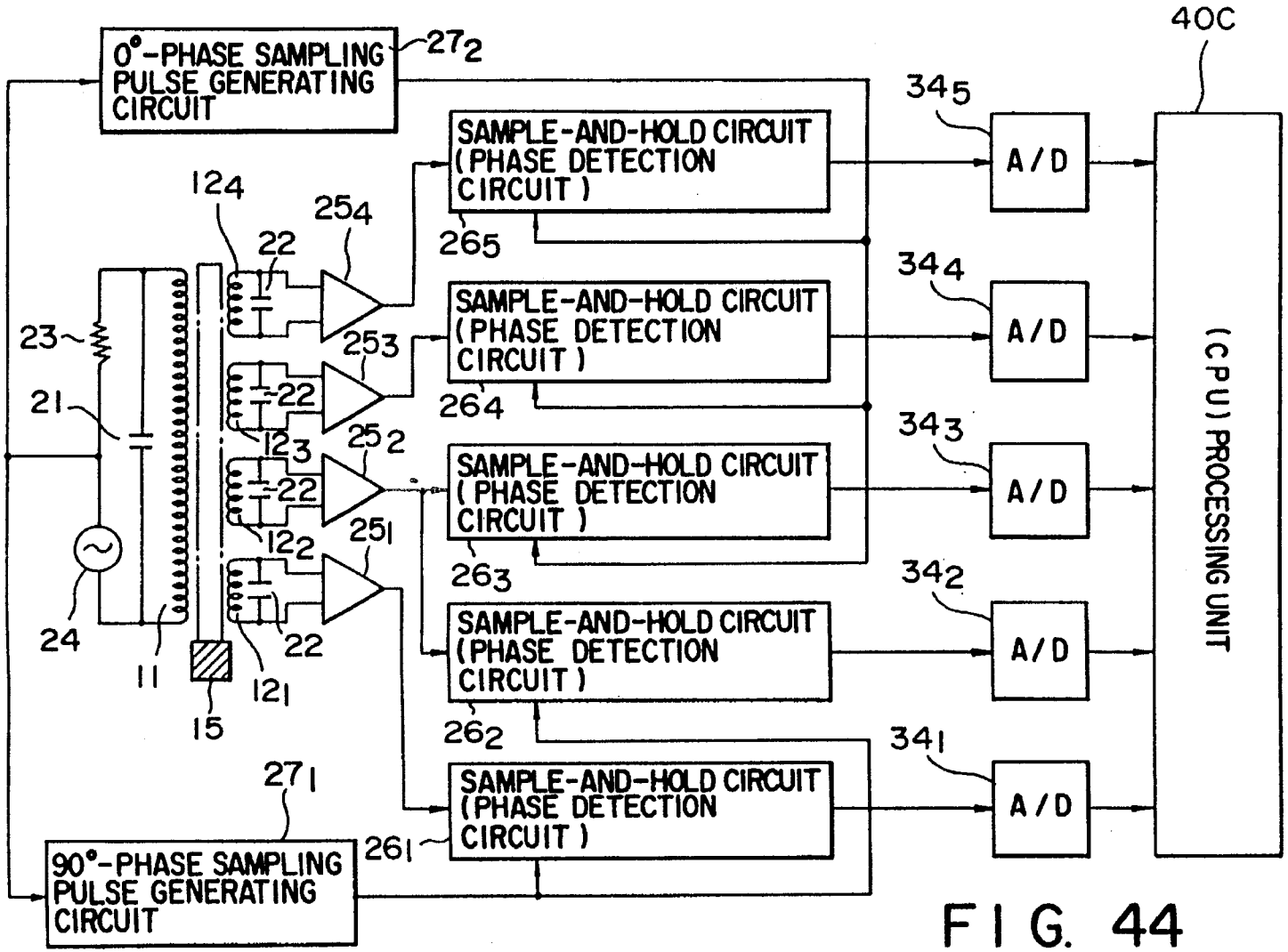
FIG. 44 is a block diagram showing the electric circuit used in the fourth embodiment of the present invention.

FIG. 44 shows an electric circuit employed when four reception coils $12_1$, $12_2$, $12_3$, and $12_4$ are used in the fourth embodiment. More specifically, in the same manner as shown in the first and second embodiments, the first and second reception coils $12_1$ and $12_2$ are used for detecting the thickness/material of the coin, and outputs from these coils are sampled (phase-detected) by a 90°-phase sampling pulse output from a 90°-phase sample pulse generating circuit $27_1$. In the same manner as shown in the third embodiment, the second, third, and fourth reception coils $12_2$, $12_3$, and $12_4$ are used for detecting the diameter of the coin, and outputs from these coils are sampled (phase-detected) by a 0°-phase sampling output from a 0°-phase sample pulse generating circuit $27_2$.

Figure 45:
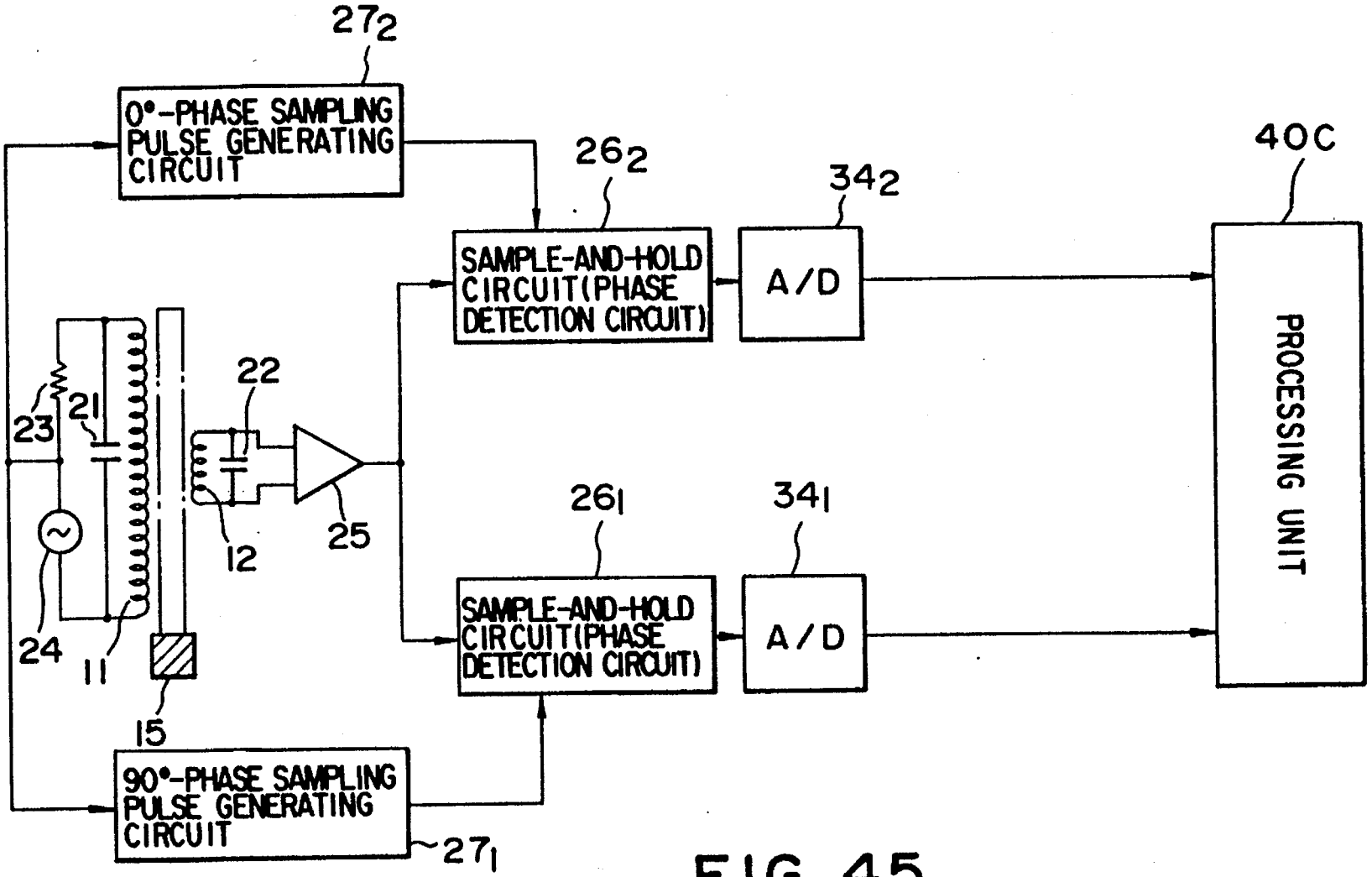
FIG. 45 is a block diagram showing the electric circuit used in the fifth embodiment of the present invention.

Referring to FIG. 45, reference numerals $25_1$ to $25_4$ denote buffer amplifiers; $26_1$ to $26_5$, sample-and-hold circuits (phase detection circuits); and $34_1$ to $34_5$, A/D converters. Reference symbol 40C denotes a processing unit including a CPU. Other than this, the arrangement of FIG. 44 is the same as that of FIG. 38.

More specifically, in this embodiment, the processing unit 40C performs discrimination on the basis of outputs obtained by sampling (phase-detecting) outputs from the first and second reception coils $12_1$ and $12_2$ with a 90°-phase sample pulse, in order to detect the thickness/material of the coin in the same manner as described above in the first and second embodiments, and performs discrimination on the basis of outputs obtained by sampling (phase-detecting) outputs from the second, third, and fourth reception coils $12_2$, $12_2$, $12_3$, and $12_4$ with a 0°-phase sample pulse, in order to detect the diameter of the coin in the same manner as described above in the third embodiment.

FIG. 45 shows the fifth embodiment in which detection of thickness/material of the coin and detection of the diameter of the coin are performed on the basis of an output from one reception coil 12. Referring to FIG. 45, the same portions as in FIGS. 38 and 44 are denoted by the same reference numerals, and a detailed description thereof will be omitted.

More specifically, according to the fourth and fifth embodiments, not only the thickness and material of a coin but also the diameter of a coin can be discriminated more accurately.

The sixth embodiment of the present invention will be described with reference to the accompanying drawings.

Figure 46:
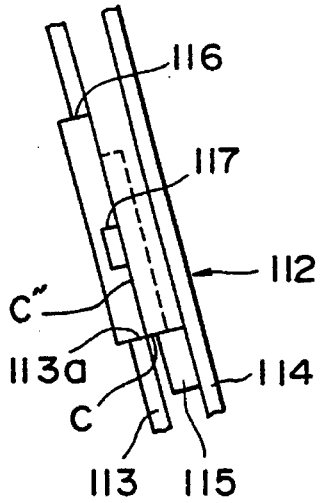
FIG. 46 is a sectional view showing the coin track used in the sixth embodiment of the present invention.
Figure 47:
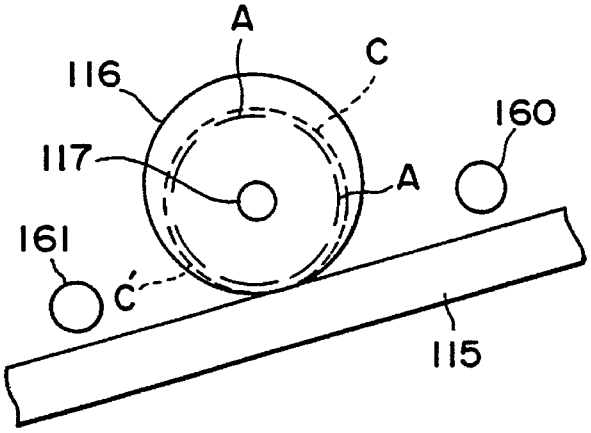
FIG. 47 is a view for schematically explaining the sixth embodiment of the present invention.

FIGS. 46 and 47 show an arrangement of a coin track of the sixth embodiment of the present invention.

A coin C inserted through a coin slot drops onto a coin track 112. The coin track 112 is constituted by a base plate 113 inclined with respect to a vertical plane, a cover plate 114 at a predetermined gap from and parallel to the base plate 113, and a rail 115 mounted on the cover plate 114 to be inclined with respect to the horizontal line. When the coin C drops onto the coin track 112, it falls in rolling contact with the inclined rail 115 while its circumferential surface C' contacts the rail 115 and its face C" contacts the base plate 113.

A transmission coil 116 is provided within a plane in the base plate 113, which is substantially parallel to the base plate 113, and a reception coil 117 smaller than the transmission coil 116 is provided in the transmission coil 116.

Figure 48:
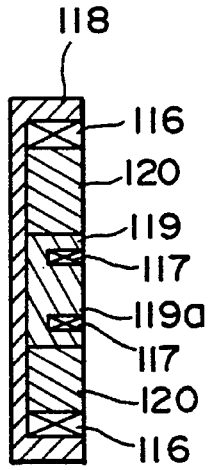
FIG. 48 is a sectional view showing the arrangement of transmission/reception coils used in the sixth embodiment of the present invention.

As shown in FIG. 48, the transmission coil 116 is wound on a bobbin, and this bobbin is fitted in a large cylindrical bottomed core 118. The reception coil 117 is wound on a bobbin, and this bobbin is fitted in an annular groove 119a of a small-diameter core 119. The large-diameter core 118 is fitted in a round hole 113*a* of the base plate 113 and fixed to be the same level as that of the surface of the base plate 113. Reference numeral 120 denotes an annular spacer or part of the large-diameter core 118.

The size (outer diameter) of the reception coil 117 must be much smaller than the diameter of the coin C and is preferably 0.25 times or less the diameter of the coin. The reception coil 117 is preferably mounted near a position corresponding to the center of a passing coin. When a plurality of coins are to be used, the reception coil 117 is preferably mounted slightly above a position corresponding to the center of the minimum-diameter coin.

The transmission coil 116 must be much larger than the reception coil 117, and its size (outer diameter) is preferably 0.5 times or more the diameter of the coin C.

Figure 49:
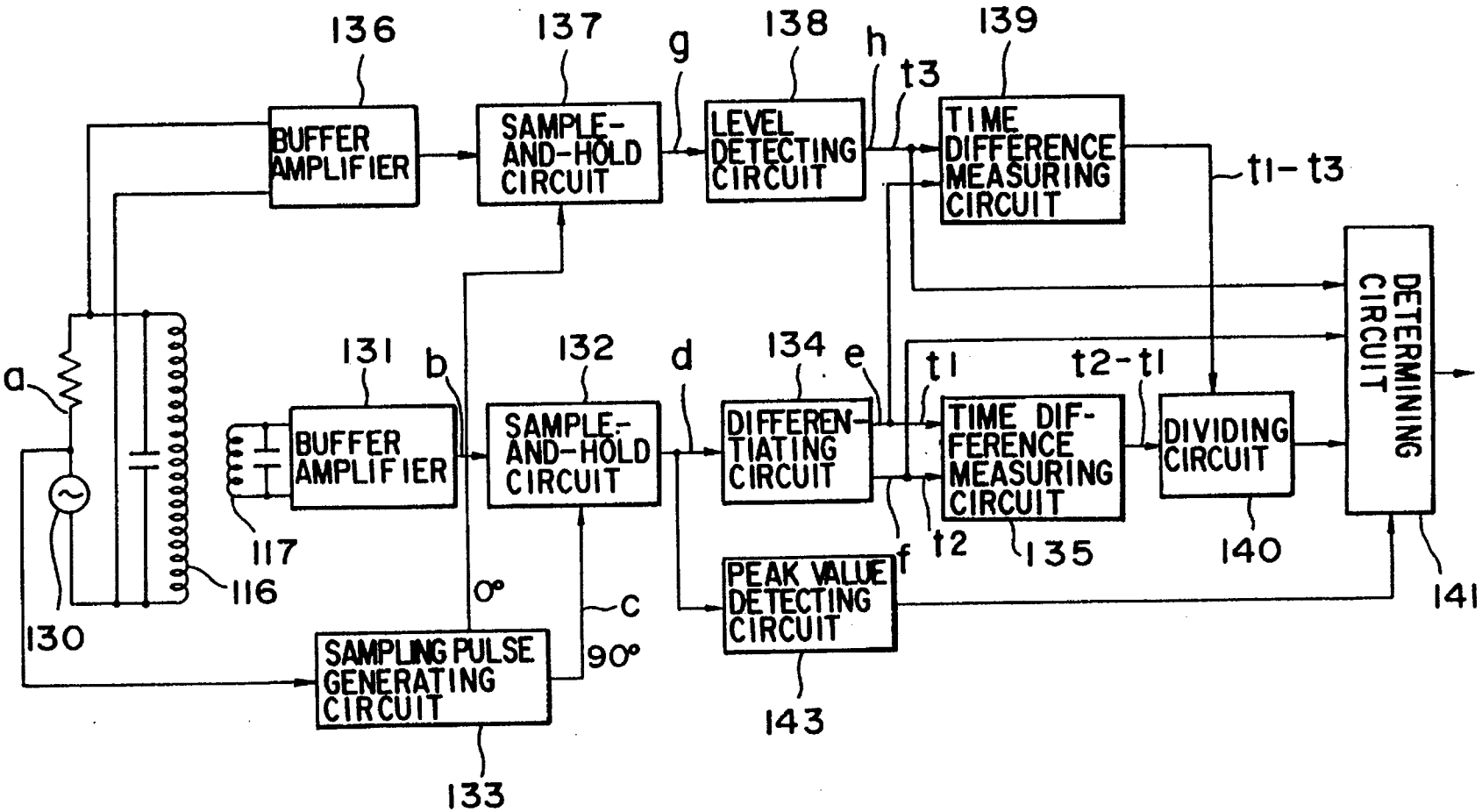
FIG. 49 is a block diagram showing the electric circuit configuration used in the sixth embodiment of the present invention.

FIG. 49 shows the arrangement of the electric circuit of a coin diameter detecting apparatus using these transmission and reception coils 116 and 117.

Figures 50A, 50B, 50C, 50D:
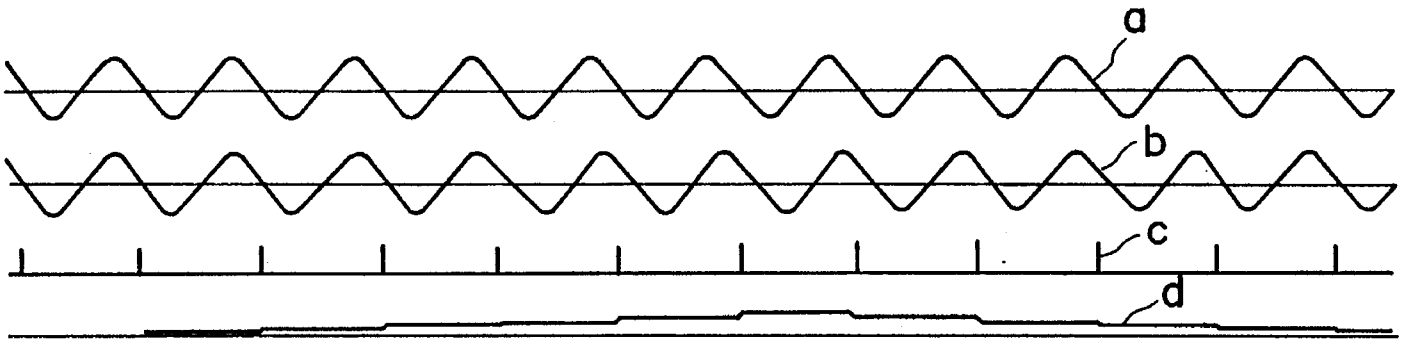
FIGS. 50A to 50D are charts showing the waveforms of the output signals of the respective portions of the electric circuit of FIG. 49.

A high-frequency output (FIG. 50A) from an oscillator 130 is applied to the transmission coil 116 to generate an alternating magnetic field. Then, an electric signal appears in the reception coil 117. This signal is amplified by a buffer amplifier 131, and the amplified signal (FIG. 50B) is supplied to a sample-and-hold circuit (phase detection circuit) 132. The sample-and-hold circuit 132 is driven by a sampling pulse (FIG. 50C) delayed by 90° from the drive signal for the transmission coil 116 generated by a sampling pulse generating circuit 133, and converts the signal from the buffer amplifier 131 into a voltage level signal by sampling. Hence, as shown in FIG. 50B, when the output signal from the reception coil 117 changes, as shown in FIG. 50D, this change appears as a change in voltage level.

The phase of the sampling pulse is delayed from the drive signal for the transmission coil 116 by 90° due to the following reason. A phase difference of 90° exists between an electromotive force generated in the reception coil 117 in the absence of a coin and an electromotive force generated in the reception coil 117 by the magnetic field of the eddy current in the coin. In order to derive the electromotive force of the reception coil 117 generated by the magnetic field of the eddy current in the coin the sample signal is preferably delayed by 90°.

Figure 51:
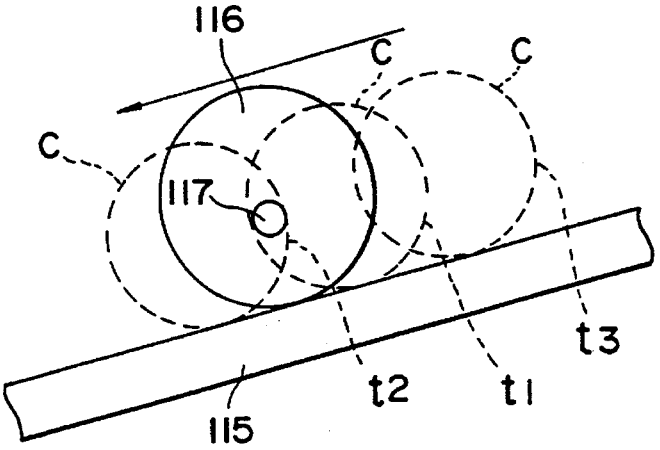
FIG. 51 is a view for explaining the relationship among the position of a coin and transmission/reception coils.
Figures 52A, 52B, 52C, 52D, 52E:
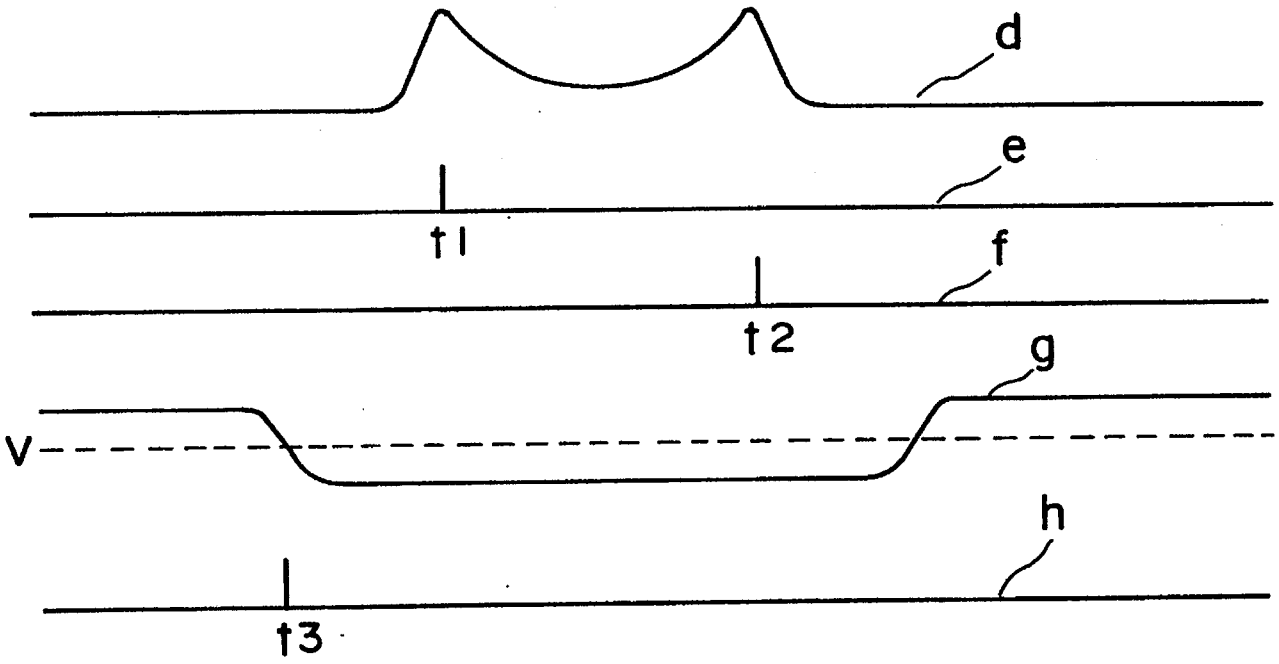
FIGS. 52A to 52E are charts showing the waveforms of the output signals of the respective portions of the electric circuit of FIG. 49.

When the coin inserted from the coin slot passes between the transmission and reception coils 116 and 117, the eddy current is generated by the alternating magnetic field generated by the transmission coil 116 to flow in the coin, and a new magnetic field is generated by this eddy current. When the frequency is high, the position on the coin where the eddy current flows is centralized on the peripheral portion of the coin regardless of the conductivity or thickness of the coin, as indicated by an arrow A in FIG. 47 (the higher the frequency, the outer portion the eddy current is centralized). Hence, as shown in FIG. 51, the magnetic flux generated by the eddy current links to the reception coil 117 at a timing $t_1$ when the front peripheral portion of the coin C passes in front of the coin C and a timing $t_2$ when the rear peripheral portion of the coin C passes in front of the coin C. Thus, the sample-and-hold circuit 132 outputs a signal having two peaks, as shown in FIG. 52A. The time between the timings $t_1$ and $t_2$ of the two peaks depends on the diameter of the passing coin C.

This signal is input to a differentiating circuit 134, and outputs (FIGS. 52B and 52C) are extracted at the timings $t_1$ and $t_2$ when the gradient of the signal is changed from positive to negative.

A time difference $(t_2-t_1)$ between the two peaks is measured by a time difference measuring circuit 135 using a clock circuit, a time constant circuit, or the like.

The voltages across the transmission coil 116 are amplified by a buffer amplifier 136, and the amplified signals are supplied to a sample-and-hold circuit 137. The sample-and-hold circuit 137 is driven by a sampling pulse having a phase delayed from that of the signal from the transmission coil 116 by 0°, and samples the signal from the buffer amplifier 136. The sampling pulse is phase-locked with the signal from the transmission coil 116 in order to obtain a large, fast-rising signal in which both amplitude and phase change.

When the coin passes in front of the transmission coil 116, since the output from the transmission coil 116 is decreased by a change in impedance caused by the coin, the output from the sample-and-hold circuit 137 is changed as shown in FIG. 52D. This signal is input to a level detecting circuit 138 and a timing $t_3$ (FIG. 52E) (i.e., the timing $t_3$ when the coin C reaches the transmission coil 116, as shown in FIG. 51) when this signal becomes lower than a reference level V is extracted, and a time difference $(t_1-t_3)$ is measured by a time difference measuring circuit 139. The reciprocal number $1/(t_1-t_3)$ of the time difference $(t_1-t_3)$ is proportional to the passing speed of the coin ($t_2$ may be used in place of $t_1$). Accordingly, when the time difference $(t_2-t_1)$ is divided by the time difference $(t_1-t_3)$ by a dividing circuit 140, the value $(t_2-t_1)/(t_1-t_3)$ represents the diameter data of the coin.

This result is compared with reference values corresponding to several denominations of coins and respectively having specific numerical ranges by a determining circuit 141. If the resultant value does not fall within the range of any coin, the determining circuit 141 determines that the coin in question is a counterfeit coin and outputs a determination signal. The determination signal is reset upon output from a level detecting circuit 138 representing the insertion of a coin, and latched at the timing $t_2$ of the differentiating circuit 134 representing that the coin has passed.

In the embodiment of FIG. 49, if the peak value of the output of the reception coil 117 from the sample-and-hold circuit 132 is detected by a peak value detecting circuit 143 and determination of comparison of the peak value with the reference value in accordance with the specific materials and thickness of various denominations of coins is performed by the determining circuit 141, the material and thickness of the coin can also be detected.

Figure 53:
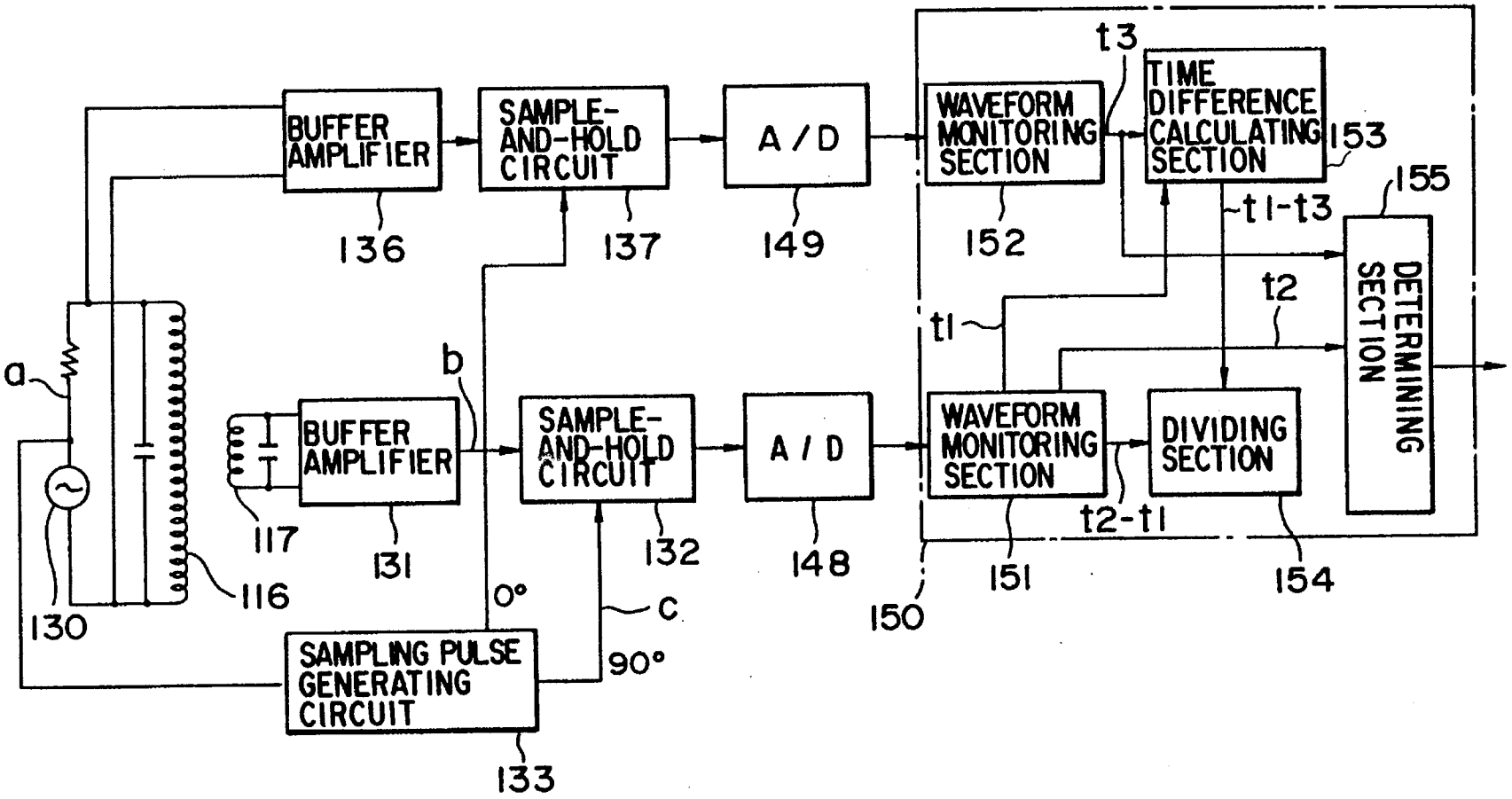
FIG. 53 is a block diagram showing another embodiment of the present invention.
Figure 54:
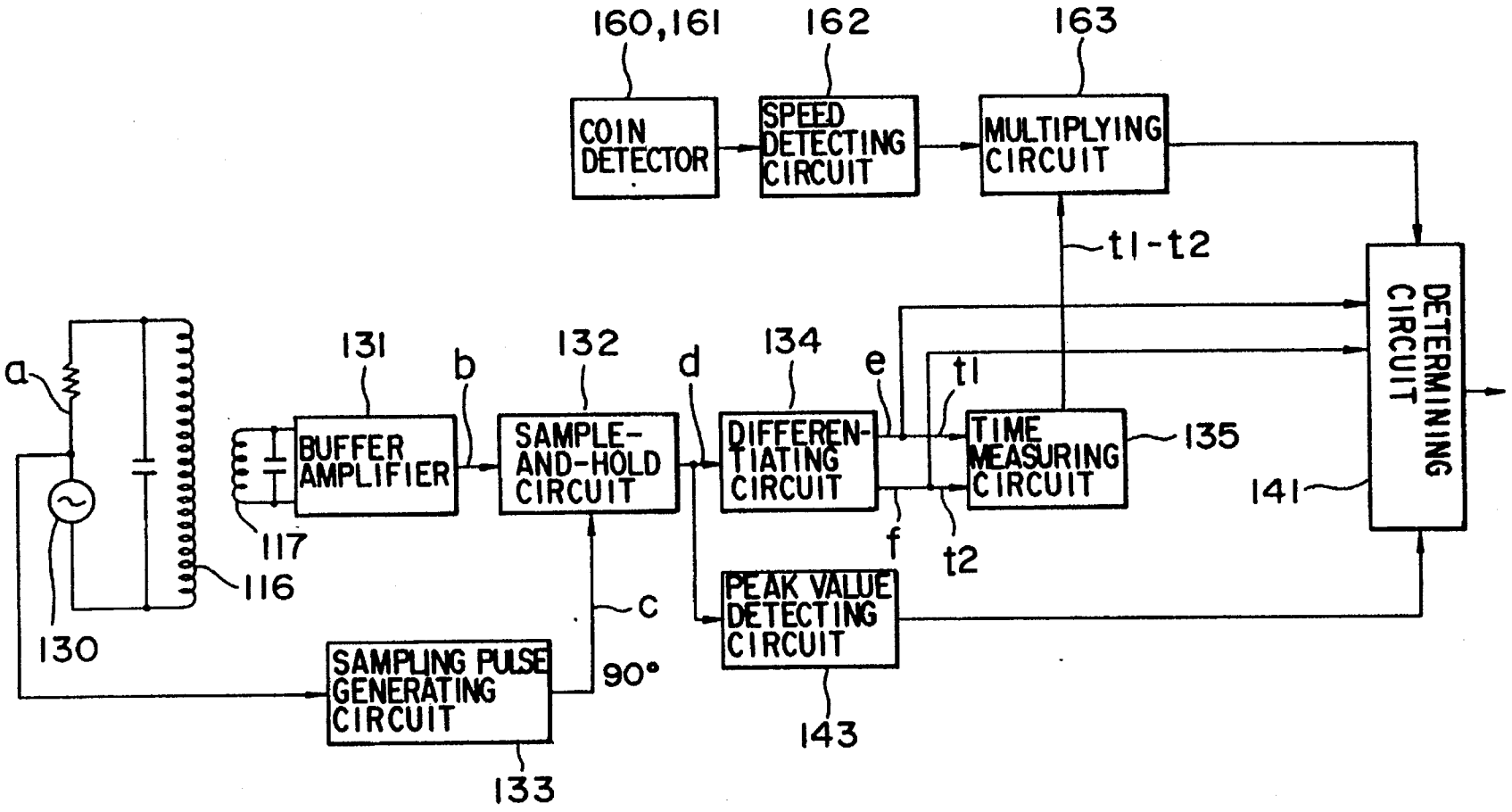
FIG. 54 is a block diagram showing still another embodiment of the present invention.

FIG. 53 shows another embodiment of the present invention. More specifically, in this embodiment, outputs from sample-and-hold circuits 132 and 137 are respectively A/D-converted by A/D converting circuits 148 and 149, and the digital values are detected by waveform monitoring sections 151 and 152 of a CPU 150. In this case, the waveform monitoring section 151 outputs a time difference $(t_2-t_1)$, and a time difference calculating section 153 calculates a time difference $(t_1-t_3)$. A dividing section 154 calculates $(t_2-t_1)/(t_1-t_3)$, and a determining section 155 compares it with a reference value, thereby determining the authenticity and denomination of the coin. In the embodiment of FIG. 49, the passing speed of the coin is detected by the timing $t_3$ when the level of the signal of the transmission coil 116 changes and the timing of the first peak value of the output from the reception coil 117, and the diameter of the coin is detected by the coin speed and the time between the two peak values of the output from the reception coil 117. However, the passing speed of the coin can be detected in accordance with various other methods. For example, as shown in FIG. 47, coin detectors (e.g., photodetectors or detection coils) 160 and 161 may be provided at two locations in the coin moving direction. Then, as shown in FIG. 54, the passing speed of the coin is detected by a speed detecting circuit 162 from the time difference between detecting operations at these two locations, and the speed and the time between the timings $t_1$ and $t_2$ are multiplied by a multiplying circuit 163, thereby calculating the diameter of the coin. This result is determined by a determining circuit 141.

Figure 55:
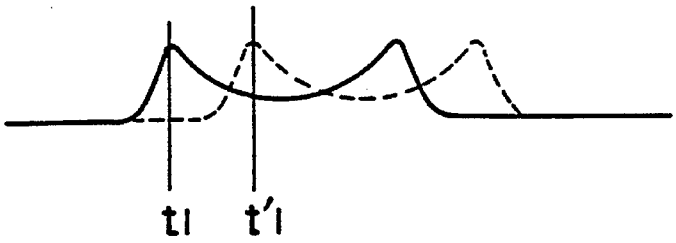
FIG. 55 is an output signal waveform chart for explaining the principle of still another embodiment of the present invention.
Figure 56:
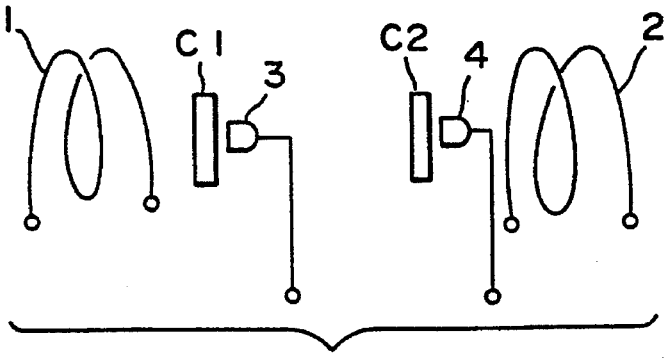
FIG. 56 PRIOR ART
FIG. 56 is a view showing the arrangement of the main part of a conventional coin discriminating apparatus.
Figure 57:
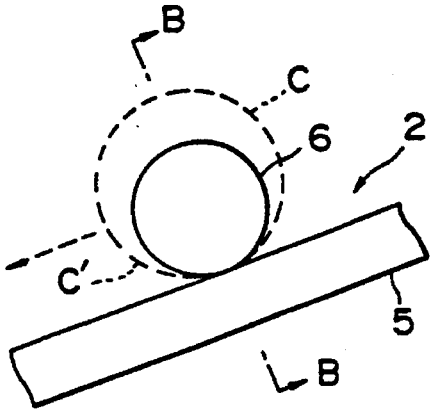
FIG. 57 PRIOR ART
FIG. 57 is a view schematically showing the arrangement of the transmission/reception coils of the conventional coin discriminating apparatus.
Figure 58:
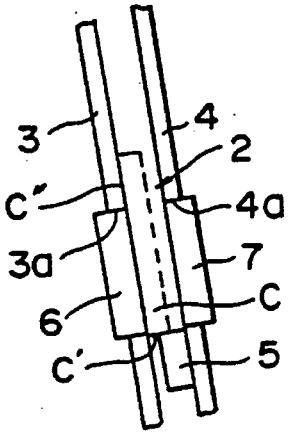
FIG. 58 PRIOR ART
FIG. 58 is a sectional view taken along the line B—B of FIG. 57.
Figure 59:
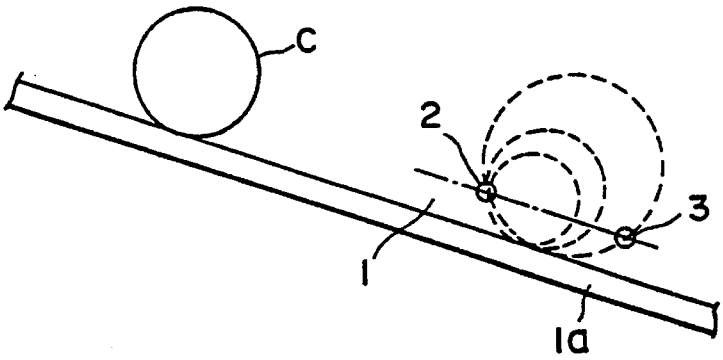
FIG. 59 PRIOR ART
FIG. 59 is a view for explaining a conventional apparatus using phototransistors.
Figure 60:
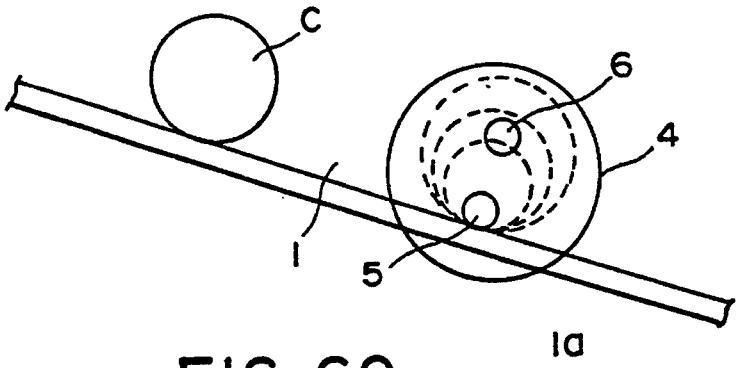
FIG. 60 PRIOR ART
FIG. 60 is a view for explaining a conventional apparatus which detects the diameter from a voltage difference between two reception coils.
Figure 61:
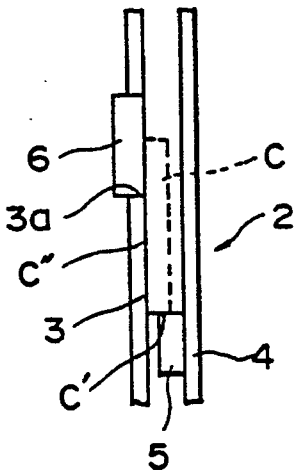
FIG. 61 PRIOR ART
FIG. 61 is a sectional view schematically showing the arrangement of a conventional diameter detecting apparatus and FIG. 62 is a view for explaining the detection principle of the conventional diameter detecting apparatus.
Figure 62:
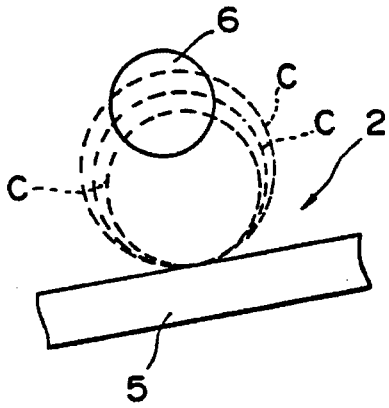
FIG. 62 PRIOR ART

If two reception coils 117, each identical to that shown in FIG. 49, are arranged in the coin moving direction at a predetermined distance, two identical signals each having two peaks can be obtained, as shown in FIG. 55. Accordingly, the passing speed can also be detected from the time difference between corresponding peak times $t_1$ and $t_1'$.

If a coin transporting apparatus is provided to set the coin passing speed constant, the value of the time difference $(t_2-t_1)$ between the two peak times can be directly used as the diameter determination data. In this case, data that can be compared with the time difference $(t_2-t_1)$ between the two peak times is stored in advance in a storage section 42. The same applies to a case wherein the coin is kept stopped and transmission and reception coils are moved at a predetermined speed.

In the above embodiment, the transmission and reception coils are provided on the same side. However, transmission and reception coils may be provided to oppose each other.

As described above, in the coin diameter detecting apparatus according to the sixth embodiment of the present invention, the magnetic field generated by the eddy current, which is generated by the alternating magnetic field, in the peripheral portion of a coin is detected by the reception coil, a double-peak waveform type signal having two peaks corresponding to the front and rear peripheral portions of the coin is generated, and a time between these two peaks irrespective of the material or thickness of the coin is detected, thereby detecting the diameter of the coin. Therefore, accurate diameter detection can be performed without being influenced by the material or thickness of the coin, thereby preventing erroneous determination of the coin.

What is claimed is:

1. A coin diameter discriminating apparatus comprising:

a transmission coil, arranged near a coin track, for applying an alternating magnetic field to a coin moving along said coin track;

a plurality of reception coils, arranged near said coin track, for detecting, as a change in an induced signal, a magnetic field generated by an eddy current within the coin to which the magnetic field from said transmission coil is applied, and the change in magnetic field during the movement of the coin;

bottom detecting means for detecting a bottom value of a waveform representing a change in the induced signal during the coin movement from each of said reception coils;

selecting means for selecting a reception coil, a bottom value of which is detected during the coin movement and falls within a predetermined range; and calculating means for calculating a diameter $\phi$ of the moving coin in accordance with a following function of diameter $$\phi=Fph(V_b)$$

on the basis of the bottom value $V_b$ of said reception coil selected by said selecting means.

2. A coin diameter discriminating apparatus according to claim 1, wherein the function of diameter is expressed by $$\phi=AV_b+B$$

where A and B are constants.

3. A coin diameter discriminating apparatus according to claim 1, wherein said plurality of reception coils are arranged in said transmission coil on a same plane on which said transmission coil is disposed, and are integrally formed with said transmission coil.

* * * * *